US006282854B1

(12) United States Patent
Vos et al.

(10) Patent No.: US 6,282,854 B1
(45) Date of Patent: Sep. 4, 2001

(54) FRAME-BASED WORKPLACE SYSTEM

(75) Inventors: Richard L. Vos, Marne; Vance B. Dang, Holland; Michael W. Eastman, West Olive; Edward L. Elzinga, Holland; James J. Thompson, Holland; David R. Williams, Holland; Michael R. Yob, Allendale, all of MI (US)

(73) Assignee: Trendway Corporation, Holland, MI (US)

( * ) Notice: Subject to any disclaimer, the term of this patent is extended or adjusted under 35 U.S.C. 154(b) by 0 days.

(21) Appl. No.: 09/325,331

(22) Filed: Jun. 3, 1999

Related U.S. Application Data

(60) Provisional application No. 60/088,070, filed on Jun. 5, 1998.

(51) Int. Cl.[7] ..... E04B 2/78

(52) U.S. Cl. ..... 52/239; 52/36.1; 52/220.7

(58) Field of Search ..... 52/36.1, 36.6, 52/220.7, 239, 481.2, 592.1, 718.01, 731.7; 248/218.4, 220.1, 300

(56) References Cited

U.S. PATENT DOCUMENTS

| | | | |
|---|---|---|---|
| D. 407,501 | 3/1999 | Shipman et al. . | |
| D. 407,587 | 4/1999 | Grabowski . | |
| D. 408,355 | 4/1999 | Welsh et al. . | |
| D. 409,419 | 5/1999 | Wilkinson . | |
| D. 415,901 | 11/1999 | Arko et al. . | |
| 3,559,813 | 2/1971 | Sosinski . | |
| 3,952,461 | 4/1976 | Kinsey . | |
| 4,265,502 | 5/1981 | Blodee et al. . | |
| 4,356,672 | 11/1982 | Beckman et al. . | |
| 4,404,776 | 9/1983 | Ball et al. . | |
| 4,634,212 | 1/1987 | Boundy et al. . | |
| 4,685,255 | 8/1987 | Kelley . | |
| 4,771,583 | 9/1988 | Ball et al. . | |
| 4,876,835 | 10/1989 | Kelly et al. . | |
| 5,015,203 | 5/1991 | Furrow . | |
| 5,031,371 | 7/1991 | Davister . | |
| 5,038,539 | 8/1991 | Kelley et al. . | |
| 5,106,173 | 4/1992 | Kelley et al. . | |
| 5,116,235 | 5/1992 | Nienhuis et al. . | |
| 5,155,955 | * 10/1992 | Ball et al. | 52/239 X |
| 5,158,472 | 10/1992 | Juhlin . | |
| 5,178,555 | 1/1993 | Kilpatrick et al. . | |
| 5,209,035 | 5/1993 | Hodges et al. . | |
| 5,252,086 | 10/1993 | Russell et al. . | |
| 5,277,609 | 1/1994 | Ondrejka . | |
| 5,410,855 | 5/1995 | Clausen et al. . | |
| 5,448,865 | 9/1995 | Palmersten . | |
| 5,491,943 | 2/1996 | Vondrejs et al. . | |
| 5,502,939 | 4/1996 | Zadok et al. . | |
| 5,546,718 | 8/1996 | Way . | |
| 5,562,469 | 10/1996 | Nienhuis et al. . | |
| 5,613,338 | 3/1997 | Esposito . | |
| 5,626,404 | 5/1997 | Kelley et al. . | |
| 5,724,778 | 3/1998 | Cornell et al. . | |
| 5,740,650 | 4/1998 | Seiber et al. . | |
| 5,746,034 | 5/1998 | Luchetti et al. . | |

(List continued on next page.)

*Primary Examiner*—Carl D. Friedman
*Assistant Examiner*—Kevin D. Wilkens
(74) *Attorney, Agent, or Firm*—Rader, Fishman, Grauer & McGarry, an Office of Rader, Fishman & Grauer PLLC

(57) ABSTRACT

An improved workspace management system for dividing a space into separate work areas comprises a rigid structural framework formed of rigid rectangular frames rigidly joined together at the edges thereof to form at least one work area. Each of the frames has outer faces on opposite sides thereof and openings on the opposite sides of the frames and a plurality of interchangeable tiles, with each of the tiles having a connector cooperating with the openings on the frames for removably mounting the tiles to the frames for ease of placement on and removal from the frames. The tiles are mounted to the outer faces of the frames to substantially cover both sides of the frames from a bottom portion thereof to a top thereof in juxtaposed parallel relationship.

91 Claims, 39 Drawing Sheets

U.S. PATENT DOCUMENTS

| | | |
|---|---|---|
| 5,746,035 | 5/1998 | Seiber et al. . |
| 5,768,840 | 6/1998 | Feldpausch et al. . |
| 5,784,843 | 7/1998 | Greer et al. . |
| 5,791,751 | 8/1998 | Meyer et al. . |
| 5,802,789 | 9/1998 | Goodman et al. . |
| 5,809,708 | 9/1998 | Greer et al. . |
| 5,813,177 | 9/1998 | Wu . |
| 5,816,001 | 10/1998 | Goodman et al. . |
| 5,822,935 | 10/1998 | Mitchell et al. . |
| 5,826,385 | 10/1998 | Dykstra et al. . |
| 5,836,112 | 11/1998 | Lindale et al. . |
| 5,836,121 | 11/1998 | Hofman . |
| 5,839,240 | 11/1998 | Elsholz et al. . |
| 5,867,955 | 2/1999 | Russell . |
| 5,886,295 | 3/1999 | Carino et al. . |
| 5,890,325 | 4/1999 | Corcorran et al. . |
| 5,893,616 | 4/1999 | MacDonald et al. . |
| 5,899,025 | 5/1999 | Casey et al. . |
| 5,899,035 | 5/1999 | Waalkes et al. . |
| 5,899,036 | 5/1999 | Seiber et al. . |
| 5,906,079 | 5/1999 | Brickner et al. . |
| 5,907,285 | 5/1999 | Toms et al. . |
| 5,934,204 | 8/1999 | Oberle . |
| 5,943,834 | 8/1999 | Jeffers et al. . |
| 5,947,569 | 9/1999 | Rheault et al. . |
| 5,950,371 | 9/1999 | Rives et al. . |
| 5,950,386 | 9/1999 | Shipman et al. . |
| 5,970,662 | 10/1999 | Corcorran et al. . |

* cited by examiner

FRAME-BASED WORKPLACE SYSTEM

CROSS-REFERENCE TO RELATED APPLICATIONS

This application claims the benefit of Provisional Application Ser. No. 60/088,070, filed on Jun. 5, 1998.

BACKGROUND OF THE INVENTION

1. Field of the Invention

The invention relates to a frame-based workspace definition system and, more specifically, to a frame-based workspace definition system comprising a framework defined by interconnected frames with attached tiles and accessories, such as worksurfaces, overhead bins, pedestals and shelves, mounted on vertical hanging intelligence. In another aspect, the invention relates to a series of interconnected frames which have tiles detachably mounted thereto whereby the frames and tiles cooperate to define an interior set of raceways which cooperate between the interconnected frames to define an interconnected chamber throughout the system for the passage of electrical and data conduit therein.

2. Description of the Related Art

Workspace definition systems for open room areas, such as office space, have a matrix of interconnected frames which have tiles mounted thereto. The frames often can accommodate electrical and data conduit therein so that several ports or sockets are defined within the framework for the interconnection with office components, such as computers, typewriters, dictation equipment, etc. Often these types of data and sockets and even the electrical data conduit can be provided directly within partition tiles mounted on the framework.

It has been found that the routing of electrical data conduit throughout these types of prior art office space partition systems can be difficult. Further, if the data and electrical connectors or sockets are provided in the tiles, these tiles must often be replaced or rewired with a new connector if the data and electrical needs of the office space partition system change over time. These types of rewiring of electrical and data conduit and the inability of prior art systems to easily accommodate new electrical and data systems have increased the time, expense and frustration with these systems.

SUMMARY OF THE INVENTION

The invention relates to an improved workspace management system for dividing a space into separate work areas comprising a rigid structural framework formed of rigid rectangular frames rigidly joined together at the edges thereof to form at least one work area. Each of the frames have outer faces on opposite sides thereof and openings on the opposite sides of the frames and a plurality of interchangeable tiles, with each of the tiles having a connector cooperating with the openings on the frames for removably mounting said tiles to the frames for ease of placement on and removal from the frames. The tiles are mounted to the outer faces of the frames to substantially cover both sides of the frames from a bottom portion thereof to a top thereof in juxtaposed parallel relationship.

In one improved embodiment, the invention relates to at least one of the frames comprising at least one load rail mounted horizontally between a pair of vertical rails and U shaped in cross section, the upper ends of the legs of the U shape having a reinforcing lip thereon. A pair of the tiles are mounted to the frames form a horizontal access slot therebetween. The horizontal access slot between the pair of the tiles is positioned in register with the upper ends of the legs of the U shaped load rail. The reinforcing lip can comprise an inwardly rolled portion forming a hook. The component can have a bracket mounted to the load rail and supported by the at least one frame. The bracket can be slidably mounted to the load rail.

Electrical power blocks can be mounted within the load rail inwardly of the component bracket whereby the bracket can slide along the rail. The bracket can be slidably mounted to the rail. The load rail can have at least one internal rib on bottom surface. The bracket on the component can seat behind the internal rib. The component can be any office furniture component such as a work surface or a cabinet. The component can have a first width, the frame has a second width and the first width can be different than the second width. The bracket can comprise a first portion adapted to mount to the load rail and having one of a flange and a slot and a second portion mounted to the component and having the other of a flange and a slot, wherein the flange is adapted to be removably mounted within the slot to removably mount the component to the first portion of the bracket. The U shape in the load bar can form a horizontal recess and the vertical rails can have an opening in register with the horizontal recess for routing conduit throughout the framework.

In another embodiment, each of the frames can further comprise a pair of opposed vertical rails having edge faces thereon. The edge faces can be interconnected with the outer faces of the vertical rails by ramped portions which are at an acute angle with respect to the edge faces and the outer faces. A series of aligned vertical slots can be provided in the ramped portions. The tiles can extend horizontally at least as far as the vertical slots to block light from passing directly from one side of the frame to the other side of the frame through the aligned vertical slots.

The edge face on each vertical rail can have a projection and a recess both extending along the vertical length of the rail in laterally spaced juxtaposed relationship to one another whereby the projection on one end face is received within the recess on an adjacent end face when a pair frames are placed into edge abutment with one another to prevent light from passing between the abutting end faces.

The frame can have a threaded opening in a lower portion thereof and the frame can further comprise at least one floor-engaging glide having a threaded shaft which is threadably received in the threaded opening in the frame. The threaded shaft can have a hexagonal head on an upper portion thereof whereby the at least one glide can be adjusted relative to the frame lower portion by a conventional socket tool when the frames are assembled. The frames are rigidly joined together by bolts which extend through abutting edge faces of the frame.

In an additional embodiment, the invention relates to one of the edge faces of the rigid rectangular frames further comprising a threaded aperture and another of the edge faces of the rigid rectangular frames has an aperture in registry with the threaded aperture of adjacent rigid rectangular frames and threaded bolts extending through the apertures of the another edge faces and threadably received in the threaded apertures in the one edge faces of adjacent rigid rectangular frames to rigidly join the rigid rectangular frames together.

The threaded aperture can comprise an integral threaded sleeve having a thickness greater than the thickness of the one edge face. The integral threaded sleeve can comprise a flow drilled extruded length of material formed inwardly from the one edge face.

In a further embodiment, the invention relates to the upper rail upper portion having a reinforcing lip thereon adapted to support at least one modular component. The component can have a bracket mounted to the reinforcing lip of the upper rail. The reinforcing lip can comprise an inwardly rolled portion forming a hook. The upper rail can have at least one internal rib on bottom surface. The bracket on the component can seat behind the internal rib.

The at least one modular component can be a cabinet. The at least one modular component can comprise a frame mounted generally perpendicular to the upper rail intermediate the ends thereof. A bracket can be rigidly mounted to the perpendicular frame and can have a flange mounted over the reinforcing lip of the upper rail. The component can have a first width, the frame can have second width and the first width can be different than second width.

The vertical rails can have an opening in register with the channel in the upper rail for routing the electrical/data cables throughout the framework. The rigid framework can comprise a first rigid frame positioned with respect to a second rigid frame in a generally perpendicular relationship intermediate the edge faces thereof and a first bracket can be rigidly mounted to the first frame and have a flange mounted to an upper portion of the second frame. A second bracket can be rigidly mounted to a lower portion of the first frame and have a flange mounted to a lower portion of the second frame.

In yet an additional embodiment, at least one bracket can be mounted to a portion of an edge face of a taller frame above a shorter frame. A cover can form an open-sided channel with end portions mounted to a bracket, thereby leaving the channel open for routing electrical/data cables therethrough. The end portions can also include a projection mounted to the bracket. The bracket can have outwardly extending support flanges and the cover can have inwardly directed ends which are snap-fit behind the support flanges.

In a further embodiment, a spacer can comprise at least one bracket having a generally vertical portion mounted to edge faces of adjacent frames and a generally horizontal portion having at least one of a slot and a projection. A cover can have the other of the slot and the projection in register with the one of the slot and the projection on the spacer, whereby the cover is removably mounted to the spacer to conceal the area between the adjacent frames.

The generally horizontal portion of the spacer can have a central opening adapted to receive electrical/data cables therethrough. The cover can have a central opening in register with the spacer central opening for routing of electrical/data cables therethrough. The cover can have inwardly-directed flanges thereon which are received behind edges of the generally horizontal portion of the spacer. The frame can have alignment openings and mounting apertures on the edge faces, the spacer can have alignment tabs which extend into openings in frame. At least two adjacent frames can be joined at 90, 135 or 180 degree angles with respect to one another. Further, three adjacent frames can be joined at a 90 degree angle therebetween. The spacer can have a threaded nut mounted thereto and the spacer can be secured to the edge faces of adjacent frame by a threaded fastener which extends through the edge face of the frame and is threaded onto the nut.

In another embodiment, the frame can have a bump rail extending outwardly from a lower portion thereof to a greater extent than the plurality of interchangeable tiles to protect lower edges of the tiles from damage by occupants of the system or the operation of floor cleaning devices. The bump rail can have at least one opening adapted to receive electrical/data cables routed into the system from a floor surface. The bump rail can have at least one elongated recess in which a lower edge of one of the plurality of interchangeable tiles is received.

In an additional embodiment, each of the main frames can further comprise a pair of opposed vertical rails having an opening at each upper end thereof, and an inverted U-shaped extension frame having a pair of depending legs, each leg having a cross-sectional shape congruent with the cross-sectional shape of the opening on the vertical rail upper ends. The extension frame can thereby increase the overall height of the main frame when the legs are mounted within the openings.

The depending legs of the extension frame can be bolted to the vertical rails. The depending legs of the extension frame can be of a sufficient length to prevent the extension frame from rocking with respect to the main frame. The depending legs of the extension frame can be U-shaped in cross section.

In yet a further embodiment, the invention relates to a filler frame having a horizontal dimension less than a given distance, and an adjustable rod mounted to the filler frame and to a filler bracket to secure the filler frame to the filler bracket. The adjustable rod can be rigidly secured at one end to the filler bracket and rigidly secured in an adjusted position to the filler frame.

In another embodiment, each of the edge faces of the rigid rectangular frames can have a projection and a recess, both extending along a vertical length of the rigid rectangular frames in juxtaposed relationship to one another whereby the projection on one end face is received within the recess on an adjacent end face when a pair of the rigid rectangular frames are placed into abutment with one another to prevent light from passing between the abutting end faces.

DETAILED DESCRIPTION OF THE PREFERRED EMBODIMENTS

Figure 1:
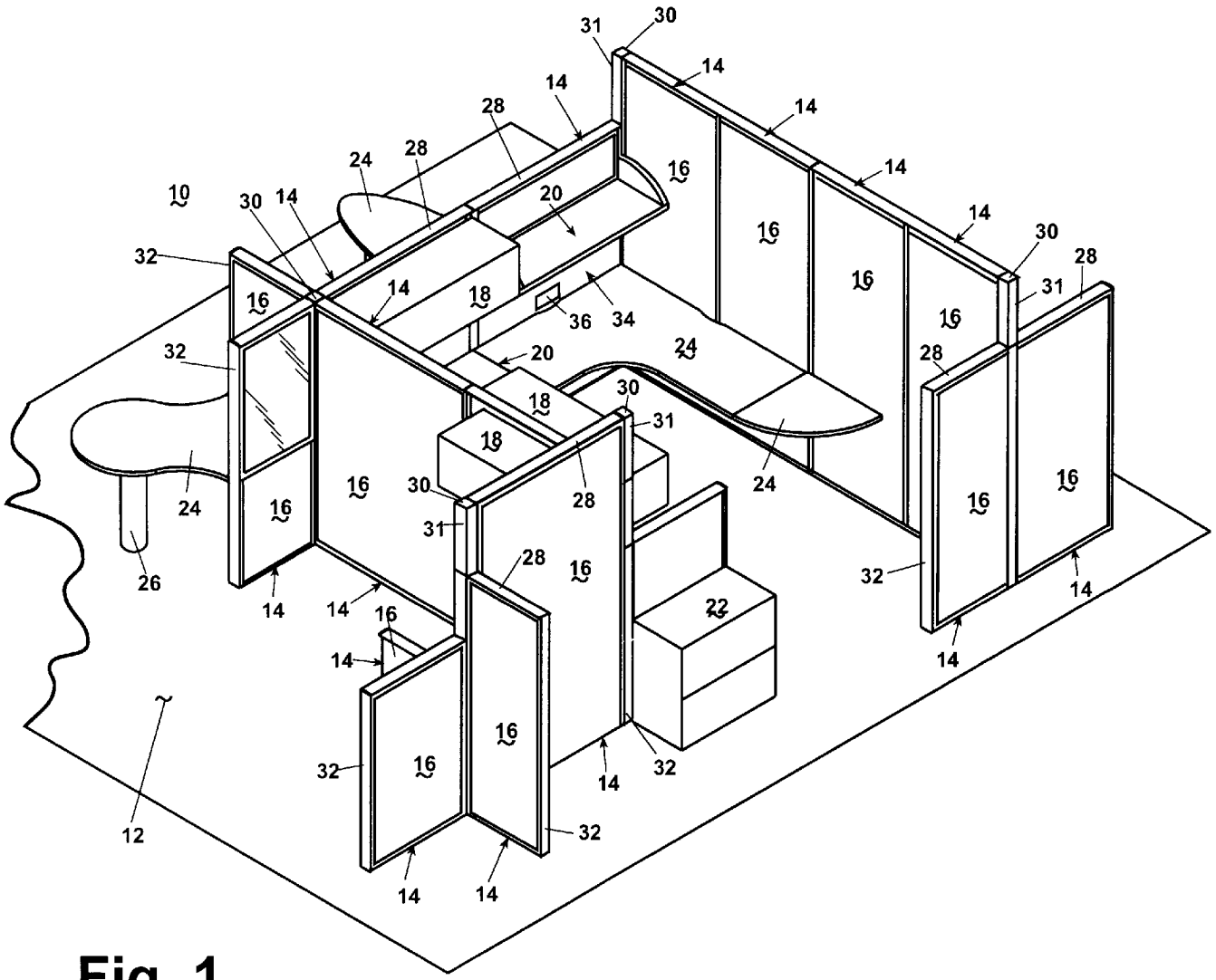
FIG. 1 is a perspective view of a frame-based workspace definition system comprising a framework with attached tiles and accessories such as work surfaces, overhead bins, pedestals and shelves according to the invention.

FIG. 1 shows a frame-based workspace definition system 10 supported on a floor surface 12 of an open workspace, such as that typically found in an office environment. The workspace definition system 10 comprises a series of interconnected frames 14 which subdivide the workspace into smaller areas, often referred to as partitions. It will be understood that the workspace definition system 10 can also be provided to define open floor plans as opposed to the partitioned environment which is well known in the art.

Each of the frames 14 supports one or more tiles 16 to create walls within the workspace as defined by the interconnected frames 14. The frames and tiles 14 and 16 can be of various sizes to define walls which extend floor-to-ceiling height or some intermediate height between the floor 12 and the ceiling (not shown). Further, frames 14 and tiles 16 of varying heights can be intercombined to define wall heights which vary depending upon the functionality and office aesthetics desired by the combination. A single tile 16 is typically mounted to either side of a frame 14, however, multiple tiles 16 can also be hung on a single side of a particular frame 14 or in combination with other accessories, such as overhead bins 18, shelves 20, and pedestals or file cabinets 22. One or more smaller tiles 16 can be provided on one or both sides of a particular frame 14 to cover the area of one side of the frame 14 not occupied by another hanging component, such as the bin 18, shelf 20 or file cabinet 22. Thus, a smooth aesthetic appearance of the workspace definition system 10 is maintained.

FIG. 1 also shows several worksurfaces 24 supported on the frames 14 preferably at a comfortable working height for an occupant of the workspace definition system 10. The worksurfaces 24, as will be described further below, can be mounted in cantilever fashion to interconnected frame 14 and can also be supported at an opposite end by one or more legs 26 as shown in FIG. 1.

The layout shown in FIG. 1, for the workspace definition system 10, should not be construed as limiting, but rather, any number of combinations of interconnected frames 14 having tiles 16 and components 18–24 mounted thereon can be achieved in any arrangement desired for a particular aesthetic appearance and functionality of the workspace in which the system 10 is located.

FIG. 1 also shows several covers mounted around exposed peripheral edges of the framework defined by the interconnected frames 14. For example, top caps 28 are mounted along upper edges of the frames 14, corner caps 30 are mounted to an upper surface between two or more interconnected frames 14 to conceal an upper surface of the joint therebetween, end covers 32 are mounted along exposed vertical edges of the workspace definition system IO, and corner covers 31 are mounted to an upper surface of one frame 14 and along exposed vertical edges of the workspace definition system 10. Corner covers 31 provide for a continuous, uniform appearance when two or more adjacent frames 14 have different vertical heights.

FIG. 1 also shows an electrical raceway cover 34 mounted adjacent to a worksurface 24 provided with a socket opening 36 whereby the raceway cover 34 is either detachable from the frame 14 or movable between an open and a closed position. The raceway cover 34 is shown in the closed position in FIG. 1. When detached or moved to the open position, the interior of the frame 14 can be accessed such as for routing electrical and data conduit and adding, removing, or splicing other connections therewith.

Figure 2:
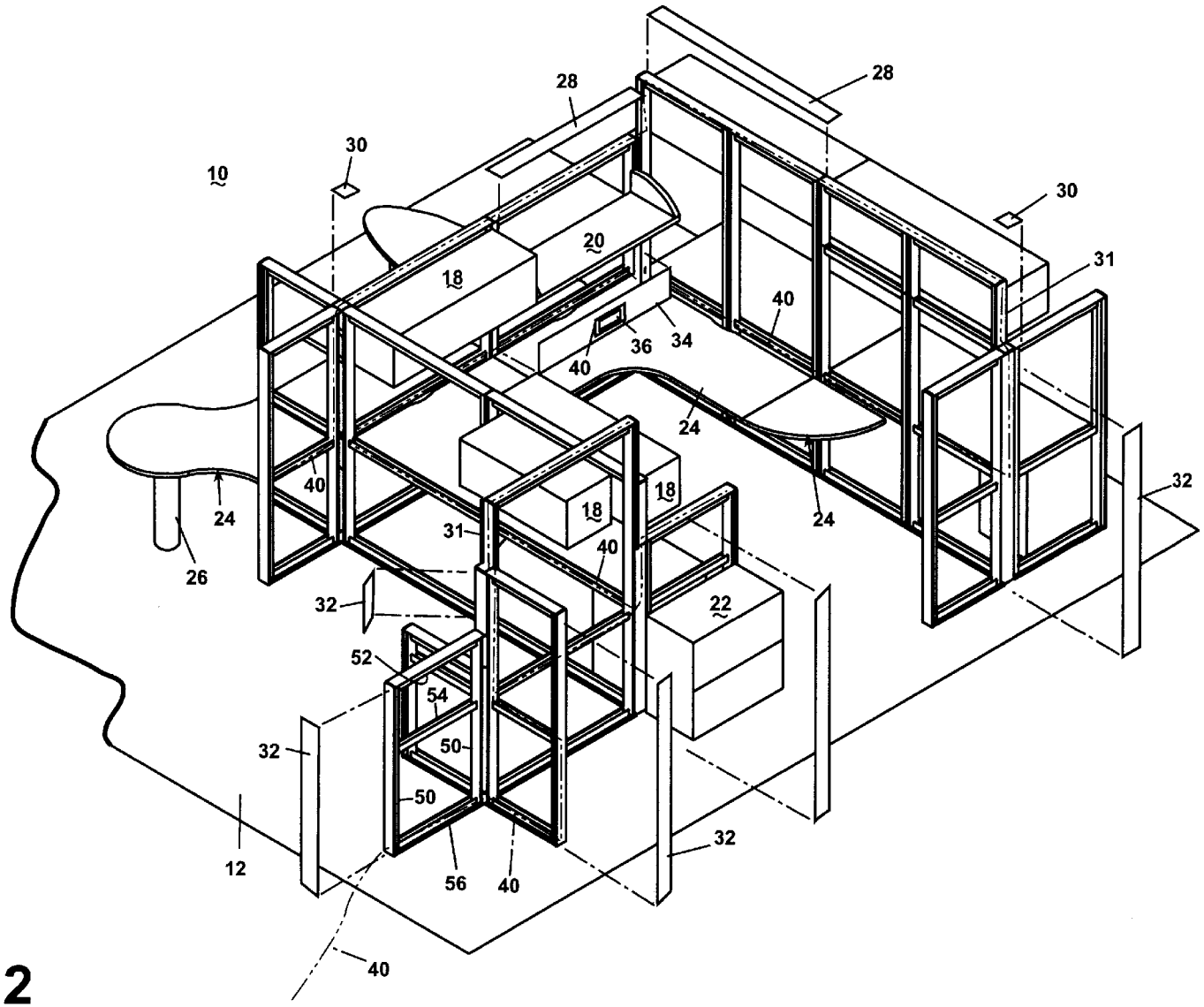
FIG. 2 is a perspective view of the workspace definition system of FIG. 1 with the tiles removed from the framework to show the framework comprising a system of interconnected frame members and electrical and data routed throughout.

FIG. 2 shows the workspace definition system 10 of FIG. 1 with the tiles 16 removed to show the interior of the interconnected frames 14. The components 18–24 are shown mounted to the frames 14. Top caps 28, corner caps 30, corner covers 31, end covers 32, and raceway covers 34 are shown exploded from the frames 14 to reveal each frame 14 comprising interconnected vertical rails 50 with generally horizontal top, intermediate and foot rails 52, 54, and 56, respectively.

Each of the rails 52, 54 and 56 preferably has a U-shaped cross section so as to define an internal chamber or raceway for accommodating electrical and data conduit 40 as shown in FIG. 2. The electrical and data conduit 40 can be routed within the top, intermediate and foot rails 52, 54 and 56, through the vertical rails 50, in between adjacent frames 14 and through any open space of a frame 14 so that the operable interconnection of office equipment components, such as computers, printers, fax machines, telephones, typewriters, etc., can be easily accomplished by merely removing one or more of the tiles 16, and covers 28–34 routing the conduit 40 throughout the interconnected frames 14 and replacing the tiles 16, covers and caps 28–34 as needed.

Figure 3:
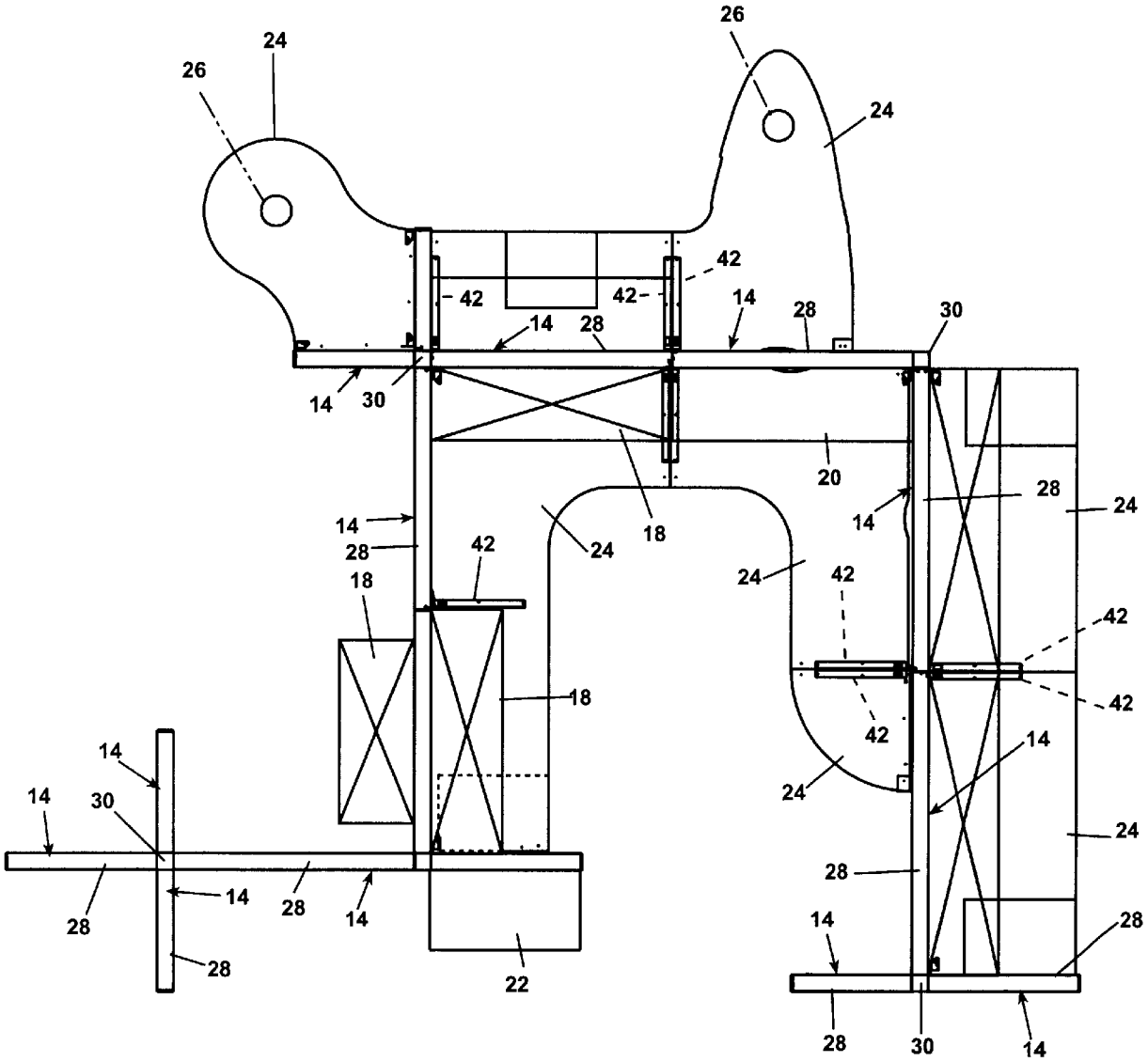
FIG. 3 is a top plan view of the workspace definition system of FIG. 1.

FIG. 3 shows a top schematic view of the workspace definition system 10 of FIGS. 1–2 showing that several components can be easily interconnected to the frames 14 with a minimum amount of hardware required. For example, several brackets 42 are shown mounted to particular frames 14, and preferably the vertical rails 50 thereof, in cantilever fashion. In addition, the brackets 42 are also mounted to a particular component, such as a worksurface 24, to support the component upon the interconnected frames 14. Further, the overhead bins 18, shelves 20 and file cabinets 22 are shown mounted to the interconnected frames 14 in similar fashion. Thus, it will be readily apparent from an examination of the workspace definition system 10 that the selection, arrangement and configuration of the frames 14 and their associated components can be easily designed and re-designed with a minimum of effort.

Figure 4:
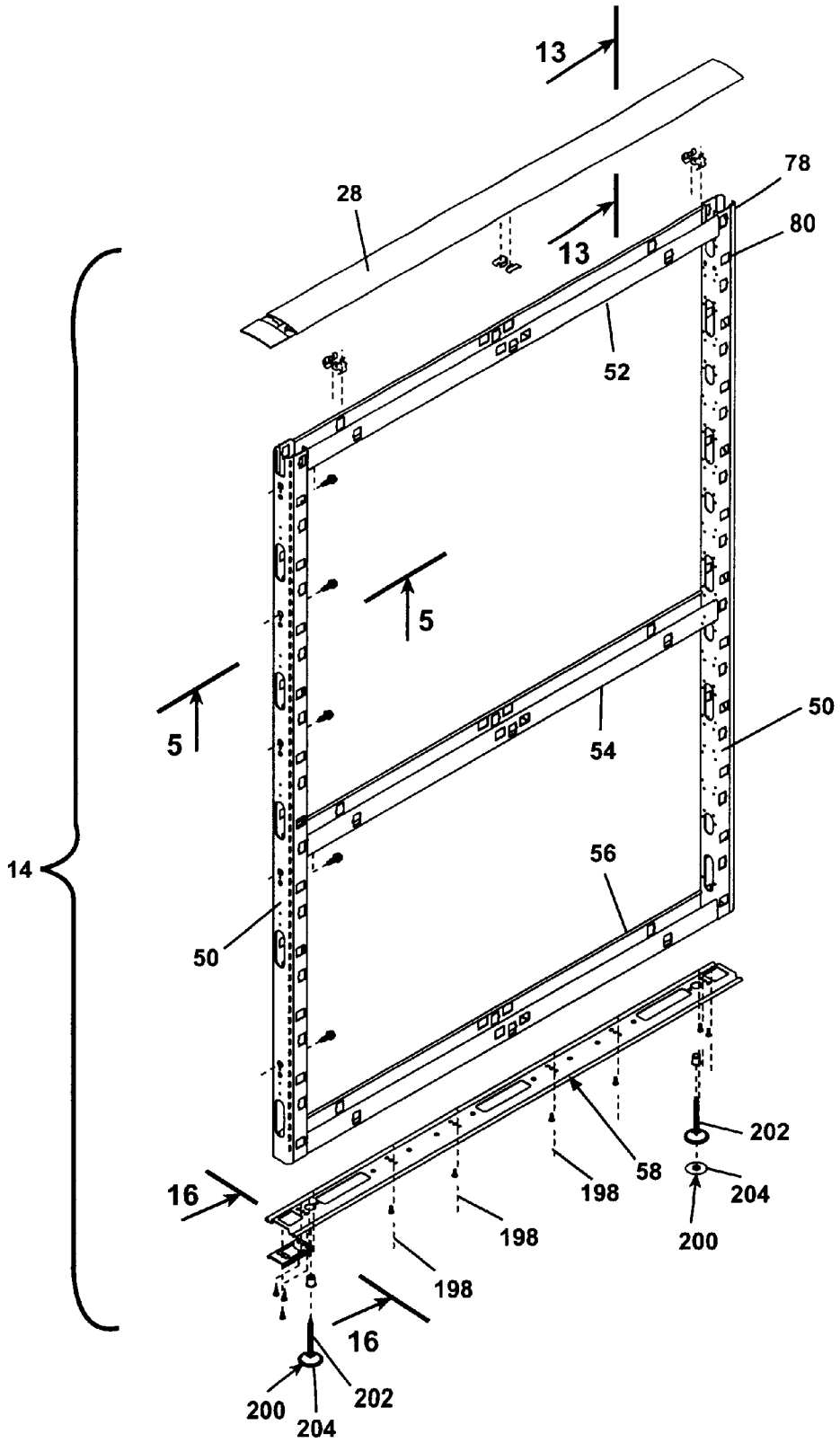
FIG. 4 is a perspective view of a frame member of FIGS. 1–2 shown comprising a top cap and a frame including a pair of vertical rails, a top rail, an intermediate rail, a foot rail and a bump rail.

FIG. 4 is an exploded perspective view showing, among other things, a single frame 14 and an associated top cap 28. As previously described, the frame has a top rail 52, intermediate rail 54 and foot rail 56 extending in generally horizontal fashion between a pair of vertical rails 50 so that the frame 14 has a generally rectangular configuration. The frame 14 is shown as also having a bump rail 58 mounted to the base of a pair of vertical rails 50, and a foot rail 56 to provide stability to the frame 14 and allow the frame 14 to have a free standing capacity on the floor surface 12.

Figure 5:
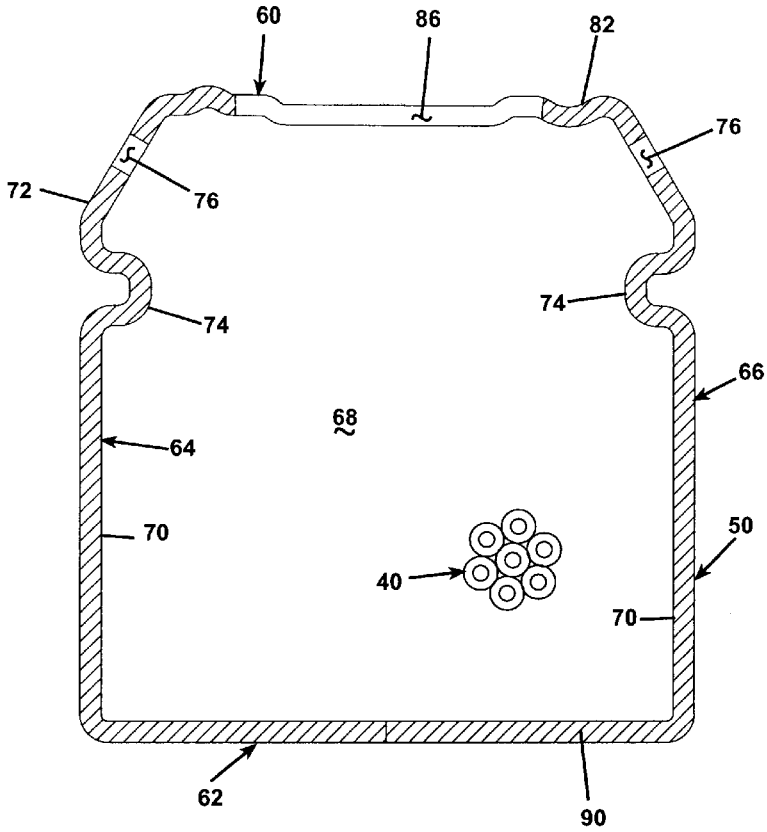
FIG. 5 is a cross-sectional view of a vertical rail of the frame sub-assembly taken along lines 5—5 of FIG. 4.
Figure 5A:
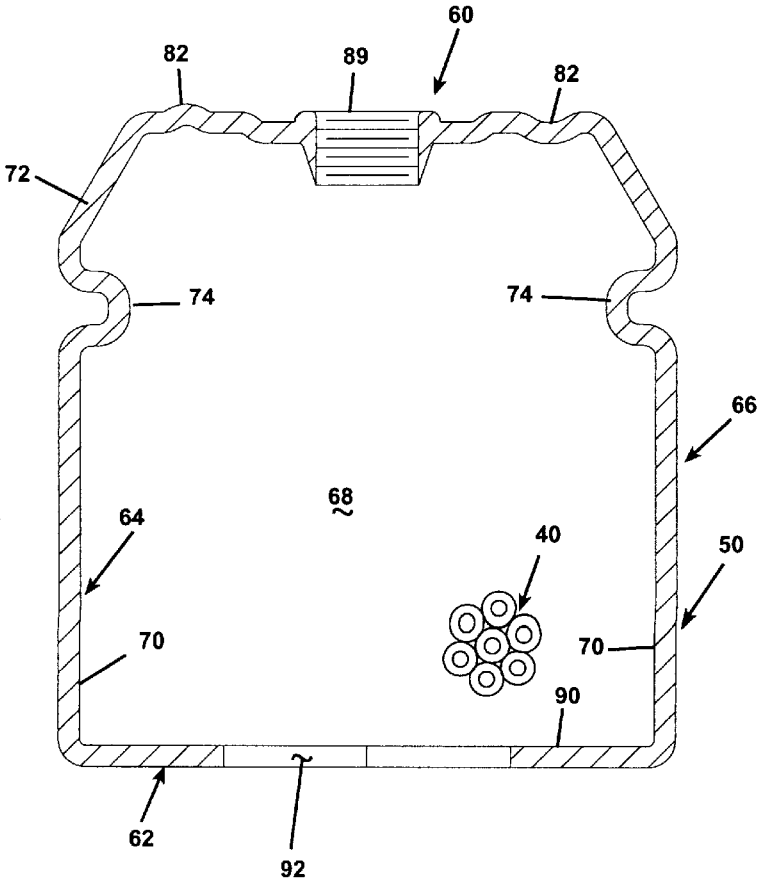
FIG. 5A is a cross-sectional view of a flow drill aperture on a leading face of a vertical frame taken along lines 5—5 of FIG. 4.

The vertical rail 50 of the frame 14 is shown in greater detail in FIGS. 5–8, respectively. The cross section of the vertical rail 50 is shown in FIG. 5 and comprises a leading face 60, a trailing face 62 located oppositely therefrom and first and second side faces 64 and 66, respectively, extending between the leading and trailing faces 60 and 62 along opposite ends thereof. Although the vertical rail 50 can be made as a solid member having apertures located at selected areas therein, the vertical rail 50 is preferably formed as a hollow member whereby the faces 60–66 form the periphery of the vertical rail 50. A chamber 68 is formed within the interior of the vertical rail 50 and allows for routing of electrical and data conduit 40 therethrough. A similar chamber is formed within the interior of the top rail 52, intermediate rail 54, and front rail 56 which also allows for routing of electrical and/or data conduit 40 therethrough.

Figure 6:
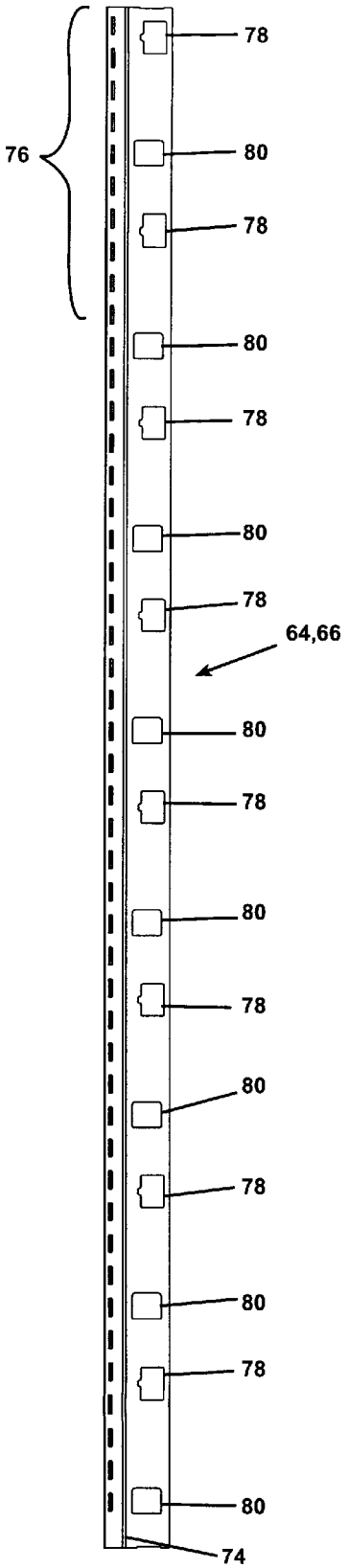
FIG. 6 is a front, elevational view or a leading face of the vertical rail of the frame of FIGS. 4–5.

FIG. 6 shows a side elevational view of the first side face 64 of the vertical rail 50. It will be understood that the second side face 66 of the vertical rail 50 is a mirror image thereof and will be referred to with common reference numerals. The first side face 64 comprises an elongated tile 70 provided with a ramped portion 72 with a U-shaped groove 74 located therebetween. The ramped portion 72 extends between the U-shaped groove 74 and the leading face 60 of the vertical rail 50. Several vertically-aligned slots 76, often referred to as "vertical hanging intelligence," extend the length of the ramped portion 72 and are provided for receiving mating hooks on components 18–24 and brackets 42 as will be further described so that these components can be mounted as shown in FIGS. 1–3. The elongated tile 70 includes alternating first and second apertures 78 and 80 which extend in an alternating pattern along the length of the elongated tile 70.

Figure 7:
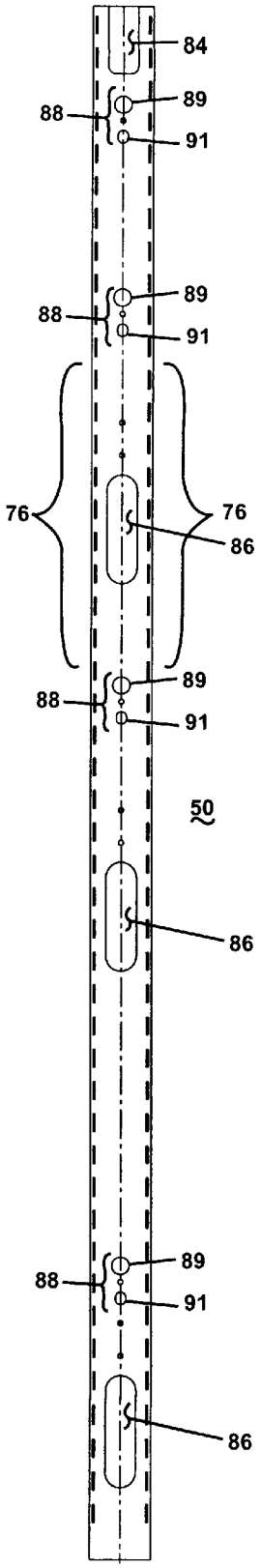
FIG. 7 is a side, elevational view or a side face of the vertical rail of the frame of FIGS. 4–5.

The leading face 60 is shown in FIG. 5 and in greater detail in FIG. 7. The leading face 60 comprises an elongated tile 82 having an upper U-shaped aperture 84 and several elliptical apertures 86. A pair of mounting apertures 88 are interspersed between each of the elliptical apertures 86 on the length of the elongated tile 82. As can be seen in FIG. 7, the slots 76 on the ramped portion 72 of the first and second side faces 64 and 66 are visible in FIG. 7 adjacent to each edge of the elongated tile 82 of the leading face 60. The leading face 60 is the portion of the vertical rail 50 which faces an adjacent leading face 60 of a vertical rail 50 of an adjacent frame 14 so that apertures 84–88 are generally horizontally aligned when a pair of leading faces 60 are so positioned. Thus, data conduit located in one frame 14 can extend through one or more of the apertures 84–88 into the adjacent frame 14.

Figure 8:
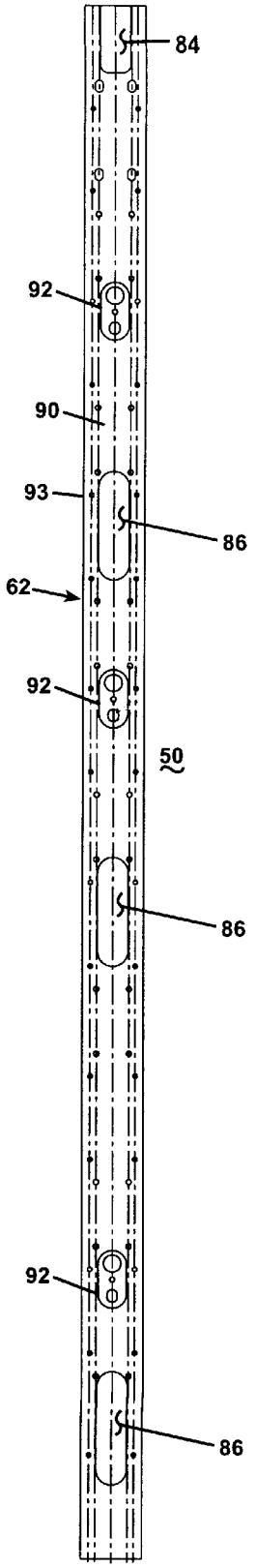
FIG. 8 is a rear, elevational view or a trailing face of the vertical rail of the frame of FIGS. 4–5.

The trailing face 62 of the vertical rail 50 is shown in FIG. 5 and in greater detail in FIG. 8. The trailing face 62 comprises an elongated stile 90 with elliptical apertures 92 aligned with the mounting apertures 88 on the leading face 60. Mounting apertures 88 comprise a flow drill aperture 89 and an opposed attachment aperture 91. A tool, such as a ratchet or wrench can be inserted within the elliptical apertures 92 to tighten a fastener (not shown) provided within one of the mounting apertures 88 to interconnect a pair of adjacent frames 14. It will be understood that each of the apertures on the trailing face 62 can readily accommodate electrical and/or data conduit 40.

Alternatively, as can be seen in FIG. SA the vertical rail 50 can be configured with a leading face 60 having a flow drill aperture 89, and a trailing face 62 having a clearance aperture 92. With such a configuration, a pair of vertical rails 50 can abut together along each of their respective leading faces 60. Although not shown, it is likewise contemplated that the flow drill aperture 89 can be associated with the trailing face 62, and the clearance aperture 92 can be associated with the leading face 60. The only limitation with regard to the flow and clearance apertures 89 and 92, respectively, is that together they must cooperate to, in turn, provide a configuration such that a pair of vertical rails 50 are adjoined in a substantially flush manner.

Figure 9:
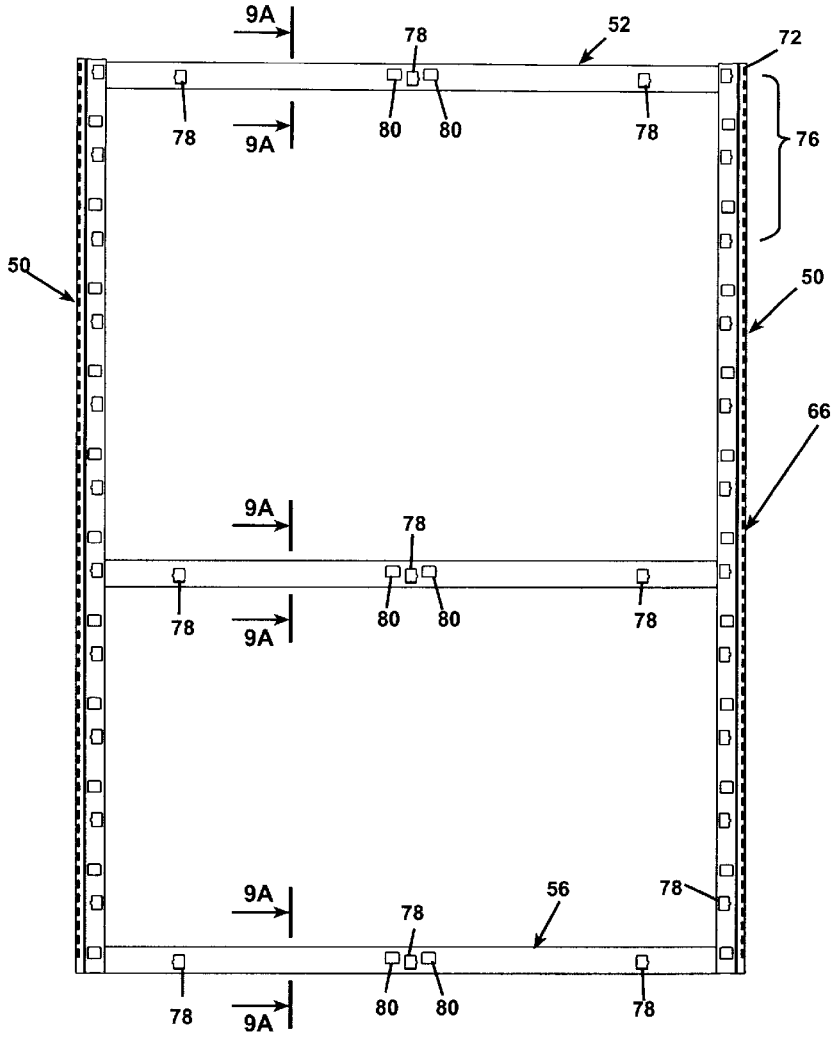
FIG. 9 is a front, elevational view of the frame of FIG. 4 showing the top, intermediate and foot rails mounted between a pair of vertical rails.

FIG. 9 shows an assembled frame 14 with the top, intermediate, and foot rails 52, 54, and 56 interconnected between a pair of vertical rails 50. As further shown in FIG. 9, the slots 76 on the ramped portion 72 of the first and second side faces 64 and 66 of each vertical rail are visible from the front elevational view shown in FIG. 9. The first and second apertures 78 and 80 are provided along the vertical height of the vertical rail 50 of the frame 14.

Figure 9A:
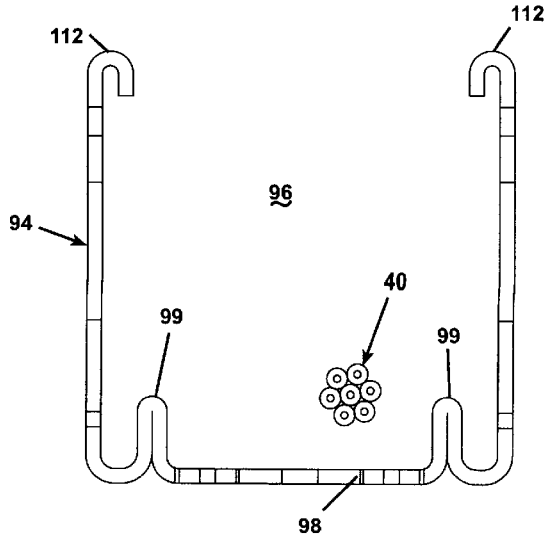
FIG. 9A is a cross-sectional view of the top, intermediate or foot rail taken along lines 9A—9A of FIG. 9 which defines an internal channel for accommodating electrical and data conduits therein.

Each of the top, intermediate and foot rails 52, 54, and 56 have an elongated wall 94 provided with a U-shaped cross section as shown in FIG. 9A. The elongated wall 94 preferably defines an interior chamber 96 which serves as a raceway for receiving electrical and data conduit 40 therein. A bottom portion 98 of the wall 94 has a pair of elongated, longitudinal ribs 99 thereon which provide reinforcement to the rails 52, 54 and 56.

As further shown in FIG. 9, the top, intermediate and foot rails 52, 54 and 56 can also be provided with first and second apertures 78 and 80, respectively, spaced along the width of the U-shaped elongated wall 94 of each member and configured similarly to those on the vertical rails 50. As shown in FIG. 9, preferably a pair of first apertures 78 are located adjacent each end of the members 52, 54 and 56 as well as at a central portion thereof. A pair of second apertures 80 are preferably located on either side adjacent to the first aperture 78 located at a central portion of each rail 52, 54 and 56. These apertures 78 and 80 can be used for hanging tile 16 or, if configured properly, components 18–24 intermediate the ends of a particular frame 14 where space requirements of either a tile 16 or components 18–24 so dictate.

Each of the top, intermediate and foot rails 52, 54 and 56 can be provided with inwardly-extending hooks 112 extending into the interior chamber 96 of the elongated wall 94. Further, a floor portion 98 of the elongated wall 94 can have a pair of spaced upstanding ribs 99 provided for structural reinforcement of the wall 94 as well as several spaced openings 118 therein. Ribs 99 can also be used for off-module hanging of components 18–24.

Figure 10:
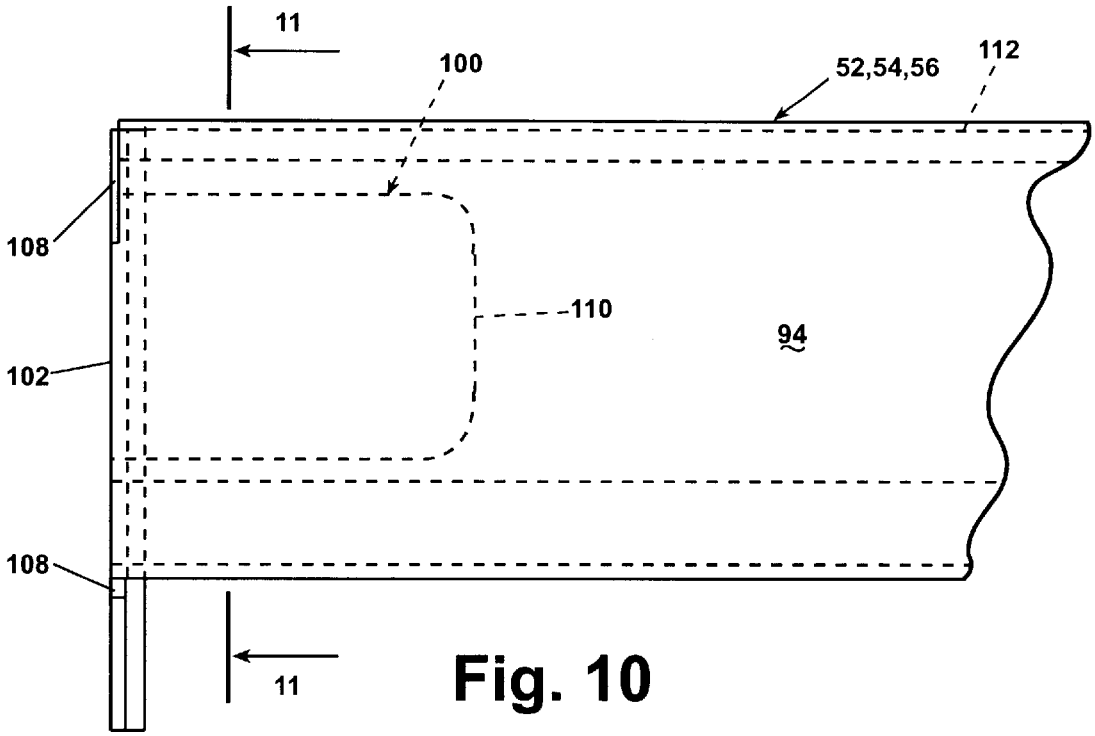
FIG. 10 is a side elevational view of an alternative embodiment for mounting an intermediate rail to the vertical rails by a clip mounted to each vertical rail which supports the intermediate rail thereon.
Figure 11:
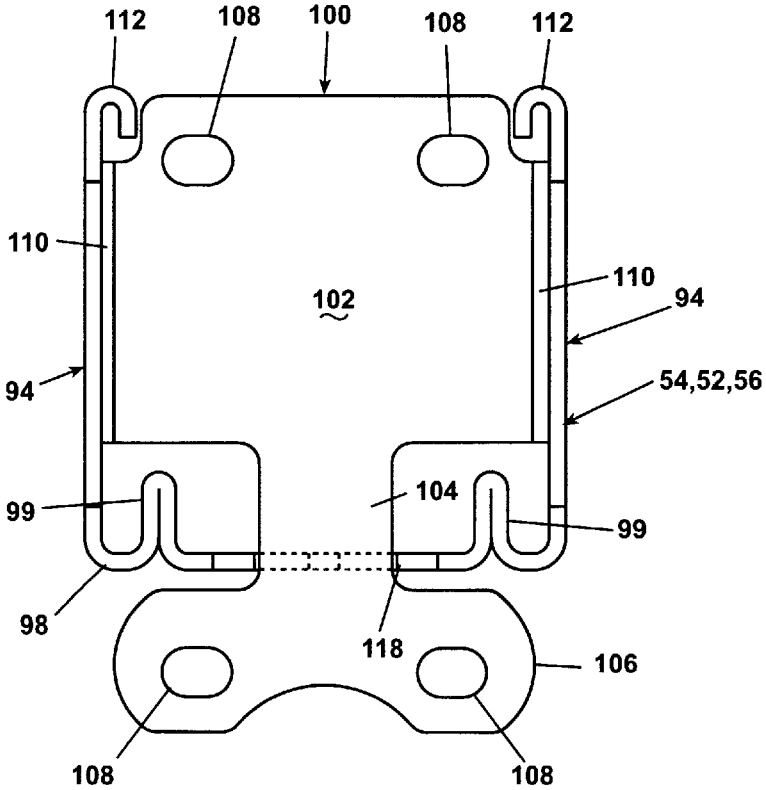
FIG. 11 is a cross-sectional view taken along lines 11—11 of FIG. 10 showing a U-shaped profile of the intermediate rail which defines an internal channel for accommodating electrical and data conduits therein.

The top, intermediate and foot rails 52, 54 and 56 can be welded at either end between a pair of vertical rails 50 having their trailing face 62 facing toward one another so that the vertical rails 50 and top, intermediate and foot rails 52, 54 and 56 form an integrally welded structure. Alternatively, the rails 52, 54 and 56 can be removably mounted between a pair of aligned vertical rails 50 by a clip 100 as shown in FIGS. 10–11. The clip preferably comprises a plate 102 having a depending flange 104 provided with a laterally-extending connector 106 at a terminal end thereof. The connector 106 is provided with a pair of spaced-mounting apertures 108 adapted to receive a threaded fastener therein. An upper end of the plate 102 is also provided with a pair of spaced-mounting apertures 108 as well. The clip 100 is also provided with a pair of forwardly-extending arms 110.

The clip 100 is preferably mounted to a mounting aperture 93 within the elongated tile 90 of the trailing face 62 so that the arms 110 extend toward the opposing vertical rail 50 of the frame 14. The rail 52, 54 and 56 is mounted on the arms 110 so that the hooks 112 engage over the arms 110 to provide a secure support for mounting the rail 52, 54 and 56 between the vertical rails 50.

Figure 12:
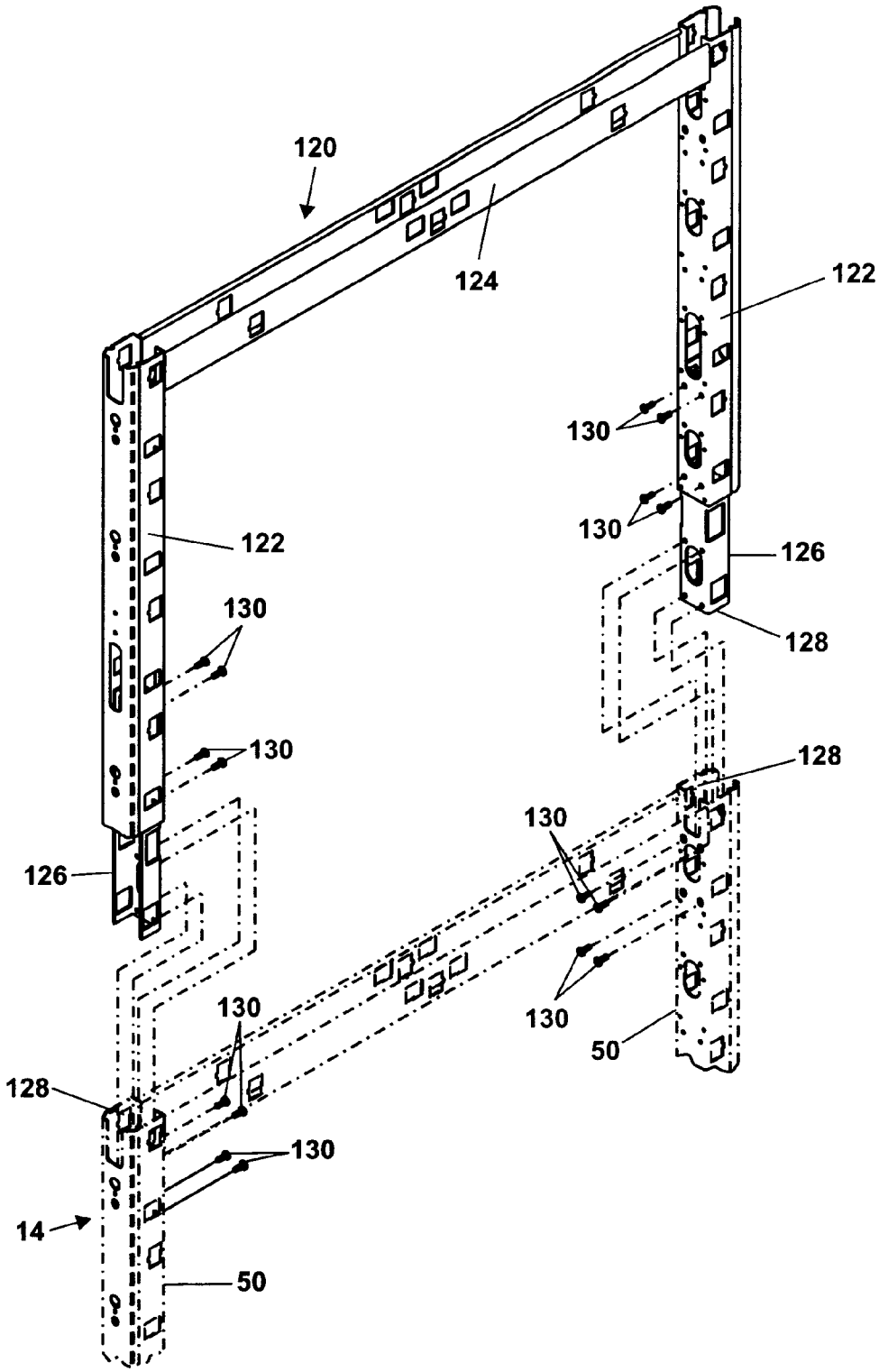
FIG. 12 is an exploded, perspective view of a stacker frame assembly for mounting to an upper surface of the frame of FIG. 4.

FIG. 12 shows an exploded perspective view of a stacker frame assembly 120 mounted atop a frame 14 comprising the rails 52, 54 and 56 as previously described. The stacker frame assembly 120 is used to increase the height of a standard frame 14 when a framework of increased height is desired. The stacker frame assembly 120 comprises a pair of vertical rails 122 supporting a top rail 124 therebetween at an upper end thereof. Each of the vertical rails 122 are provided with a reduced-diameter depending flange 126 which is preferably shaped to correspond with the interior of a vertical rail 50 as shown in greater detail in FIG. 5.

The vertical and top rails 122 and 124 of the stacker frame assembly 120 are preferably configured with all of the apertures and other discontinuities described with respect to the vertical rails 50 and top rail 52 of a frame 14. Further, the reduced-diameter flanges 126 which depend from each of the vertical rails 122 are also provided with the corresponding apertures and discontinuities of the vertical rail 50 of a frame 14 to align with those apertures and discontinuities of the vertical rails 50 when axially inserted therein.

A stacker frame assembly 120 is mounted atop a frame 14 by inserting the reduced-diameter flanges 126 on each vertical rail 122 within an aperture 128 located atop each vertical rail 50 of the frame 14. The reduced-diameter flange 126 is thereby received within the aperture and extends into the interior chamber 68 of the vertical rail 50 and can be secured thereto by fasteners 130. Alternatively, the stacker frame assembly 120 can be welded atop the frame 14 in a known fashion if the stacker frame assembly 120 is to be permanently mounted thereon.

Figure 13:
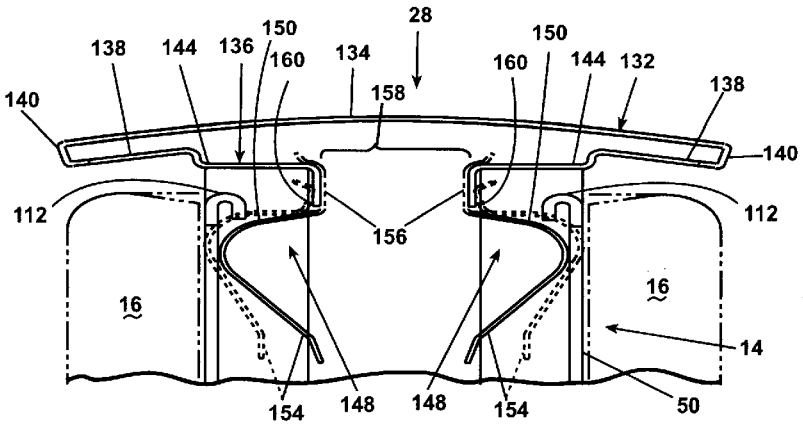
FIG. 13 is a cross-sectional view of the top cap taken along lines 13—13 of FIG. 4.

The top cap 28 is shown in FIGS. 1–4 and in greater detail by the cross section of FIG. 13. The top cap 28 comprises an elongated member 132 having a smooth arcuate upper surface 134 and a stepped lower surface 136. The lower surface 136 comprises a first step 138 located adjacent each distal end 140 thereof and a second step 144 located slightly lower and inwardly than the first step 138. Each second step 144 terminates in a depending leg 146.

In the cross section shown in FIG. 13, the top cap 28 is shown mounted atop the upper ends of a pair of vertical rails 50 along a top rail 52. The upper ends of the vertical rail 50 and top rail 52 are preferably located adjacent to the second step 144 while a tile 16 mounted to either side of the frame 14 preferably has an upper edge located directly adjacent the first step 138. The distal ends 140 preferably align with exterior surfaces of the tile 16. The arcuate upper surface 134 extends between the distal ends 140 of the top cap 28 to provide a smooth outer appearance to the workspace definition system 10.

Figure 14:
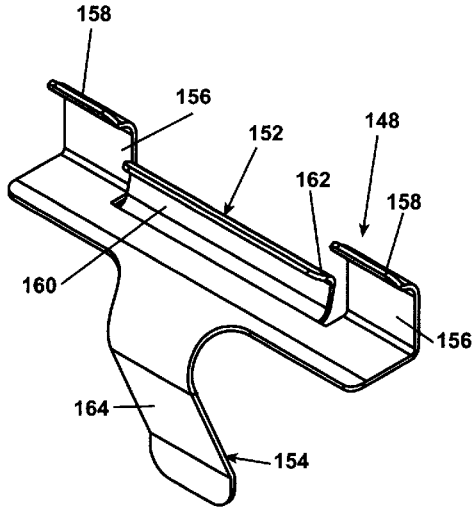
FIG. 14 is an enlarged, perspective view of a top cap clip for mounting the top cap of FIG. 13 to the top rail of the frame sub-assembly of FIG. 4.

A top cap clip 148 is shown in FIG. 13 and in greater detail in FIG. 14. The top cap clip 148 comprises a plate 150 having upwardly-extending claw 152 and a downwardly-extending arcuate arm spring 154. The claw 152 preferably has a pair of outer tines 156, each provided with an inwardly-extending angular flange 158 and a center tine 160 which is preferably bent inwardly at 162 to form a C-shaped cross section. The arm spring 154 preferably comprises an elongated member having an inwardly-curved portion 164 which has an inherent resiliency.

The top cap clip 148 is preferably mounted to each depending leg 146 into the claw 152 so that the outer tines 156 abut one side of the leg 146 and the center tine 160 is located on the opposite side thereof. The resilience of the tines 156 and 160 cause the leg 146 to be securely gripped therebetween. A top cap clip 148 is preferably mounted in a spaced relationship along the length of a top cap 28 to both of the depending legs 146 so that the curved portions 164 of the arm spring 154 on opposite legs 146 of the top cap 28 extend outwardly therefrom.

The top cap 28 is mounted atop a frame 14 by urging the top cap 28 with attached clips 148 downwardly onto an upper surface of the vertical rails 50 and top rail 52 so that the arm spring 154 on each leg 146 is compressed inwardly. As the top cap 28 is urged further downwardly onto the frame 14, the curved portion 164 bears against the interior surface of the elongated wall 94 of the top rail 52 until the curved portion 164 lodges beneath the hooks 112 at the upper edge of the elongated wall 94. The curved portion 164 of the arm spring 154 of the top cap clip 148 is received therebeneath to retain the top cap 28 atop the frame 14.

Figure 15:
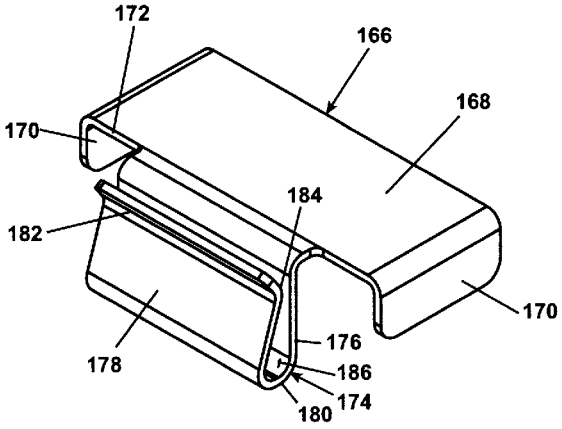
FIG. 15 is an enlarged, perspective view of a support clip for providing reinforcement to the top cap of FIG. 13 upon the top rail of the frame of FIG. 4.

A support clip 166 for providing reinforcement to the top cap 28 shown in FIGS. 1–4 and FIG. 13 atop the frame 14 is shown in FIG. 15. The support clip 166 comprises a plate 168 having a pair of depending ends 170 and a lateral edge 172 provided with a spring clip 174. The spring clip 174 comprises a depending wall 176 interconnected to an upwardly-standing wall 178 by a resilient bight 180. An upper end of the upwardly-extending wall 178 can be provided with an angular flange 182 to provide a bearing surface 184 within a gap 186 located between the walls 176 and 178.

The support clip 166 is provided for the purpose of supporting the top cap 28 from collapsing along the length thereof at points in lieu of or in addition to the top cap clip 148. A depending leg 146 of the top cap 28 can be inserted within the gap 186 between the walls 176 and 178 so that the bearing surface 184 is held against the leg 146 by the resilience of the bight 180. The plate 168 with depending walls 170 can thereby be inserted over a portion of a top rail 52, such as over upper portions of the elongated wall 94 thereof to support the top cap 28 atop the frame 14 and provide further support and structural integrity thereto.

Figure 16:
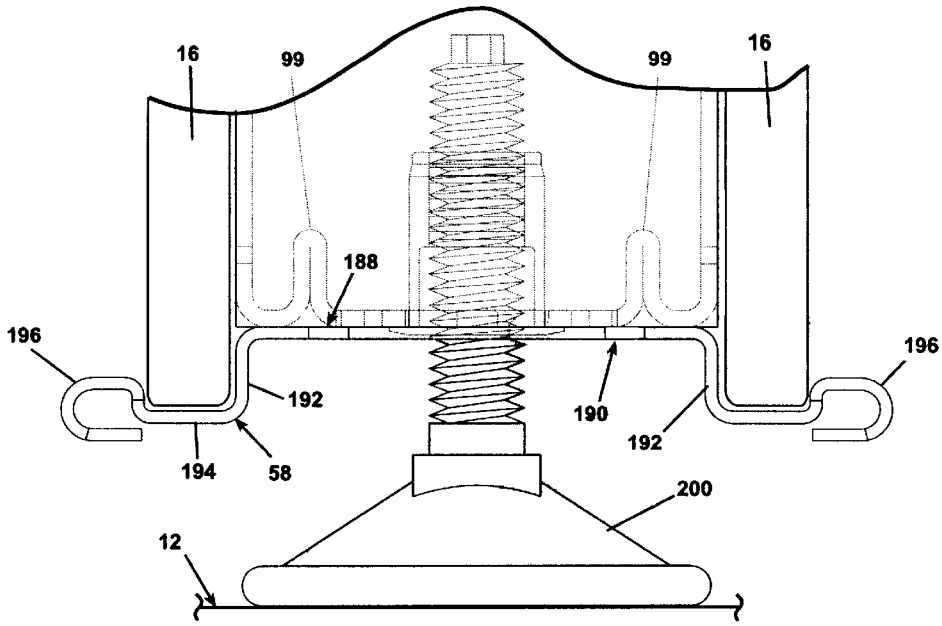
FIG. 16 is an cross-sectional view of the bump rail taken along lines 16—16 of FIG. 4.

The bump rail 58 is shown in FIG. 4 and in greater detail in FIG. 16 and comprises an elongated member 188 having several elongated spaced apertures 190 therein for accommodating the passage of wires from a sub-floor surface. Each longitudinal edge of the bump rail 58 is provided with a depending wall 192 which terminates in a laterally-extending wall 194. Each of the walls 194 terminates in a reversibly-curled foot 196. A glide 200 supports the bump rail 58 above the floor so that the bump rail 58 can be adjustably supported relative to the floor 12 so that the frame 14 can be supported at a predetermined height. Although not shown, a base tile trim cover can be applied to the bump rail 58 to, in turn, protect the lower portion of tile 16 from personnel and/or vacuum cleaners inadvertently contacting such tile.

As shown in greater detail in FIG. 4, the bump rail 58 is mounted to a lower surface of the frame 14 by several fasteners 198. Further, a pair of glides 200, which generally comprise a threaded shaft 202 and a conical foot 204 can also be mounted within apertures in the bump rail 58 and engaged within the frame 14, such as in the foot rail 56 or within an aperture (not shown) within a lower surface of each of the vertical rails 50 of a frame 14.

Figure 17:
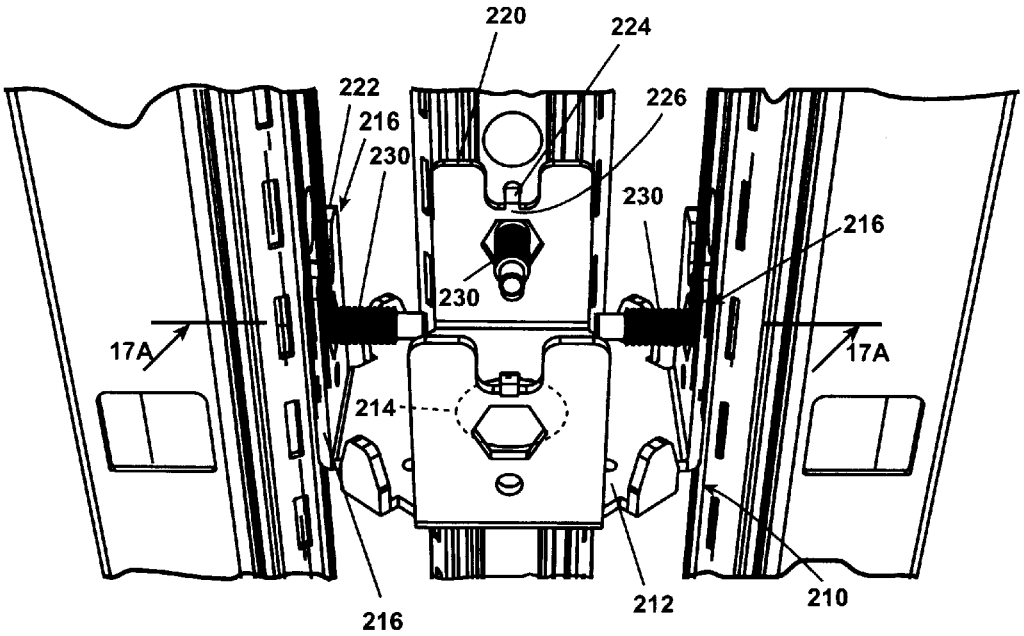
FIG. 17 is a fragmentary, perspective view of a first embodiment of a connector shown interconnecting multiple frames of FIG. 4 to define a partitioned area of a workspace.

FIG. 17 shows a fragmentary perspective view of a first embodiment of a connector 210 used for interconnecting two or more adjacent frames 14 in a particular configuration, such as at a 90°, 135° or 180° angular relationships with respect to an adjacent frame 14. The connector 210 comprises a plate 212 provided with a central aperture 214. Several upstanding flanges 216 are provided around the periphery of the plate 212 at a desired angular spacing. It will be understood that a leading face 60 of a frame 14 can be mounted to each of the upstanding flanges 216 so that, depending upon the angular spacing of the flanges 216 around the plate 212, two or more frames 14 can be supported at a desired angular spacing.

Each of the upstanding flanges 216 comprises a plate 218 which has an upper edge 220 provided with a central indentation 222 therein. A lower edge 224 of the central indentation 222 has a radially-extending hook 226 which, as shown best in FIG. 17A, extends upwardly and radially outwardly from each flange 216.

Each upstanding flange 216 is also provided with a hexagonal aperture 228 which receives a threaded sleeve 230 therein. The threaded sleeve 230 is provided with a pair of annular flanges 232 located on either side of a hexagonal surface 234 on the sleeve 230 adapted to be inserted within the hexagonal aperture 228 so that the annular flanges 232 abut both sides of the flange 216 around the hexagonal surface 234. Thus, the engagement of the hexagonal surface 234 within the hexagonal aperture 228 prevents the threaded sleeve from being rotated within the hexagonal aperture 228 while the abutment of the annular flanges 232 on either side of the flange 216 prevents the sleeve 230 from being axially removed from the aperture 228.

Figure 17A:
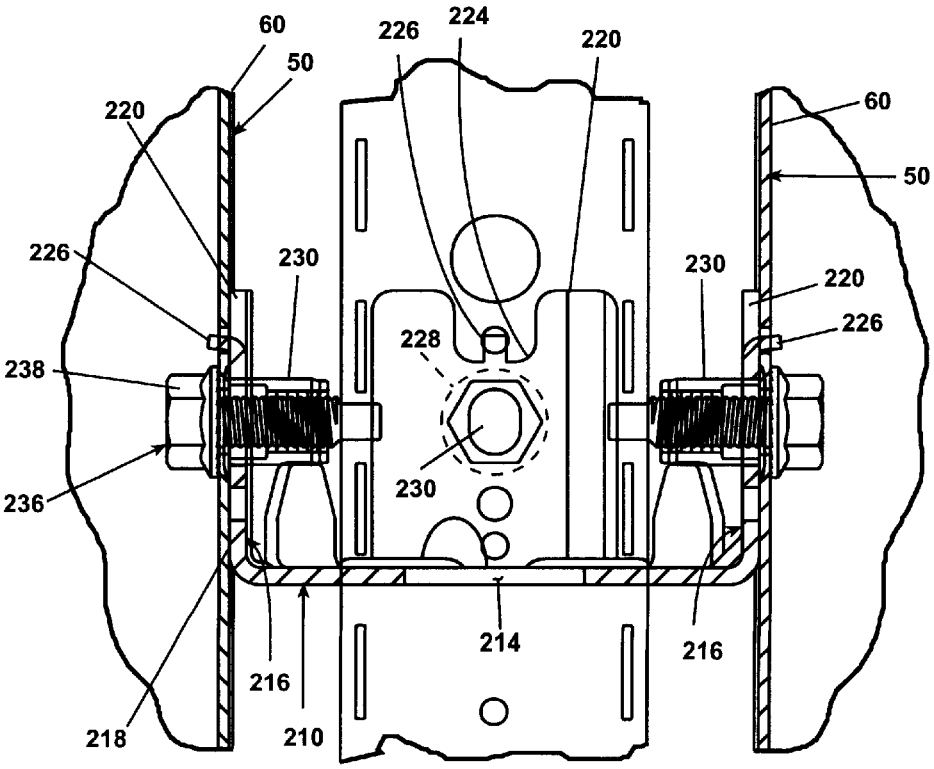
FIG. 17A is a cross-sectional view of the connector and attached frames taken along lines 17A—17A of FIG. 17.

As best shown in FIGS. 17 and 17A, the connector 210 is mounted to two or more adjacent frames 14 by aligning the threaded sleeve 230 on each flange 216 with one of the mounting apertures 88 thereon so that the hook 226 passes into one mounting aperture 88 (i.e., flow aperture 89) and the threaded sleeve is aligned with another mounting aperture 88 (i.e., opposed attachment aperture 91).

The hook 226 is used to align the connector 210 with the mounting aperture 88 on the frame 14 to ease interconnection of the connector 210 with the frame 14. Once the threaded sleeve 230 is aligned with the mounting aperture 88 and the hook 226 is passed within an adjacent mounting aperture 88, a fastener 236 is passed through the mounting aperture 88 into the threaded sleeve 230 and tightened as needed. Fasteners 236 can be mounted within all of the threaded sleeves 230 on each of the flanges 216 to interconnect as many frames to the connector 210 as desired. A tool (not shown), such as a wrench, ratchet or powered driver, can be passed through elliptical apertures 92 on the trailing face 62 of a vertical rail 50 so that a head portion 238 on the fastener 236 can be engaged with the tool and the fastener rotated easily and quickly.

Figure 18:
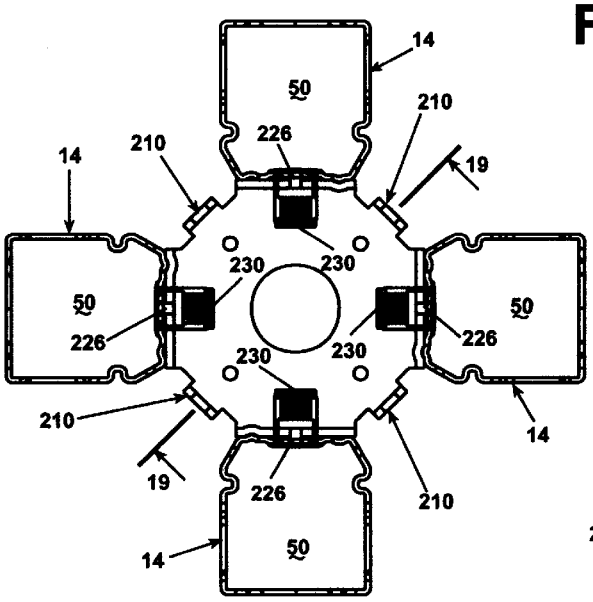
FIG. 18 is a top plan view of alternative embodiments of the connector of FIG. 17 shown in both solid and phantom lines for interconnecting frames at 90° angles.
Figure 19:
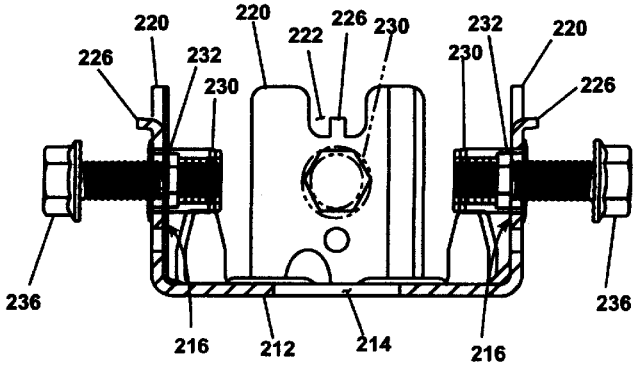
FIG. 19 is a cross-sectional view taken along lines 19—19 of FIG. 18.
Figure 20:
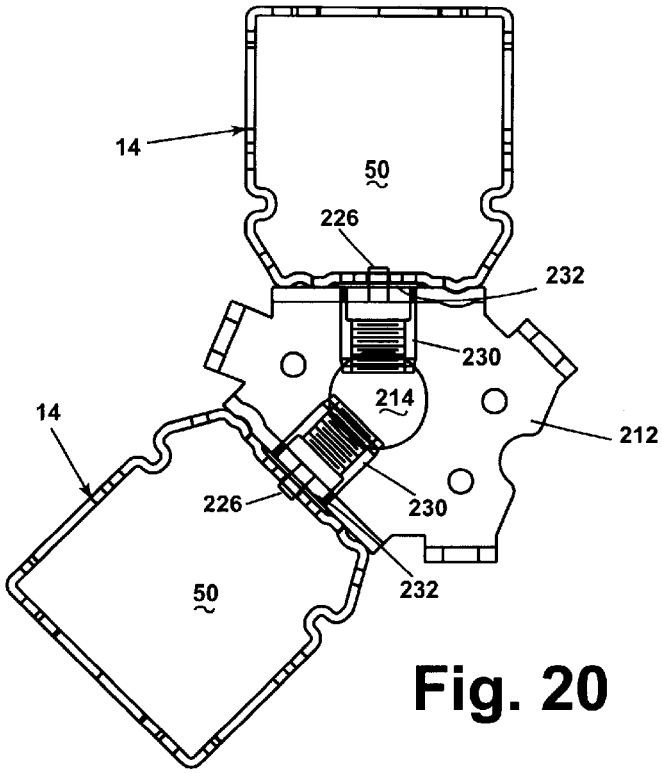
FIG. 20 is a top plan view of another embodiment of the connector of FIG. 17 for interconnecting a pair of frames at a 135° angle.

As can be seen in FIG. 17, the first embodiment of the connector 210 is shown interconnecting three frames 14 at 90° angles with respect to one another. As shown in FIG. 18, a second embodiment of the connector 210 is shown which is adapted to interconnect a pair of frames 14 at 90° angles with respect to one another. A phantom outline portion of FIG. 18 shows a third embodiment of the connector 210, when combined with the solid line portion of FIG. 18, provides a connector 210 adapted to interconnect four frames 14 at 90° angle with respect to one another. FIG. 19 shows a cross-sectional view of the connector showing the mounting of the sleeve 230 on the flange 216 in greater detail for such a 90° angle connector 210. FIG. 20 shows a fourth embodiment of the connector 210 adapted to interconnect a pair of frames 14 at a 135° angle with respect to one another. It will be further understood that other embodiments of the connector 210 can be provided for interconnecting frames 14 at 90°, 135° and 180° angles with respect to one another. Further, other embodiments of the connector 210 can easily be contemplated for interconnecting two, three, four and even more frames 14 without departing from the scope of this invention.

Figure 21:
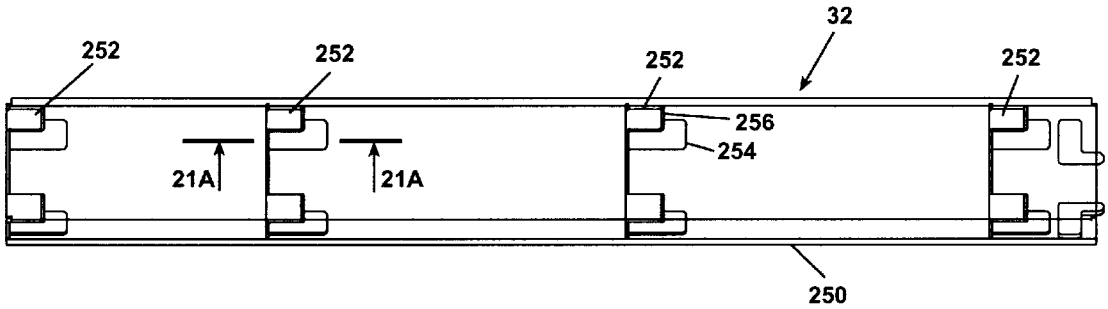
FIG. 21 is a front elevational view of a first embodiment (three-way) of a corner cover for concealing a joint between two or more interconnected frames which is mounted to a connector of FIGS. 17–20 with a truss.
Figure 21A:
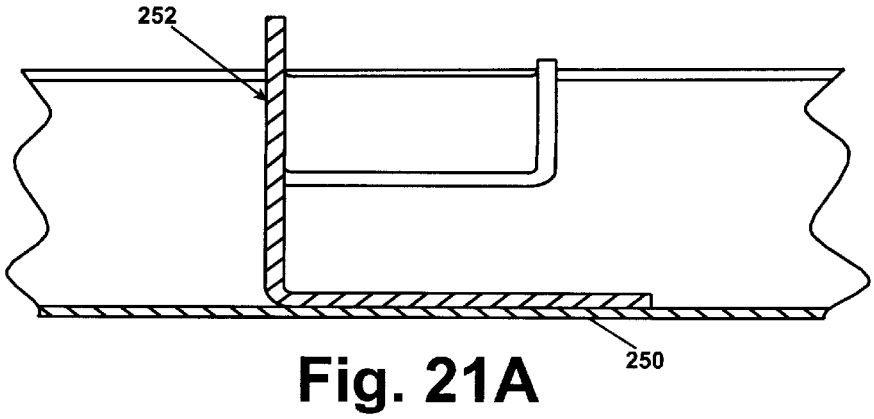
FIG. 21A is a cross-sectional view taken along lines 21A—21A of FIG. 21.

FIG. 21 shows the end cover 32 for concealing a vertical joint between two or more adjacent frames 14 interconnected by one or more connectors 210. The end cover 32 comprises an elongated cover 250 provided with several mounting trusses 252 at spaced vertical intervals along the length of the cover 250. The cover 250 generally comprises an extruded member having a desired aesthetically-pleasing outer surface and is adapted to interfit between a vertical joint between two or more adjacent frames 14 to obstruct the interior of the joint between two or more adjacent frames 14 from view. The trusses 252 are mounted to the cover 250 in a conventional manner, such as by welding, fasteners, or the detachable engagement of a flange 254 on the cover 250 with a mating flange 256 on the truss 252 as generally shown in FIG. 21. A tab 253 is provided proximate the bottom portion of the end cover 32, which can engage and, in turn, secure the end cover 32, or any other structure therebelow.

FIGS. 22–24A show various embodiments of the cover 250 and truss 252 which are adapted to interfit with various embodiments of the connector 210 as shown in FIGS. 17–20. Each of the trusses 252 comprise a plate 258 having a central recess 260 preferably adapted to be aligned with the central aperture 214 on a connector 210. A pair of flanges 262 are located on either side of the recess 260 and are adapted to be received by the connector 210 to mount the truss 252 thereto.

Figure 22:
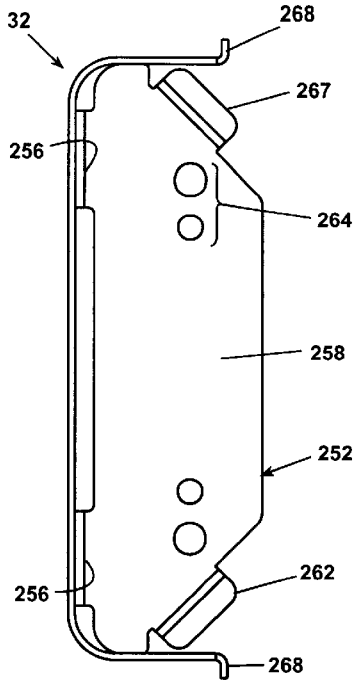
FIG. 22 is a top plan view of the corner cover and truss of FIG. 21.
Figure 23:
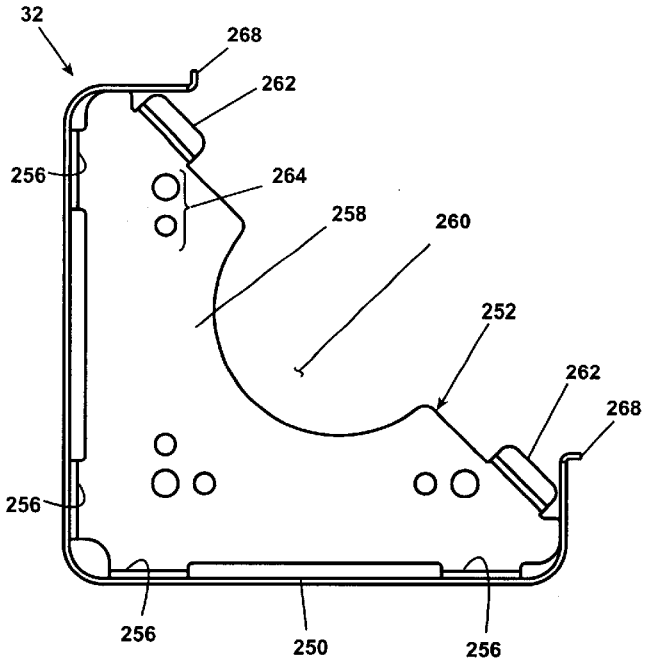
FIG. 23 is a top plan view of a second embodiment (90°) of a corner cover and truss of FIGS. 21–22.
Figure 24:
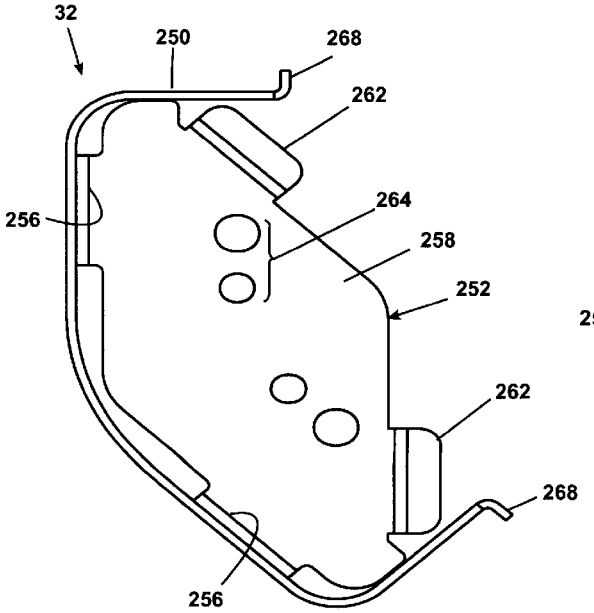
FIG. 24 is a top plan view of a third embodiment (135°) of a corner cover and truss of FIGS. 21–22.

Three embodiments of the truss 252 and associated cover 250 are shown in FIGS. 22–24. It will be understood that each of the components 256–262 of the truss 252 are referred to with common reference numerals in the embodiments shown in FIGS. 22–24. FIG. 22 shows a truss 252 configured for mounting to a connector 210 for concealing a 180° joint or the three-way joint shown in FIGS. 17 and 17A. FIG. 23 shows an embodiment of a truss 252 configured to conceal the vertical portion of a joint between a pair of frames mounted by connectors 210 at a 90° angle with respect to one another. FIG. 24 shows an embodiment of the truss 252 configured to conceal the vertical portion of a joint between a pair of frames 14 mounted by connectors 210 at a 135° angle with respect one another.

The truss 252 can be mounted to a corresponding connector 210 between two or more interconnected frames 14. In particular, the flanges 262 of the trusses 252 can fixedly engage the plates 212 of the connectors 210.

As shown in FIGS. 21–24A, the cover 250 can be configured as needed to completely conceal the joint between two or more interconnected frames 14. In any configuration, the cover 250 can preferably be provided with a pair of out-turned edges 268 which are adapted to directly abut the leading face 60 of a vertical rail 50 of an adjacent frame 14 so that the joint between two or more interconnected frames 14 is completely concealed.

As can be seen in FIGS. 1–2 a change of height corner cover 31 can be used when two or more adjacent frames 14 and associated tiles 16 have different heights.

Figure 24A:
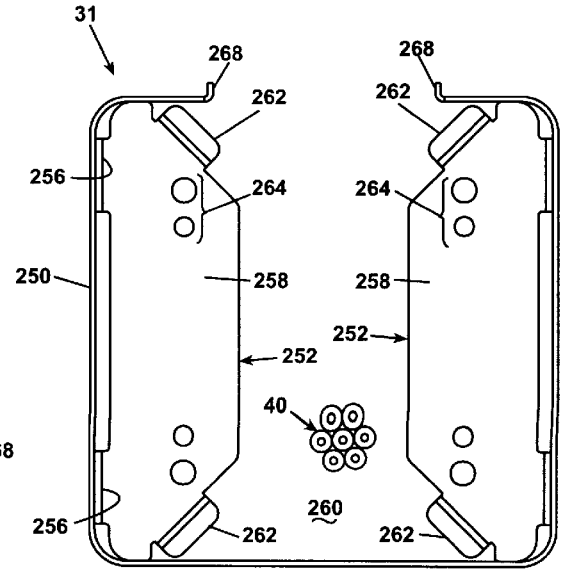
FIG. 24A is a top plan view of a change-of-height corner cover shown in FIGS. 1–2.

The change of height of corner cover 31 allows electrical and/or data conduit 40 to be routed into and through such areas in a protected, yet non-restrictive, manner. Additionally, the change of height corner cover 31 can perform an aesthetic function inasmuch as it provides for a continuous, uniform cover surface for the frames 14. FIG. 24A is a top plan view of the change of height corner cover 31 of FIGS. 1–2. In particular, FIG. 24A shows that the substantially rectangular chamber region 33 can readily accommodate electrical and/or data conduit 40.

Figure 25:
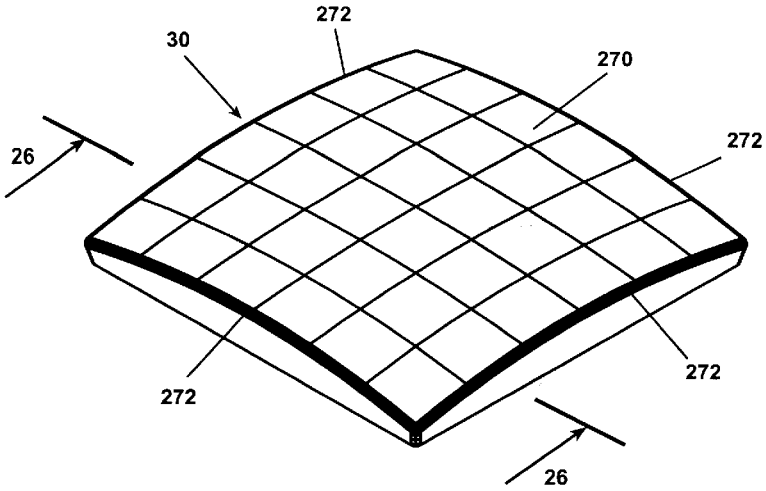
FIG. 25 is a perspective view of a corner cap for concealing an upper surface of and a joint between two or more interconnected frames.
Figure 26:
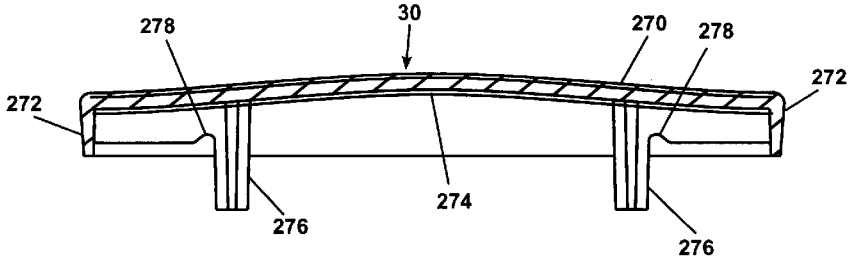
FIG. 26 is a cross-sectional view of the corner cap taken along lines 26—26 of FIG. 25.

FIGS. 25–26 show an enlarged example of the corner cap 30 illustrated in FIGS. 1–3. The corner cap 30 has an upper surface 270 provided with a smooth aesthetically-pleasing surface which has peripheral edges 272 having depending portions which are adapted to directly abut an adjacent top cap 28 or an upper edge of an adjacent end cover 32 to provide a smooth transition between these components and conceal an upper surface of a joint between two or more interconnected frames 14. An underside 274 of the corner cap 30 is provided with depending flanges 276 which depend downwardly from the underside 274 to further extend beyond the peripheral edges 272 thereof. The depending flanges 276 cooperate to define an alignment structure for mounting the corner cap 30 upon the upper edge of a joint between interconnected frames 14.

The corner cap 30 is generally placed onto the upper surface of the joint between interconnected frames 14 after the frames 14 have been mounted together by connectors 210. The corner cap 30 is placed downwardly onto the upper surface of the joint so that the depending flanges 276 thereof abut the upper surfaces of the interconnected frames 14. For example, the upper surfaces of the frame 14 can be engaged within a small recess 178 adjacent the depending flanges 276 so that the corner cap 30 securely rests thereon. The corner cap 30 can be placed atop a corner cover 31 and secured thereto by fixedly engaging the flanges 276 of the corner cap 30 with the apertures 264 of the corner cover 31.

Figure 27:
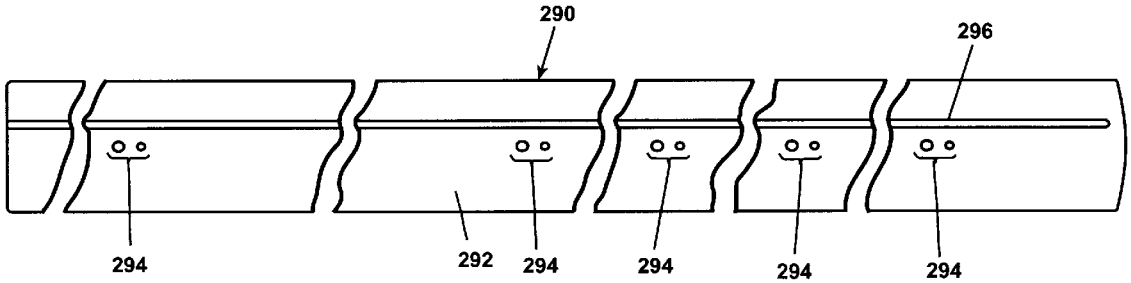
FIG. 27 is a front elevational view of a wall-starter rail adapted to be mounted between a frame and an existing wall of the workspace for supporting the frame relative to the existing wall.

FIG. 27 shows a front elevational view of a wall starter rail 290 comprising an elongated panel tile 292 provided with several spaced sets of mounting apertures 294 and an elongated vertical groove 296. The mounting apertures 294 are preferably configured to align with the mounting apertures 88 provided along the leading face 60 of the vertical rail 50 of the frame 14.

The wall starter rail 290 is provided for mounting a frame 14 to an existing wall of the workspace so that the workspace definition system 10 can extend to, and be mounted with, the existing wall. Once the wall starter rail is mounted to an existing wall, the frame 14 can be placed adjacent the wall starter rail 290 and mounted thereto by passing fasteners into the aligned mounting apertures 88 and 294 in the frame 14 and wall starter rail 290, respectively. The vertical groove 296 is provided so that a joint cover, such as end cover 32 or a vertical edge of a tile 16, can fit therein so that a smooth transition between the existing wall, the wall starter rail 290, and the frame 14 is provided in an aesthetically-pleasing manner.

Figure 28:
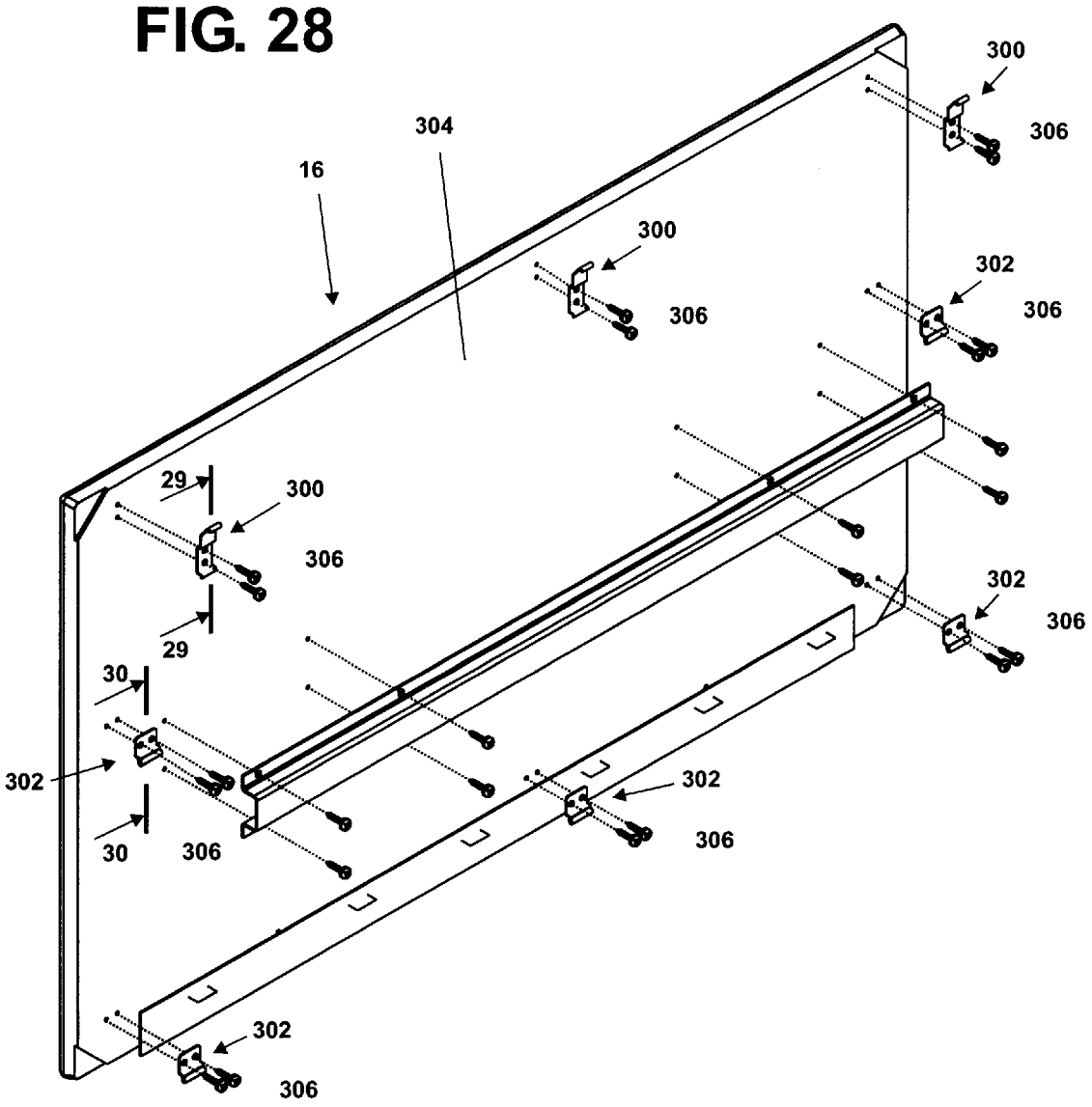
FIG. 28 is a perspective view of rear side of a tile of FIG. 1 provided with first and second mounting clips adapted to mount the tile to corresponding apertures in a frame.

FIG. 28 shows an exploded perspective view of a tile 16 provided with several first clips 300 and several second clips 302 mounted to a rear surface 304 of the tile 16 by fasteners 306. The first clips 300 are preferably provided on the tile 16 to align with the first apertures 78 on the vertical rails 50 and top, intermediate, and foot rails 52–56 while the second clips 302 are provided to preferably align with the second apertures 80 on the vertical rails 50 and top, intermediate, and foot rails 52, 54 and 56. As many of the first and second clips 300 and 302 can be provided to securely support the tile 16 on the frame 14 with the engagement of the first and second clips 300 and 302 within corresponding first and second apertures 78 and 80, respectively, on a frame 14.

Figure 29:
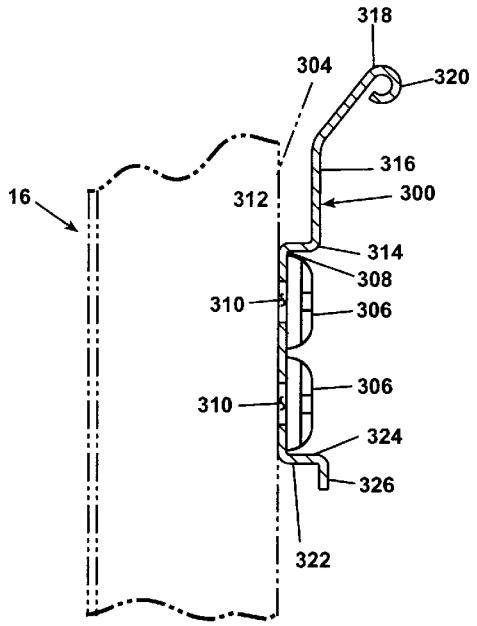
FIG. 29 is a cross-sectional view of the first mounting clip taken along lines 29—29 of FIG. 28.

A cross-sectional view of the first clip 300 is shown in FIG. 29 mounted to the rear surface 304 of the tile 16 by the fasteners 306. The first clip 300 comprises a plate 308 provided with a pair of spaced apertures 310 for receiving the fasteners 306.

An upper edge 312 of the plate 308 is provided with a laterally extending step 314, which terminates in an upwardly extending flange 316. An upper portion of the flange 316 is provided with an angularly extending flange 318, which terminates in a curled edge 320. A lower edge 322 of the plate 308 is provided with a laterally extending step 324, which terminates in a depending wall 326.

Figure 30:
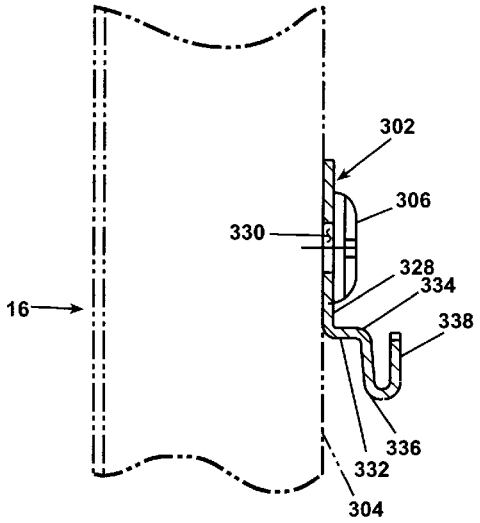
FIG. 30 is a cross-sectional view of the second mounting clip taken along lines 30—30 of FIG. 28.

FIG. 30 shows a cross-sectional view of the second clip 302 mounted to the rear surface 304 of the tile 16 by the fasteners 306. The second clip 302 comprises a plate 328 provided with a pair of spaced apertures 330 for receiving the fasteners 306. A lower edge 332 of the plate 328 terminates in a laterally extending step 334 which, in turn, terminates in a downwardly and angularly extending flange 336. The flange 336 terminates in a reversely curled edge 338.

Figure 28A:
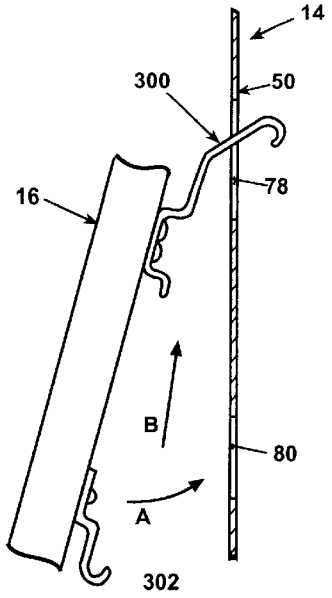
FIG. 28A is a schematic view of a first step of mounting the tile of FIG. 28 onto a frame with the clips shown in FIGS. 29 and 30.

A tile 16 can be mounted to a frame 14 by angularly tilting the tile 16 so that the first clips 300 thereon are placed forwardly toward, and aligned with, the first apertures 78 on a frame 14. The curled edge 320 on the first clips 300 are inserted within the aligned first aperture 78 as shown in FIG. 28A. The tile 16 is then urged angularly upwardly so that first clip 300 is urged therein.

Figure 28B:
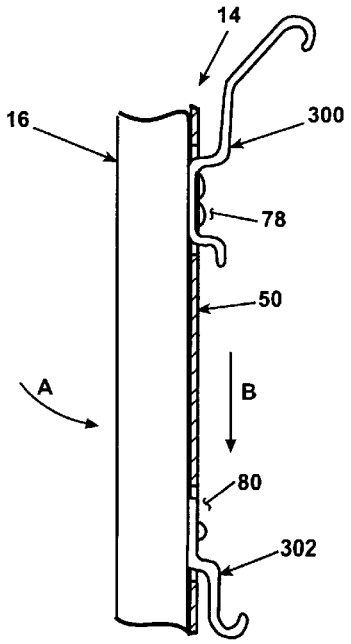
FIG. 28B is a schematic view of a second step of the mounting of the tile onto the frame.

As shown in FIG. 28B, the second clip 302 is brought toward the aligned second aperture 80 in the frame 14 with the first clip 300 inserted within the first aperture 78 as shown by the arrow marked "A". The tile 16 is then urged downwardly, as shown by the arrow marked "B" in FIG. 28B, to bring the tile 16 to the rest position as shown in FIG. 28C.

Once the tile 16 is so mounted, the upwardly extending flange 316, as offset from the rear surface 304 of the tile 16 by the step 314, is retained behind the leading face 60 of the vertical rail 50. In addition, the depending wall 326, as offset from the rear surface 304 of the tile 16 by the step 324, is also retained therebehind. The second clip 302 has the angularly-extending flange 336 retained behind the leading face 60 of the vertical rail 50 as offset from the rear surface 304 of the tile 16 by the step 334.

Figure 28C:
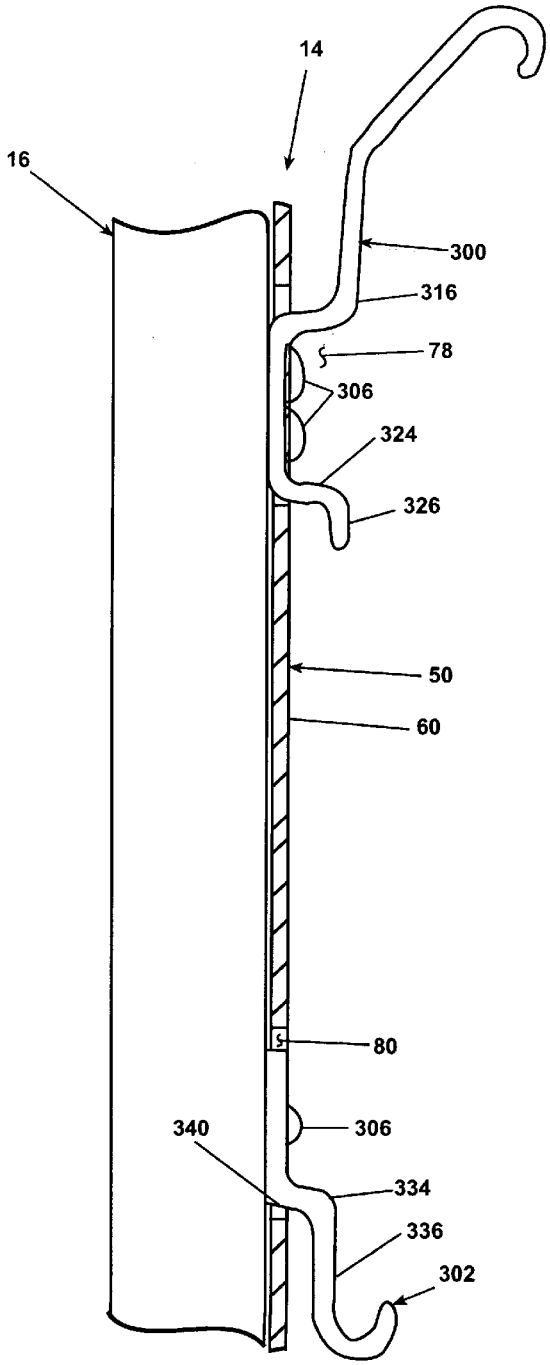
FIG. 28C is a an enlarged schematic view showing the mounted tile on the frame whereby the clips shown in FIGS. 29 and 30 retain the tile on the frame.

The upwardly extending flange 316 abuts against a rear surface of the leading face 60 of the vertical rail 50 to hold the upper portion of the tile 16 against the frame 14 as shown in FIG. 28C. Further, the angular configuration of the flange 336 on the second clip 302 acts as a "cam" surface to prevent a lower edge 340 of the second aperture 80 from sliding with respect to the step 334. Thus, the lower portion of the tile 316 is also tightly retained against the frame 14 because the lower edge 340 of the second aperture 80 is not allowed to slide rearwardly with respect to the frame 14. Thus, the first and second clips 300 and 302 provide a secure mounting of the tile 16 with respect to the frame 14 without requiring the use of conventional threaded fasteners between the tile 16 and frame 14. Thus, the tile 16 can be easily removed by reversing the steps shown in FIGS. 28A–28C to expose the interior of the frame 14 for accessing the electrical and data conduit 40 routed therein.

Figure 28D:
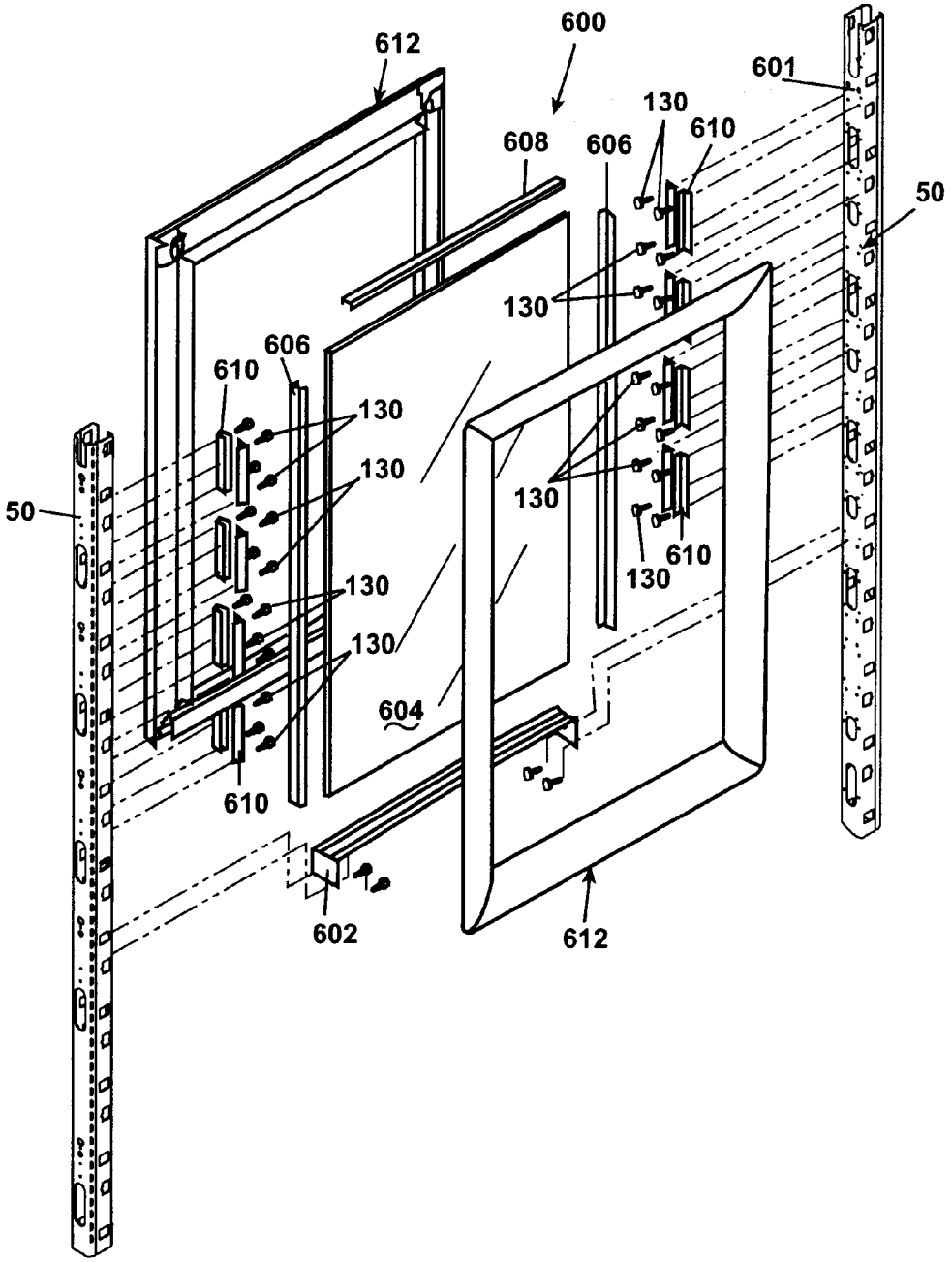
FIG. 28D is an exploded perspective view of a glass tile assembly showing the interconnection thereof with several brackets to a pair of vertical rails on a frame.

FIGS. 28D–I show the installation of a glass tile assembly for integration with the workspace definition system 10 in accordance with the present invention. FIG. 28D shows an exploded perspective view of a glass tile assembly 600 comprising a pair of vertical rails 50 having trailing faces 60, glass tile bottom rail 602, glass material 604, vertical molding strips 606, horizontal molding strips 608, side brackets 610, and frames 612. The vertical rails 50 extend generally parallel to each other, and the glass tile bottom rail 602 is secured between the vertical rails 50 in a generally perpendicular orientation. Both the vertical and horizontal molding strips 606 and 608, respectively, are secured to the glass material 604 upon complete fabrication. As will be discussed in greater detail below, the side brackets 610 are secured to a pair of vertical rails by fasteners 130. While the window has been disclosed as fabricated from glass material, it is likewise contemplated that any one of a number of polymeric resins including, but by no means limited to, acrylic resins are suitable for use.

Figure 28E:
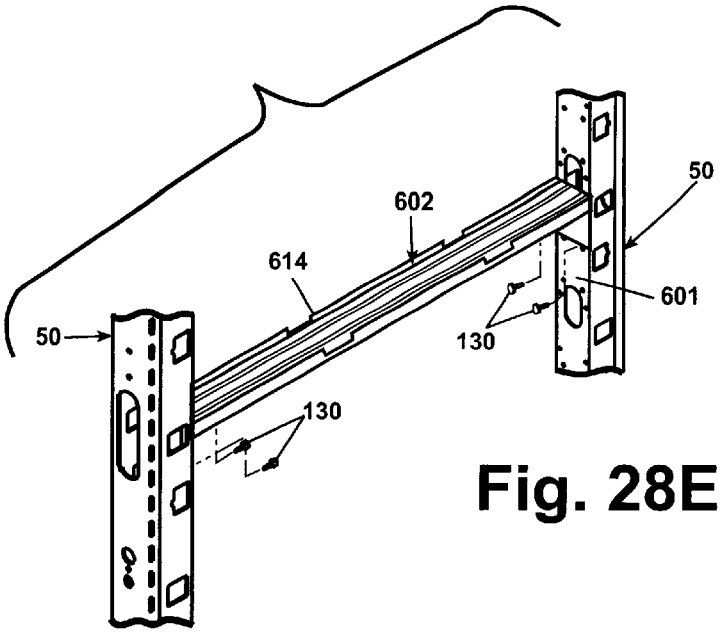
FIG. 28E is a fragmentary, perspective view of the interconnection of a glass tile bottom rail between a pair of vertical rails in the frame of FIG. 28D which is adapted to receive a bottom portion of a glass panel therein.

FIG. 28E shows the interconnection of a glass tile bottom rail 602 between a pair of vertical rails 50 in the frame of FIG. 28D, which is adapted to receive a bottom portion of a glass panel therein. As further shown in FIG. 28E, upon assembly, the glass tile bottom rail 602 is secured to the trailing face 601 of each vertical rail 50 by fasteners 130. The glass tile bottom rail 602 has a channel 614 for controllably receiving the lower portion of the glass material 604.

Figure 28F:
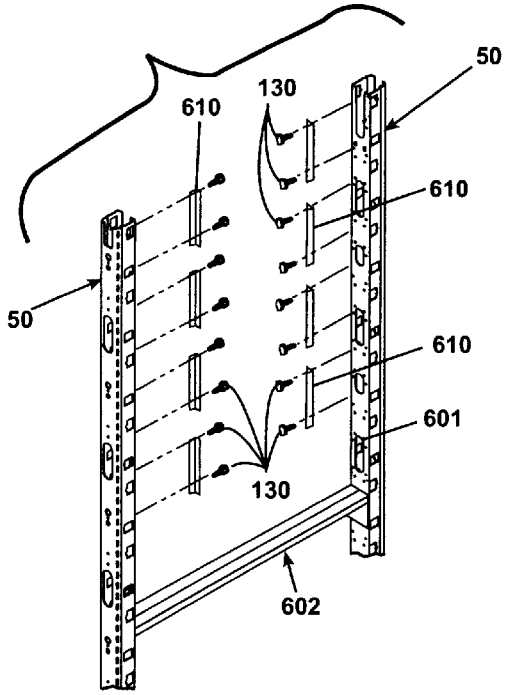
FIG. 28F is a fragmentary, perspective view showing the mounting of several brackets to one of the vertical rails of FIGS. 28D–28E for receiving vertical edge portion of one lateral surface of a glass tile.

FIG. 28F shows the mounting of a plurality of brackets 610 to the trailing face 601 of pair of vertical rails 50 of FIGS. 28D–28E, for receiving the vertical molding 606 of the glass material 604. Upon further assembly, the side brackets 610 are secured by fasteners 130 to one side of each of the vertical frames 50.

Figure 28G:
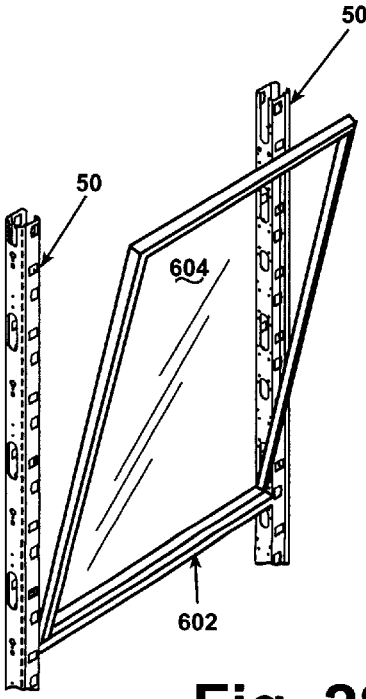
FIG. 28G is a fragmentary, perspective view showing the angular insertion of a glass panel onto the glass tile bottom rail of FIG. 28E.

FIG. 28G shows the angular insertion of the glass material 604 with associated vertical and horizontal moldings 606 and 608, respectively, into the channel 614 of the glass tile bottom rail 602. Once the glass material 604 is inserted into the glass tile bottom rail 602, the glass material 604 is rotated towards the vertical rail 50 until it contacts the plurality of previously secured side brackets 610.

Figure 28H:
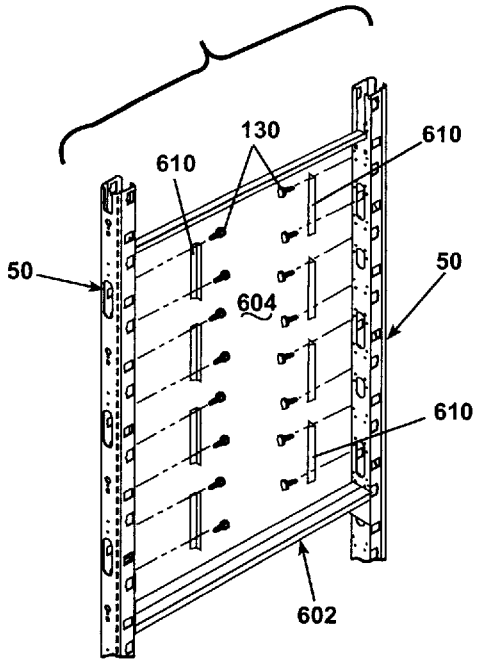
FIG. 28H is a fragmentary perspective view showing the pivotal movement from the angular position shown in FIG. 28G to a vertical position and the receipt of several brackets on the other lateral surface of the glass tile to securely mount the glass tile in a vertical position between the vertical rails of the frame.

As can be seen in FIG. 28H, once the glass material 604 is positioned so that it contacts the plurality of side brackets 610 on one side of each of the vertical rails 50, a plurality of side brackets 610 are secured by fasteners 130 on the other lateral surface of the vertical frames 50 to, in turn, secure the glass material 604 between the vertical frames 50.

Figure 28I:
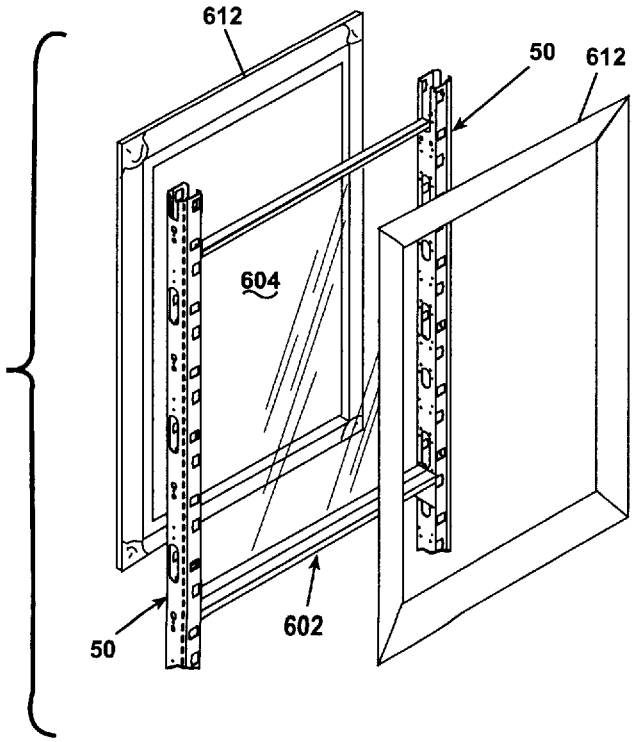
FIG. 28I an exploded perspective view showing the mounting of a pair of frames to both sides of the glass tile sub-assembly to, in turn, complete the assembly of the window tile.

FIG. 28I is an exploded perspective view showing the mounting of a pair of frames 612 to both sides glass tile assembly to, in turn, complete the assembly of the window tile. Although not shown, it will be understood that a conventional top cap 28 can be mounted atop the glass tile assembly 600 for aesthetic purposes. Furthermore, inasmuch as the glass tile assembly utilizes vertical rails 50 as previously discussed herein, the glass tile assembly can readily accommodate electrical and/or data conduit 40. Moreover, it will be further understood that a passthrough-tile assembly can be readily achieved by removing the glass material 604 from the assembly. Such a pass-through-tile assembly can be convenient for various tasks such as passing mail, and/or increasing airflow throughout the entire workspace system 10.

Figure 31:
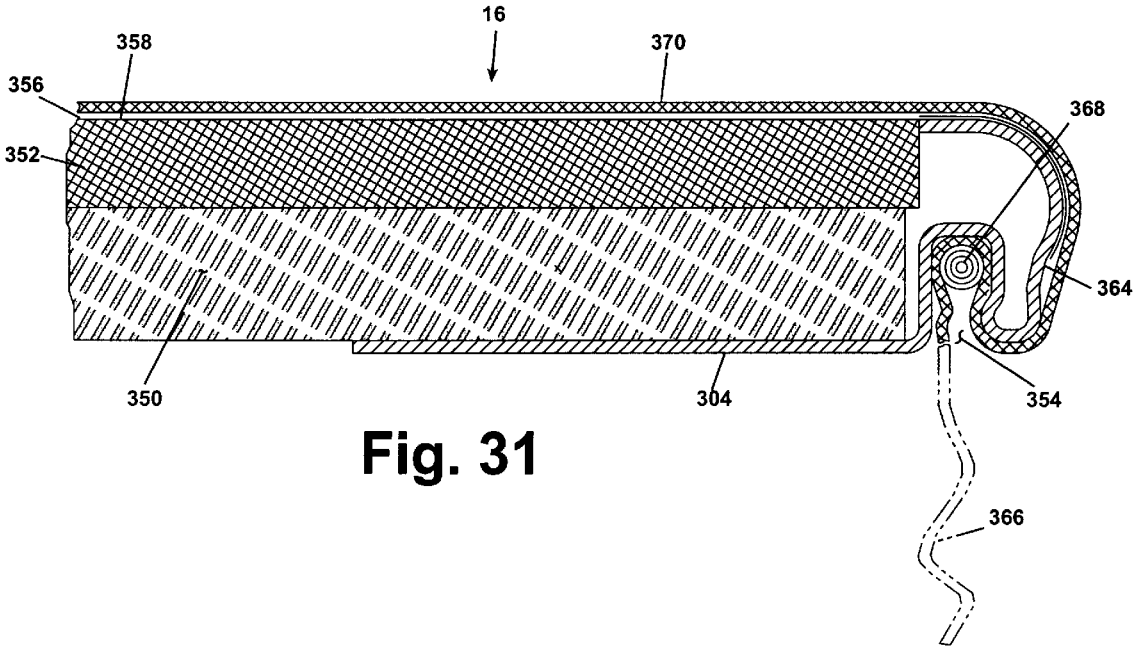
FIG. 31 is a cross-sectional view of the tile of FIG. 28 showing the mounting of a fabric cover thereon by a spline member.
Figure 32:
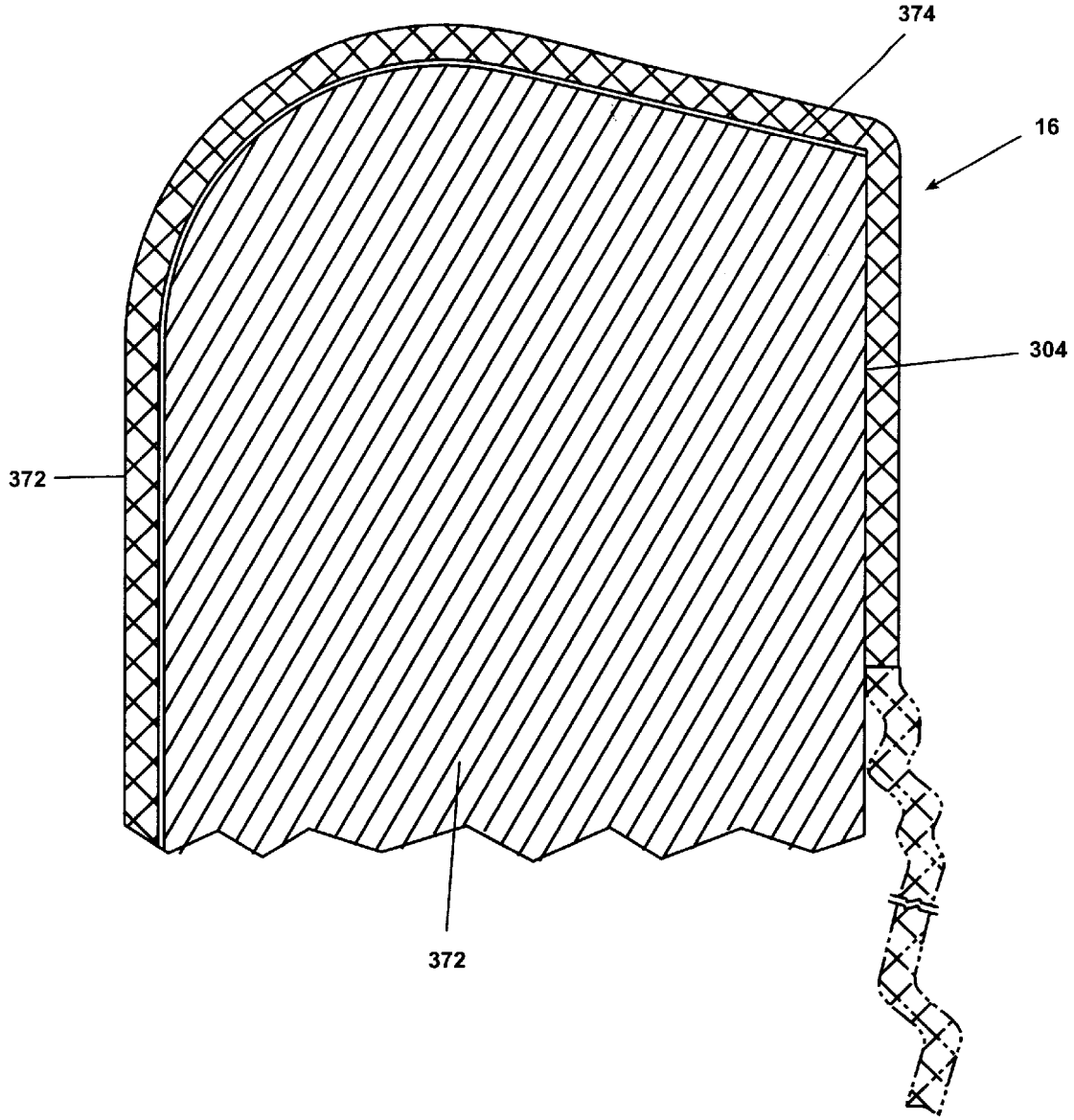
FIG. 32 is a cross-sectional view of an alternative embodiment of the tile of FIG. 28 showing the mounting of a fabric cover and a foil scrim thereon.

FIGS. 31–32 show various configurations for the tile 16. For example, in FIG. 31, the tile comprises a core 350 made from a suitable material, such as fiberglass, having a molded overlay 352 thereon which defines an inwardly-extending groove 354 on the rear surface 304 of the tile 16. The core 350 and overlay 352 can be wrapped with various materials, such as a fiberglass layer 356 and an outer fabric covering 358. An edge covering 364 can be wrapped around lateral edges of the tile 16, within the inwardly-extending groove 354 and rearwardly to the rear surface 304 so that its peripheral edge 360 is retained within a groove 362 on the rear surface 304.

The fabric covering 358 can then be wrapped around the edge covering 364 so that a peripheral edge 366 of the fabric covering 358 is disposed within the inwardly-extending groove 354 as defined by the portion of the edge covering 364 disposed therein. A spline 368 can then be disposed within the groove 354 to retain the fabric covering 358 between the spline 360 and the portion of the edge covering 364 disposed within the inwardly-extending groove 354.

By these steps, the fabric covering 358 can thereby be tautly retained over a forward surface 370 of the tile 16 to prevent wrinkling or loosening of the fabric covering. Further, the removal of the spline 368 allows the fabric covering 358 to be easily removed to change the type and/or color of fabric covering 358 on a particular tile 16 so that the style or appearance of the tile 16 can be easily changed without requiring the purchase and installation of a new tile 16.

FIG. 32 shows an alternative embodiment of the tile 16 comprising a core 372, such as particleboard, with a foil scrim layer 374 wrapped therearound intermediate an outer fabric covering 376. The fabric covering 376 of the tile 16 shown in FIG. 32 is wrapped around to the rear surface 304 of the tile 16 and mounted thereto, such as by stapling or an adhesive.

Alternatively, a tile 16 can be provided with a core material which has a vinyl coating adhesively mounted thereto or any other suitable covering known in the art to provide a desirable outer appearance to the tile 16.

Figure 32A:
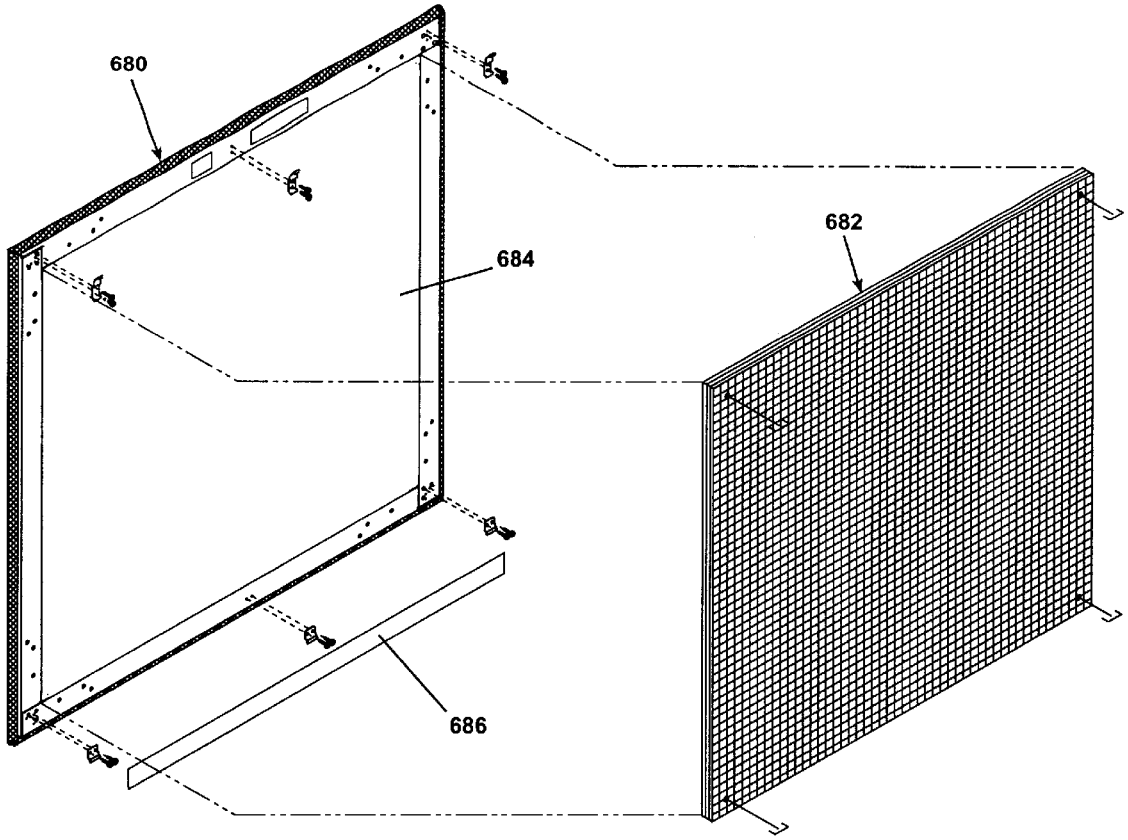
FIG. 32A is an exploded perspective view of an alternative embodiment of the tile shown in FIGS. 31–32 which is designed to enhance its acoustical properties.

In yet another embodiment an acoustical tile can replace the conventional tile 16 as described herein. As shown in FIG. 32A an acoustical tile 680 includes a fiberglass member 682 which is attached to a rear face 684 of the tile with a polyvinyl side extending from the exterior which overlaps within the inside of a surrounding frame. A light block 686 can extend from a lower edge of the acoustical tile 680 so that when adjacent panels are mounted in a vertical relationship, light is prevented from extending between a seam (not shown) of the tiles due to the light block emanating over the seam between the tiles. Alternatively, a tackable tile having a particulate core, which allows the tile to receive thumb tacks, push pins, etc., can be used instead of the tile 16.

Other types of forward surfaces 370 can be provided to the tile 16 as needed, such as a wipe-away marker board surface, a window, such as glass or an empty "passage" frame, a molded fiberglass tile, a vinyl-covered tile, and other acoustical tiles as typically used with tiles of these types.

Figure 33A:
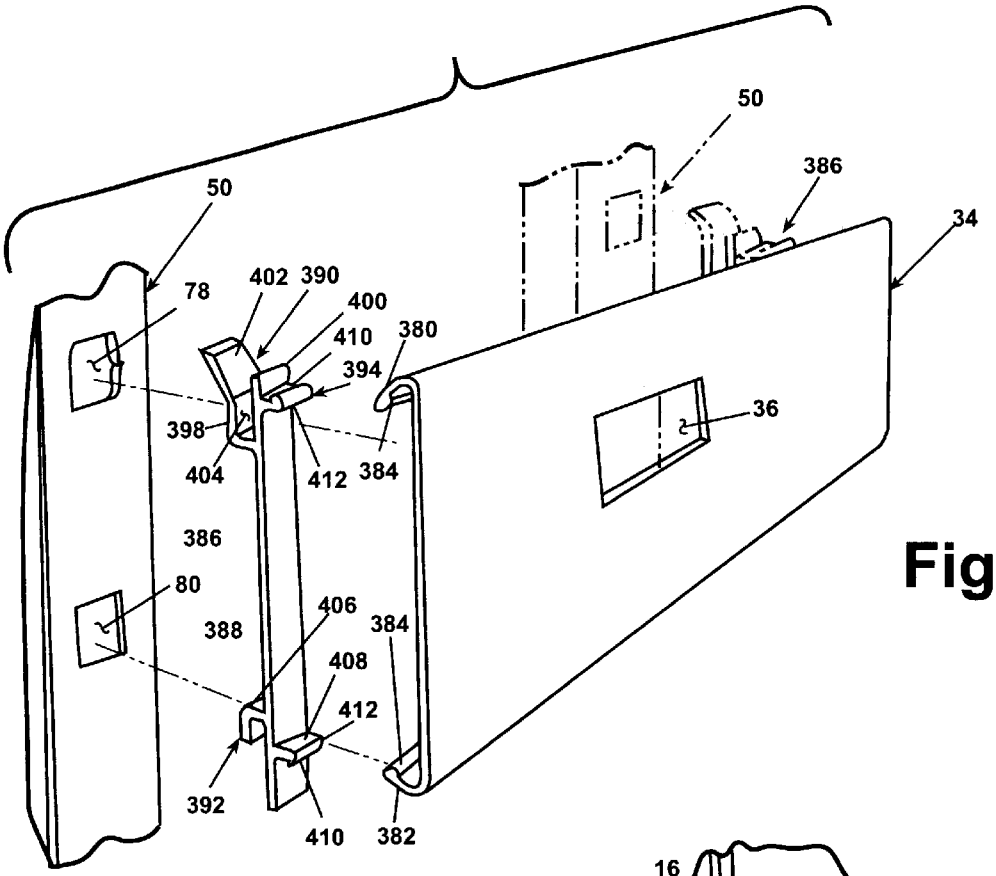
FIG. 33A is a fragmentary, exploded perspective view of the mounting of a raceway cover shown in FIGS. 1–2 to a pair of vertical rails in a frame via a pair of raceway cover brackets.
Figure 33B:
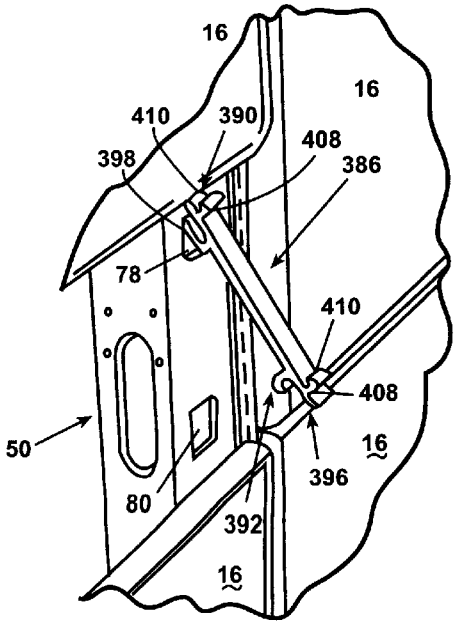
FIG. 33B is a fragmentary, perspective view showing the insertion of the raceway cover bracket of FIG. 33A into mounting apertures in the vertical rail of the frame.
Figure 33C:
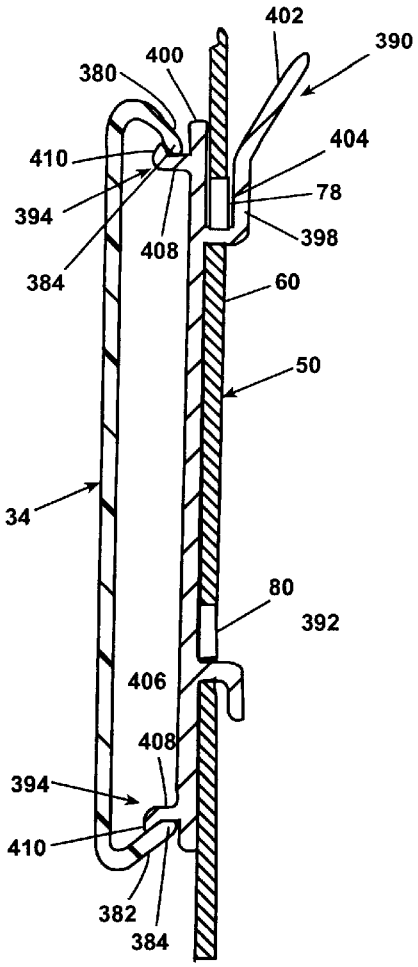
FIG. 33C is a fragmentary, perspective view showing the mounting of the raceway cover bracket of FIGS. 33A–33B into a pair of apertures in the vertical rail of the frame.

FIGS. 33A–33C show the mounting of the raceway cover 34 within a gap between several tiles 16 mounted to a framework comprising several interconnected frames 14. As described above, the raceway cover 34 generally comprises an elongated member having an opening 36 therein so that, when the raceway cover 34 is mounted to a frame 14, the opening 36 can be aligned with an electrical or data socket (not shown) mounted to the frame 14 for interconnection with components, such as a computer, printer, fax machine, telephone, etc.

The raceway cover 34 preferably has a pair of rearwardly-extending upper and lower edges 380 and 382, respectively, which are adapted to be mounted flush with adjacent edges of tile 16 and/or office components 18–24 to provide a smooth outer appearance to the workspace definition system 10. Each of the upper and lower edges 380 and 382 can be provided with a detent 384 thereon which is adapted to receive a raceway cover bracket 386. The raceway cover bracket 386 is adapted to engage the detents 384 at the upper and lower edges 380 and 382 of the raceway cover 34 and, in turn, be mounted within the first and second apertures 78 and 80 on a pair of vertical rails 50 of a frame 14.

The raceway cover bracket 386 comprises an elongated member 388 having a rearward surface provided with first and second mounting flanges 390 and 392 and a forward surface provided with third and fourth mounting flanges 394 and 396. The first and third mounting flanges 390 and 394 are preferably located adjacent an upper edge of the elongated member 388 and the second and fourth mounting flanges 392 and 396 are preferably located adjacent a lower edge of the elongated member 388. The second mounting flange 392 is preferably located upwardly from the fourth mounting flange 396.

The first mounting flange 390 comprises a pair of opposed L-shaped members 398 and 399. The L-shaped member 398 faces upwardly and has an upper edge 400 provided an upwardly- and angularly-extending flange 402. The angularly-extending flange 402 preferably extends beyond the upper edge of the elongated member 388 and the L-shaped member 398 and angularly-extending flange 402 cooperate to define a gap 404 with the upper portion of the elongated member 388.

The second mounting flange 392 comprises an inverted L-shaped member 406 which extends rearwardly and downwardly with respect to the elongated member 388.

The third and fourth mounting flanges 394 and 396 are identical members but disposed in an opposing relationship so that the fourth mounting flange 396 is a mirror image of the third mounting flange 394. Thus, common reference numerals are described with respect to each. The third and fourth mounting flanges 394 and 396 comprises a laterally-extending plate 408 which has a detent 410 on an outer distal edge 412 thereof. The detent 410 extends upwardly from the third mounting flange 394 and extends downwardly from the fourth mounting flange 396 as shown FIG. 33A.

A pair of brackets 386 can be mounted to a pair of vertical rails 50 in a frame 14 as best shown in FIG. 33B. The bracket 386 is brought toward a first and a second aperture 78 and 80 in the vertical rail 50 in an angular position so that the first mounting flange 390 is tilted toward the first aperture 78 in the vertical rail 50. The angularly-extending flange 402 is inserted within the first aperture 78 so that an upper edge of the first aperture 78 travels within the gap 404 between the first mounting flange 390 and the elongated member 388 of the bracket 386. When the first mounting flange 390 has been inserted a sufficient extent within the first aperture 78, the second mounting flange 392 is pivoted toward the second aperture 80 so that the second mounting flange 392 passes within the second aperture 80 until the bracket 386 is retained in a generally vertical position.

As best shown in FIG. 33C, the bracket 386 is then urged downwardly so that the L-shaped member 399 of the first mounting flange 390 engages over a corner edge of the first aperture 78 and the second mounting flange 394 engages over a lower edge of the second aperture 80. The L-shaped member 398 of the first mounting flange 390 is retained against the rearward surface of the leading face 60 of the vertical rail 50 so that the bracket 386 is prevented from moving laterally with respect to the vertical rail 50. Another bracket 386 can be mounted on an opposite side of the frame 14 to a pair of first and second apertures 78 and 80 as well.

The raceway cover 34 can then be snap-mounted to the pair of brackets 386 located on either side of the frame 14 by urging the detent 384 on the upper and lower edges 380 and 382 over the detents 410 on the third and fourth mounting flanges 394 and 396 so that the detent 384 is frictionally engaged behind the detent 410. Preferably, the opening 36 in the raceway cover 34 is aligned with a data or electrical socket (not shown) in a circuit provided by the data and electrical conduit 40 running throughout the workspace definition system IO so that an occupant of the workspace definition system 10 can easily interconnect various office components to the electrical and data conduit 40.

Figure 33D:
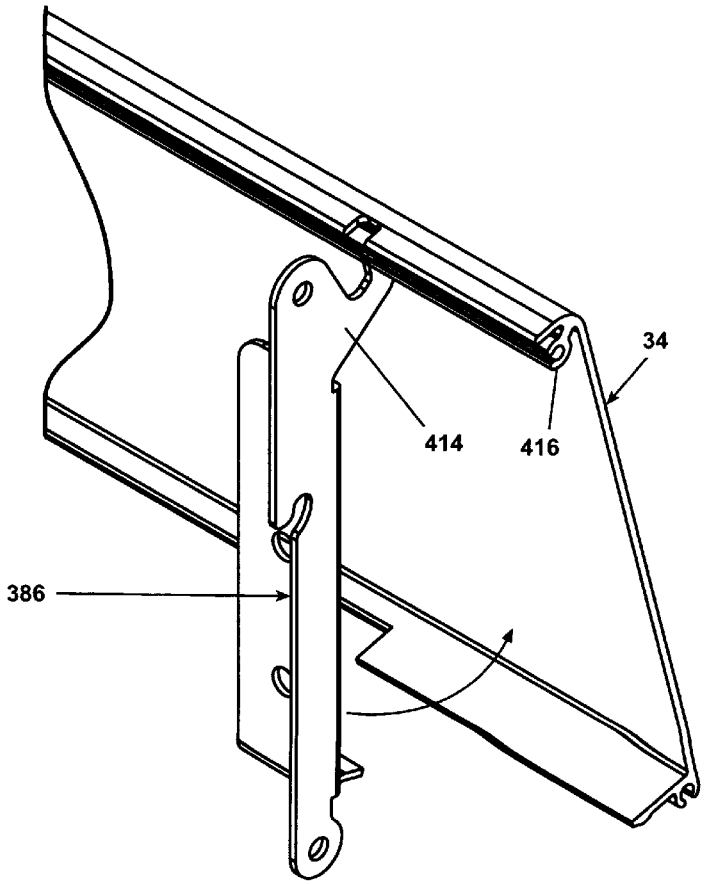
FIG. 33D is an alternative embodiment of the raceway cover and raceway cover bracket of FIGS. 33A–32C whereby the raceway cover bracket is hingedly mounted to the raceway cover allowing a user to access the interior portion of the frame by pivoting the raceway cover to an open position.

FIG. 33D shows an alternative embodiment of the raceway cover 34 and bracket 386 whereby the bracket 386 includes a hinged portion 414 which pivotally mounts to a socket 416 on the raceway cover 34 so that, when the bracket 386 is mounted to a pair of vertical rails 50 of a frame 14, the interior of the frame 14 can be accessed by pivoting the raceway cover 34 to an open position.

Figure 33E:
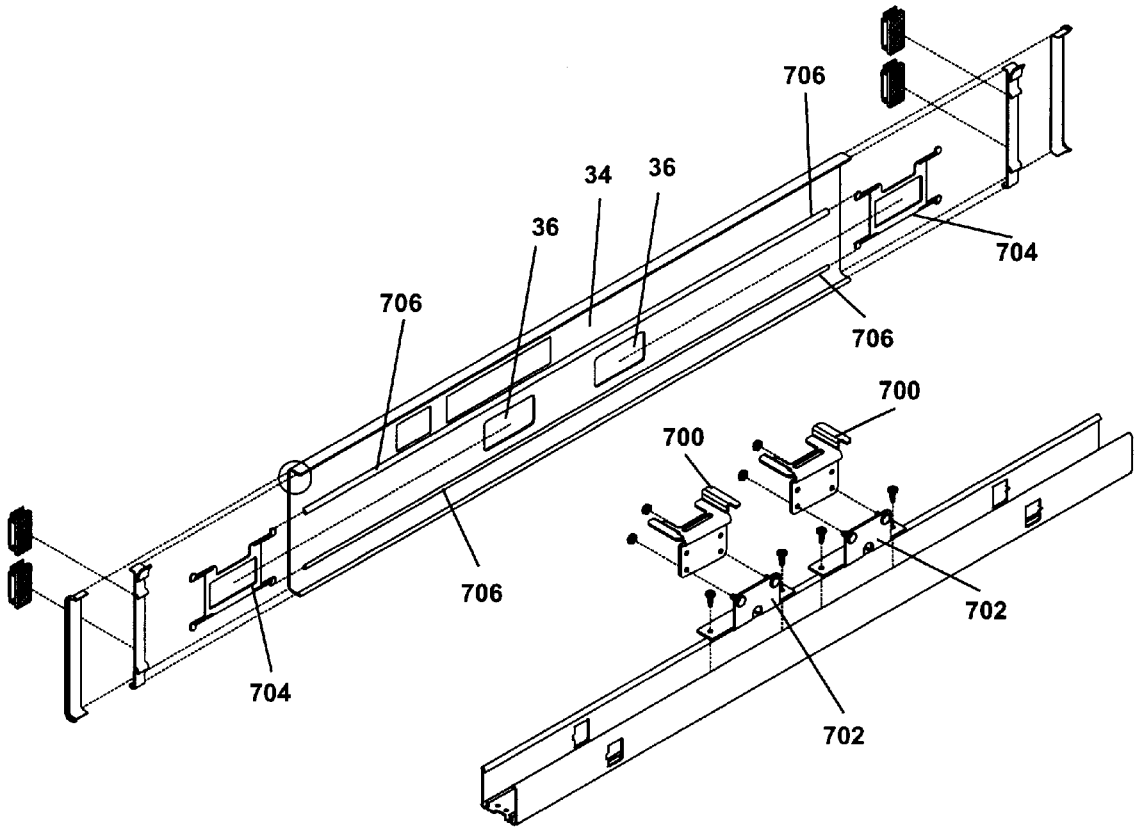
FIG. 33E is an exploded perspective view showing an alternative embodiment of the raceway cover provided with a pair of upper and lower vertical brackets for receiving communication socket hardware and a slidable receptacle cover disposed within longitudinal channels on the raceway cover which is adapted to be secured to a frame of the workspace definition system by the bracket shown in FIGS. 33A–33D.

FIG. 33E shows an alternative embodiment of the raceway cover 34 provided with a pair of upper and lower vertical brackets 700 and 702, respectively, for receiving communication socket hardware and a slidable receptacle cover 704 disposed within longitudinal channels 706 on the raceway cover 34 which is adapted to be secured to a frame 14 (shown in dashed lines) of the workspace definition system 10 by the bracket shown in FIGS. 33A–33D. The brackets in accordance with FIG. 33E mount the access panel 34 for slidable movement between an opened and closed position, whereby in the open position, electrical and data conduit 40 passing within the framework, such as within one of the horizontal rails 52, 54 and 56, can be accessed.

Figure 33F:
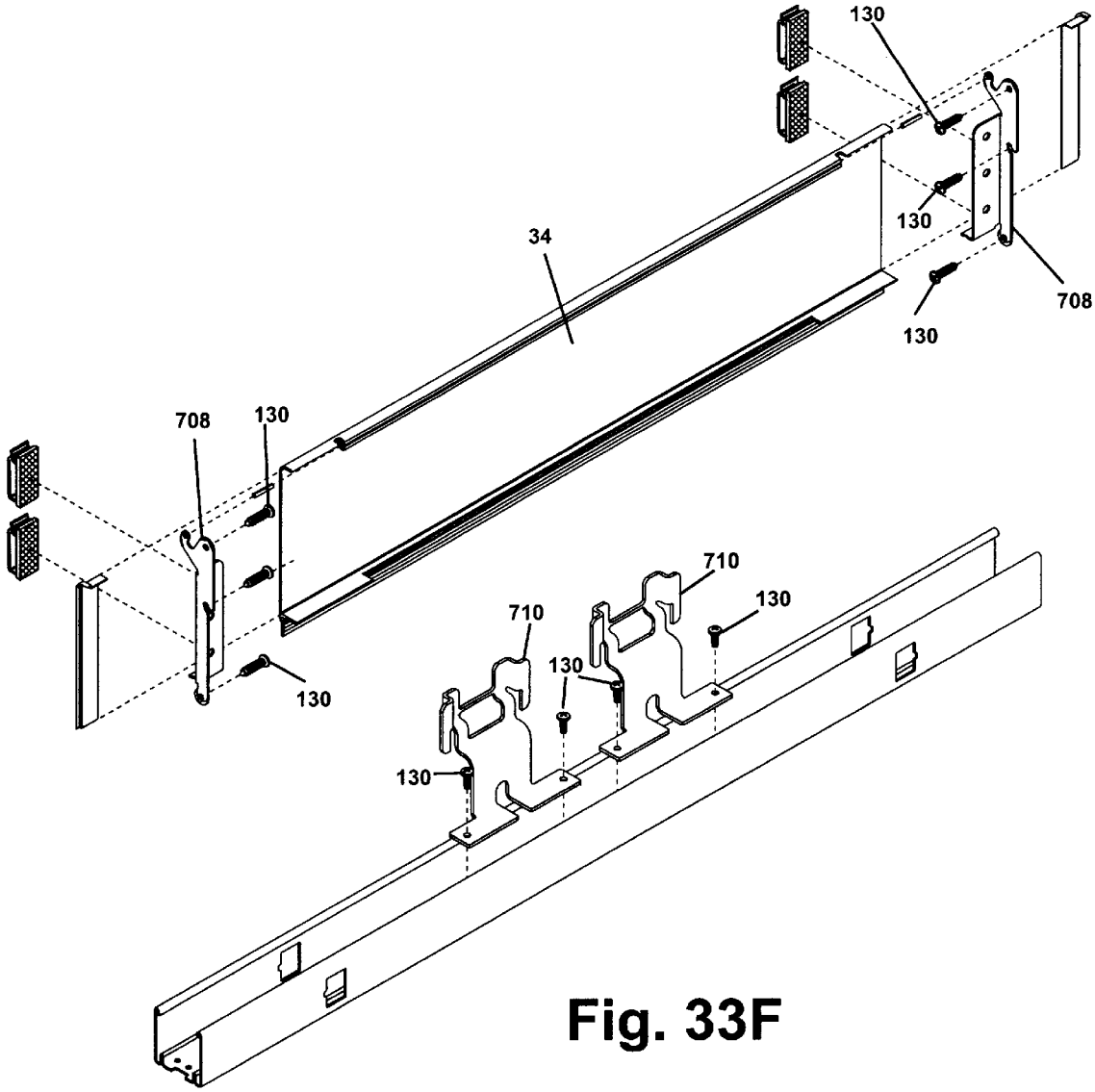
FIG. 33F is an exploded perspective view of an additional alternative embodiment of the raceway cover of FIG. 33E showing the provision of pivotally-mounted brackets for permitting movement of the raceway cover between an open and a closed position similar to that shown in FIG. 33D and having electrical brackets for receiving electrical and data communications hardware.

FIG. 33F shows an additional alternative embodiment of the raceway cover 34 of FIG. 33E wherein hinge brackets 708 pivotally mount the raceway cover 34 for movement between an open and a closed position and horizontal electrical brackets 710 receiving electrical and data communications hardware. Brackets 708 and 710 can be secured to their respective rails by fasteners 130.

Figure 34:
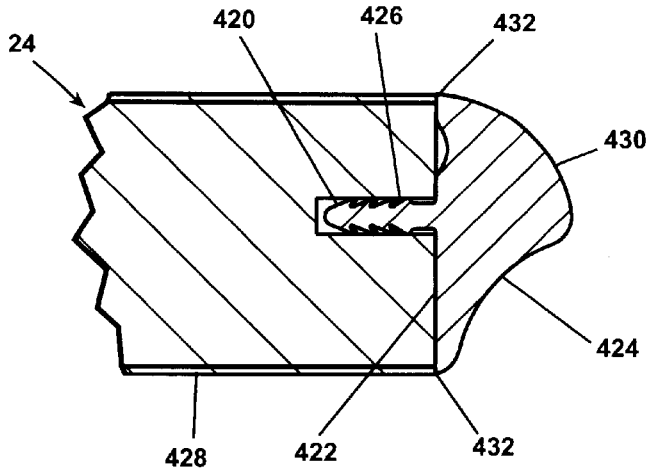
FIG. 34 is a cross-sectional view of a work surface provided with a first embodiment of a contoured edge mounted thereto by a flange.

FIG. 34 shows a worksurface 24 in cross section. The worksurface 24 is provided with a peripheral groove 420 which extends inwardly from a vertical edge 422 of the worksurface 24. The peripheral groove and vertical edge 420 and 422 cooperate to define a receiving surface for an edge molding 424. The worksurface 24, having upper and lower surfaces 426 and 428, respectively, cooperates with an exterior surface 430 of the edge molding 424 to define a "soft" or contoured vertical sidewall to the worksurface 24.

This contoured edge serves both to increase the aesthetics of the worksurface 24 as well as provide a function, if made from a soft or resilient material, of preventing an occupant of the workspace definition system 10 from injury while sitting adjacent a worksurface 24. This safety feature is provided because any sharp corners, such as those shown at 432 inbetween the upper surface 426 and vertical edge 422 and the lower surface 428 and the vertical edge 422, are given a smooth transition between the upper surface 426 and the lower surface 428, thus concealing the corners 432.

Figure 35:
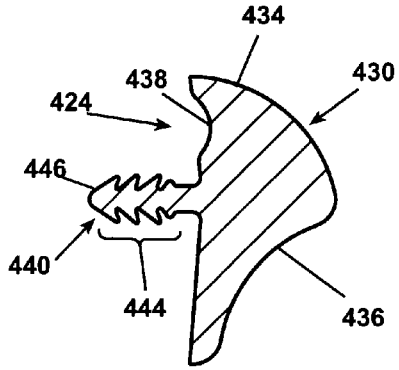
FIG. 35 is an enlarged cross-sectional view of the first embodiment of the contoured edge of FIG. 34.

The molded edge 424 is shown in FIG. 35 removed from the worksurface 24 comprising a convex upper surface 434 which arcs downwardly and terminates in a concave lower surface 436 defining the exterior surface 424 thereof. A rearward surface 438 of the edge molding 424 is provided with a rearwardly-extending flange 440. The flange 440 preferably comprises an elongated member 442 provided with several reversely-angled resilient detents 444 which terminate in a conical surface 446 thereon.

The edge molding 424 is mounted to the receiving surface of the worksurface 24 defined by the peripheral groove 420 and vertical edge 422 by inserting the flange 440 on the rearward surface 338 of the edge molding 424 within the peripheral groove 420 until the rearward surface 438 of the edge molding 424 abuts the vertical edge 424 of the worksurface 24. As the flange 440 is inserted within the peripheral groove 420, the detents 444 on the flange 440 frictionally engage surfaces defining the peripheral groove 420. The reverse angle of the detents 440 allow the flange 440 of the edge molding 424 to be inserted into the peripheral groove 420 with ease, however, if the edge molding 424 is attempted to be pulled out of the peripheral groove 420, the detents 444 flex against the movement of the flange 440 out of the peripheral groove 420 making the removal of the edge molding 424 from its engagement with the worksurface 24 difficult.

Figure 36:
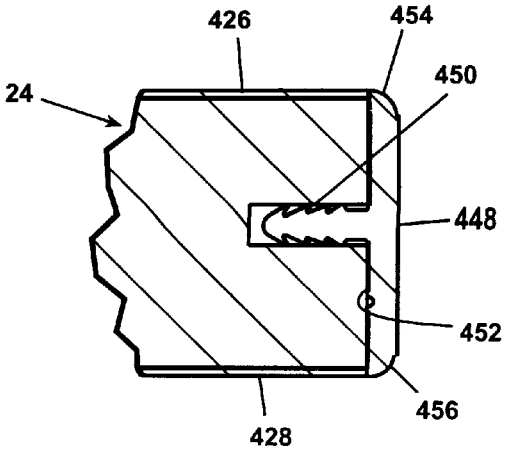
FIG. 36 is a cross-sectional view of a second embodiment of the contoured edge of FIG. 34.

FIG. 36 shows an alternative embodiment of the edge molding 448 provided with a flange 450 extending from a rearward surface 452 of the edge molding 448. The flange 450 is preferably configured similarly to the flange 440 shown with respect to the first embodiment of the edge molding 424 of FIGS. 34–35. The edge molding 448 is mounted within a peripheral groove 420 of a worksurface 24 in the same manner and differs only in shape from the embodiment shown in FIGS. 34–35. The edge molding 448 is defined by a generally flat cross section which has rounded upper and lower edges 454 and 456 as shown in FIG. 36.

Figure 37:
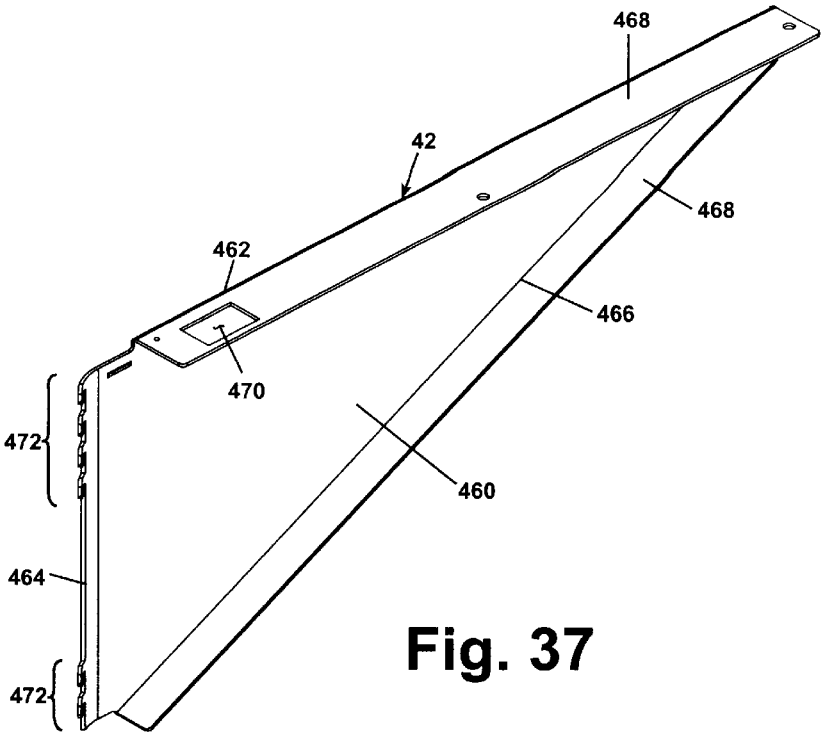
FIG. 37 is a perspective view of a first embodiment of a cantilever support bracket adapted to mount within vertical hanging intelligence located on a frame of FIG. 4.
Figure 38:
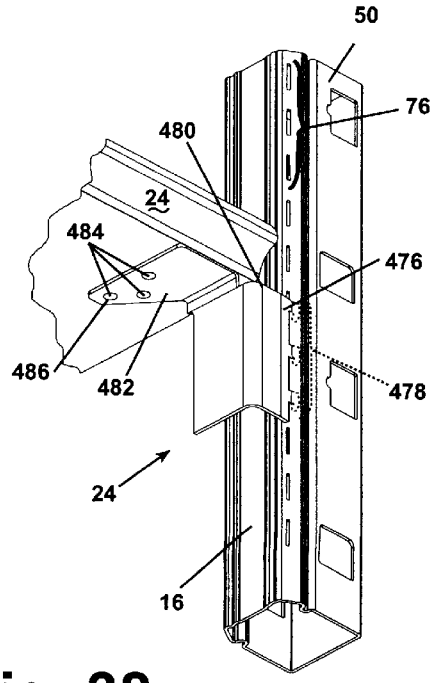
FIG. 38 is a perspective view of a second embodiment of a cantilever support bracket adapted to mount within vertical hanging intelligence located on a frame subassembly of FIG. 4.
Figure 39:
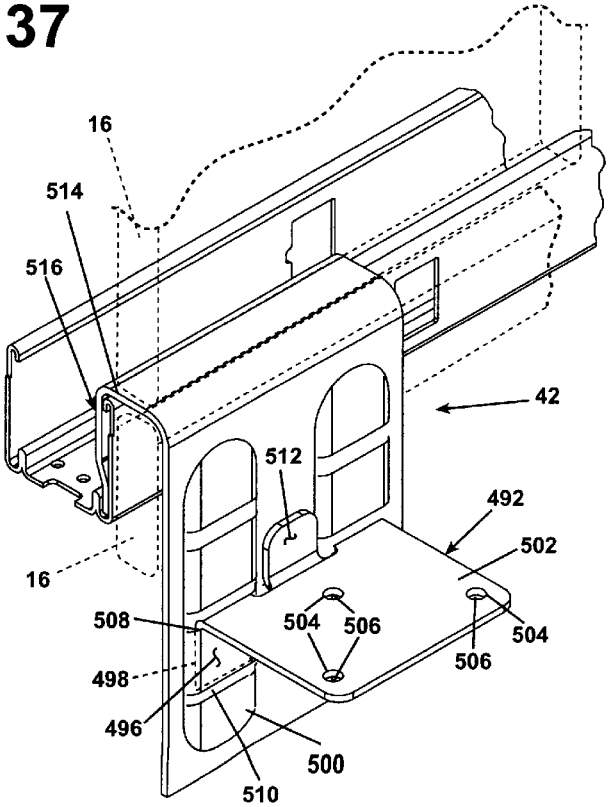
FIG. 39 is a perspective view of a third embodiment of a detachable support bracket adapted to mount over an upper edge of a rail in a frame of FIG. 4.

FIGS. 37–39 show various embodiments of brackets 42 used to mount a worksurface 24 to a frame 14. FIG. 37 shows a bracket 42 comprising a triangular body 460 having an upper leg and a vertical leg 462 and 464, respectively, preferably disposed at right angles with respect to one another and a hypotenuse leg 466 extending between the distal ends thereof. The upper leg 462 and hypotenuse leg 466 are preferably provided with laterally-extending plates 468 provided for the purpose of increasing the structural integrity of the triangular body 460 and, in the case of the upper leg 462, providing a mounting aperture 470 for receiving a fastener which extends through the mounting aperture 470 and into a worksurface 24. Alternatively, an underside of a worksurface 24 can be provided with a depending flange sized to pass within the mounting aperture 470 when the worksurface 24 is placed thereon.

The vertical leg 464 is preferably provided with several angled hooks 472, often referred to as vertical hanging intelligence, which are adapted to be received within the slots 76 the ramped portion 72 of a vertical rail 50 of a frame 14. When the hooks 472 are mounted within the slots 72 of a vertical rail 50, the triangular body 460 of the bracket 42 preferably extends in cantilever fashion from the vertical rail 50 of the frame 14 so that the upper leg 462 is positioned to receive a worksurface 24.

FIG. 38 shows a second embodiment of the bracket 42 shown comprising an L-shaped body 474 adapted to wrap around a vertical edge of a tile 16. The body 474 has a rearward edge 476 provided with several slots 478 configured in the same angled configuration as the hooks 472 of the embodiment of the bracket 42 shown in FIG. 37. An upper edge 480 of the L-shaped body 474 is provided with a forwardly-extending plate 482.

The plate 482 preferably extends in cantilever fashion from the upper edge 480 of the L-shaped body 474 and is provided with several mounting apertures 484. As shown in FIG. 38, the mounting apertures 484 are adapted to receive fasteners 486 which extend through the apertures 484 into the worksurface 24 to securely mount the plate 482 to the underside of the worksurface 24. The hooks 478 on the L-shaped body 474 are inserted within the slots 76 on a vertical rail 50 as described with the previous embodiments of the bracket 42 shown in FIG. 37.

The advantage of the embodiment of the bracket 42 shown in FIG. 38 is that the L-shaped body 474 can rest directly upon a corner edge of the tile 16 whereby the mounting of a worksurface 24 (or any other office component) can be accomplished with a minimum of exposure of the bracket 42 to an occupant of the workspace definition system 10. Rather, the L-shaped body 474 can be inserted through a seam between adjacent tiles 16 mounted to a frame 14 to engage the hooks 478 within the slots 76 on a corresponding vertical rail 50.

A third embodiment of the bracket 42 is shown in FIG. 39 comprising a first portion 490 and a second portion 492 whereby the second portion 492 is adapted to be detachably mounted to the first portion 490 to allow the second portion 490 to be removed from engagement therewith.

The first portion 490 of the third embodiment of the bracket 42 comprises a plate 494 provided with a pair of raised channels 496 therein. The channels 496 are preferably oriented in a vertical direction and are adapted to receive a mating bracket of the second portion 492. Each of the channels 496 defines a slot 498 which terminates at a lower end thereof in a stop 500 which delimits a lower limit of travel of the second portion 492 within each channel 496.

The second portion 492 of the third embodiment of the bracket 42 shown in FIG. 39 comprises a plate 502 provided with several apertures 504 therein which are adapted to receive fasteners 506 for mounting the second portion 492 to the underside of a worksurface 24 as shown in FIG. 39. A rearward edge 508 of the plate 502 is provided with a pair of depending flanges 510 preferably aligned with the channels 496 on the first portion 490 of the bracket 42. A depending central flange 512 is located between the depending flanges 510 and is preferably forwardly offset from a vertical plane of the depending flanges 510. The central flange 512 is provided to abut the plate 494 of the first portion 490 of the bracket 42 to provide a more secure mounting of the second portion 492 to the first portion 490.

The second portion 492 of the bracket 42, when mounted to a worksurface 24 by the fasteners 506, can be detachably mounted within the channels 496 of the first portion 490 by sliding the depending flanges 510 within the slots 498 within each channel 496 so that the offset central flange 512 abuts the plate 494 and prevents rotation of the second portion 492 with respect to the first portion 490 and also prevents bending of the flanges 510 and 512 as well.

The first portion 490 of the bracket 42 shown in FIG. 39 can be mounted to the frame 14 of the workspace definition system IO in several ways. Preferably, an upper edge 514 of the first portion 490 of the bracket 42 is provided with a hook 516 which is adapted to be passed over an upper edge of a tile 16 and engaged over an upper edge of a top, intermediate or foot rail 52, 54, and 56. Thus, as shown in FIG. 39, the first portion 490 can be removably mounted to the frame 14 between a pair of adjacent tiles 16 and the second portion 492 can be mounted to the first portion 490 to support a worksurface 24 in cantilever fashion with respect to a particular frame 14 within the workspace definition system 10.

In any event, with respect to the bracket 42 shown in FIGS. 37–39, a worksurface 24 can have a distal end supported by a leg 26 as shown in FIGS. 1–2 to prevent undue strain or torsion imparted to the brackets 42. However, it has been found that any of the brackets 42 shown in FIGS. 37–39 are adequate to support a worksurface 24 under normal use conditions of the workspace definition system 10.

Referring back to FIGS. 1–3, the workspace definition system 10 can be laid out in any desired manner to further subdivide an open workspace area. It should be understood that the arrangement shown in FIGS. 1–3 is by example only and any particular configuration of the workspace definition system 10 shown in the drawings should not be construed as limiting. Rather, it is a feature of this invention that the workspace definition system 10 can be constructed and rearranged easily with a minimum of effort.

Further, as best shown in FIG. 2, electrical and data conduit 40 can be routed throughout the workspace definition system 10 such as by laying the electrical and data conduit 40 within the top, intermediate and foot rails 52, 54, and 56, respectively. Further, the electrical and data conduit 40 can be routed between various vertical levels of the interconnected frames 14 by passing the electrical data conduit 40 through the central apertures in the connectors 210 and trusses 252 as described above to further aid the routed of electrical and data conduit throughout the workspace definition system 10. In addition, the vertical rails 50 of the frames 14 have several apertures therein for routing the electrical and data conduit laterally between interconnected frames 14. Moreover, electrical and/or data conduit 40 can be accommodated in the open space of the frame 14 and can be routed using virtually any vector.

Various embodiments of the tile 16 can be easily mounted to the frames 14 interconnected by the connectors 210 to create a subdivided workspace as shown in FIG. 1. The mounting of the tile 16 is affected by the first and second clips 300 and 302 as described above and as shown in FIGS. 28A–28C.

As best shown in FIG. 2, the interconnected frames 14 often have gaps between front and rear surfaces of a frame 14 and between adjacent tiles 14. An upper surface of a frame 14 can be enclosed by a top cap 28 as described above while an upper surface of a joint between interconnected frames 14 can be enclosed by a corner cap 30 as previously described. Vertical gaps of a frame 14 can be enclosed by an end cap 32. Office components, such as overhead bins 18, shelves 20, pedestals or file cabinets 22 and worksurfaces 24, can be hung from the frame 14 to further increase the utility of the workspace definition system 10.

For areas frequently accessed by the occupants of the workspace definition system 10 to access the electrical and data conduit 40 routed throughout the system 10, removable or pivotal raceway covers 34 can be mounted on brackets 386 and be provided with openings 36 which communicate with electrical or data sockets (not shown) operably interconnected with the electrical and data conduit 40 routed throughout the system 10.

It is readily apparent from a review of the specification and examination of the drawings that the workspace definition system 10 provides easy access to electrical and data conduit routed throughout the system 10 combined with easy reconfiguration and rearrangement of the layout of the system 10 with a minimum of cost and effort.

Figure 40:
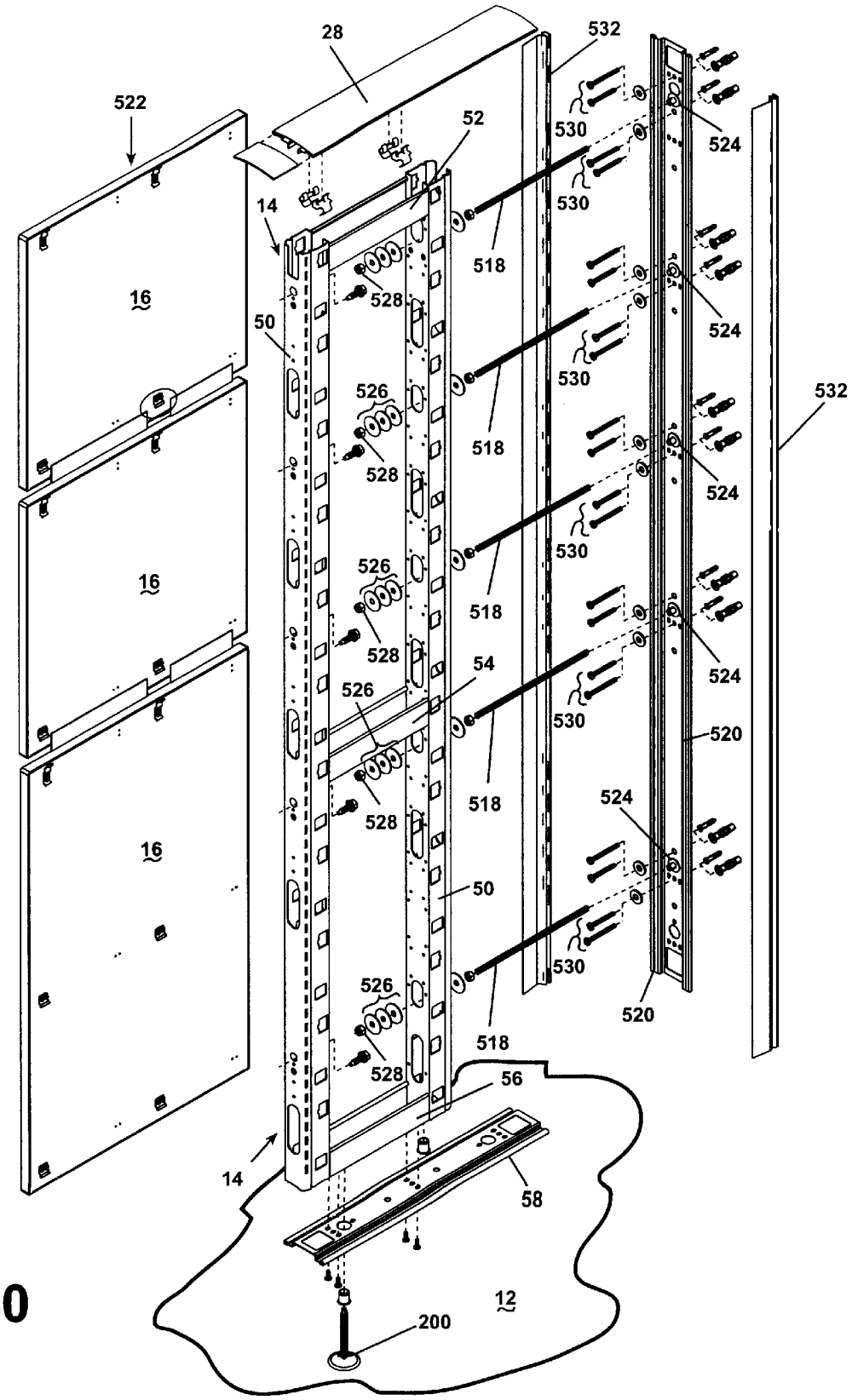
FIG. 40 is an exploded perspective view of an adjustable filler panel assembly for interconnection between two vertical surfaces.

FIG. 40 shows an exploded perspective view of a filler panel assembly 522 having a top rail 52, intermediate rail 54 and foot rail 56 extending in generally horizontal fashion between a pair of substantially vertical rails 50 so that the frame 14 has a generally rectangular configuration. The frame 14 is shown as also having a bump rail 58 with a ground engaging glide 200, mounted to the base of a pair of vertical rails 50, and a foot rail 56 to provide stability to the frame 14 and to support the frame 14 in a free-standing capacity on the floor surface 12. The filler panel assembly 522 further includes a plurality of threaded rods 518 which extend generally parallel to the top rail 52, the intermediate rail 54, and the bottom rail 56. The threaded rods 518 are secured, on one end, to a filler bump rail 520 by threaded apertures 524. The filler bump rail 520 can be secured to a vertical surface by any one of a number of conventional fasteners 530. A pair of base tile trim pieces 532 can be slidably secured to the distal edges of the filler bump rail 520. It will be understood that the threaded rods 518 can be secured to any vertical surface having compatible threaded apertures to be secured thereto. The threaded rods 518 are also secured to the leading face 60 of one of the vertical rails 50. Specifically, a portion of the threaded rods 518 extend through either one of the two mounting apertures 88, which are fixed in position by a plurality of washers 526 and at least two nuts 528. The distance between the vertical rail 50 and the filler bump rail 520 can be adjusted simply by rotating the nuts which secure the threaded rod 518 to the vertical rail 50. Once the appropriate distance between the filler bump rail 520 and the vertical rail 50 is established, the tiles 16 can be cut down the a conforming width and secured onto the frame 14 in any one of a number of conventional manners specified here within. After the desired width has been achieved, a top cap 28 can be secured atop the top rail for aesthetic purposes.

Figure 41:
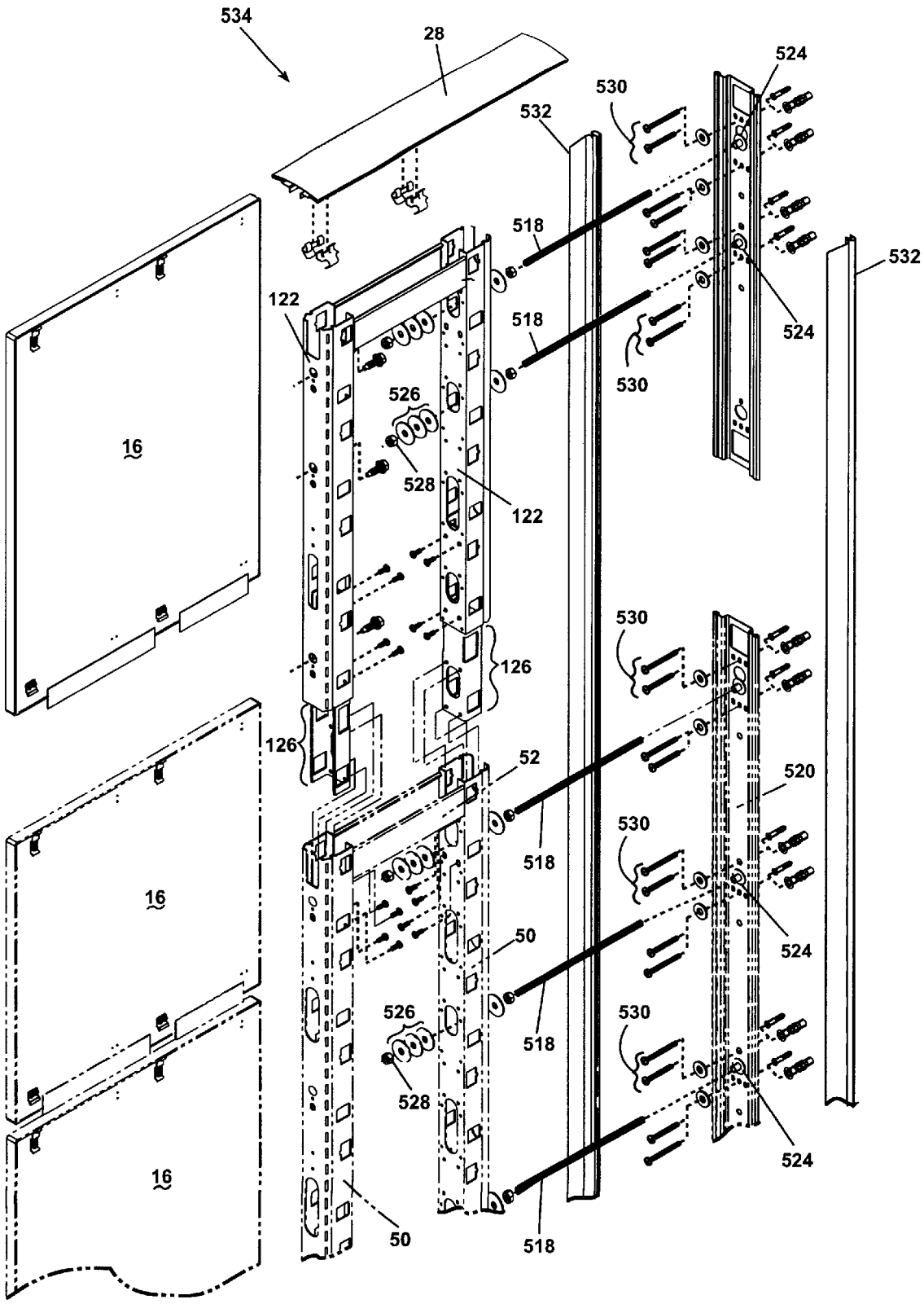
FIG. 41 is an exploded perspective view of an adjustable stacker filler panel assembly for interconnection with an upper portion of the adjustable filler assembly of FIG. 40, which provides an extension of the vertical height thereof.

FIG. 41 shows an exploded perspective view of a stackable filler panel assembly 534 mounted atop a frame 14 comprising rails 50–56 as previously described in FIG. 40 herein. The stackable filler panel assembly 534 is used to increase the height of a frame 14 of a filler panel assembly 522 when a framework of increased height is desired. The stackable filler panel assembly 522 comprises a pair of vertical rails 122 supporting a top rail 124 there between at an upper end thereof. Each of the vertical rails 122 are provided with a reduced diameter depending flange 126 which is preferably shaped to correspond with the interior of a vertical rail 50 as shown in FIG. 40. The stackable filler panel assembly 534 further includes a plurality of threaded rods 518 which extend generally parallel to the top rail 52, the intermediate rail 54, and the bottom rail 56. The threaded rods 518 are secured, on one end, to a filler bump rail stacker 536 by threaded apertures 524. The filler bump rail stacker 536 can be secured to a vertical surface by any one of a number of conventional fasteners 530. It will be understood that the threaded rod 518 can be secured to any vertical surface having compatible threaded apertures to be secured thereto. The threaded rods 518 are also secured by one of the vertical rails 126. Specifically, a portion of the threaded rods 518 extend through either one of the two mounting apertures 88, which arc fixed in position by a plurality of washers 526 and at least two nuts 528. The distance between the vertical rail 122 and the filler bump rail 520 can be adjusted simply by rotating the nuts which secure the threaded rod 518 to the vertical rail 122. Once the appropriate distance between the filler bump rail stacker 536 and the vertical rail 122 is established, the tiles 16 can be cut down the a conforming width and secured onto the frame 14 in any one of a number of conventional manners specified herewithin. After the desired width has been achieved, a top cap 28 can be secured on top of the top rail 124 for aesthetic purposes.

Figure 42A:
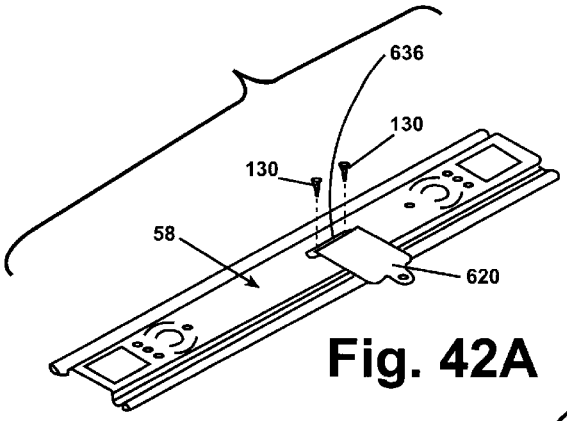
FIG. 42A is a fragmentary perspective view of the bump rail of FIG. 16 with the addition of a bottom bracket thereon for the interconnection of one frame intermediate the ends of an adjacent frame in a perpendicular fashion.

FIGS. 42A–H show how two frames 14 of the workspace definition system 10 can be interconnected in a perpendicular fashion intermediate the ends of each of the frames 14. In particular, FIG. 42A shows the bump rail 58 of FIG. 16 with the addition of a bottom bracket 620 thereon for the interconnection of one frame intermediate the ends of an adjacent frame in a perpendicular fashion. A portion of the bottom bracket 620 is received in a bump rail aperture 636 of the bump rail 58. The bottom bracket 620 is then secured to the bump rail 58 by fasteners 130.

Figure 42B:
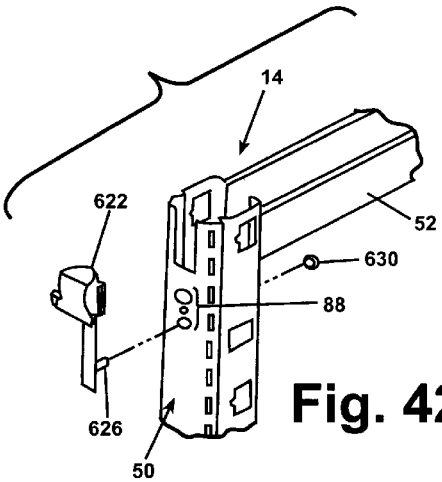
FIG. 42B is a fragmentary perspective view of an upper corner portion of a frame showing the attachment of an upper bracket thereto for completing the mid-panel installation of one frame to another.

FIG. 42B shows the upper corner portion of a vertical rail 50 of a frame 14 highlighting the attachment of an upper bracket 622 thereto for completing the mid-panel installation of one frame to another. In particular, a threaded stud 626 of the upper bracket 622 is received by one of the mounting apertures 88 of the vertical rail 50. The mounting apertures include a flow drill aperture 89 and a clearance aperture 91. Subsequently, a nut 630 engages the threaded stud 626 to, in turn, secure the upper bracket 622 to the vertical rail 50 of the frame 14.

Figure 42C:
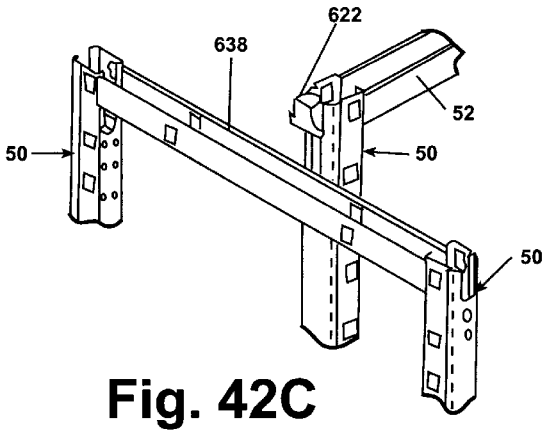
FIG. 42C shows the placement of one frame having the upper bracket of FIG. 42B adjacent to, and perpendicular to, another frame.
Figure 42D:
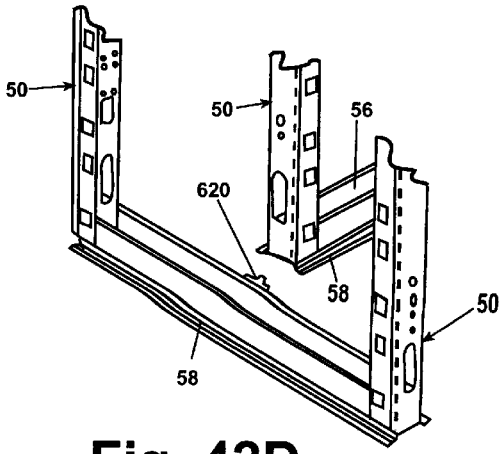
FIG. 42D is a fragmentary perspective view of a lower portion showing the placement of the frame of FIG. 42C adjacent to, and perpendicular to, another frame.

FIG. 42C shows the placement of one frame 14 having the upper bracket 622 of FIG. 42B adjacent and perpendicular to another frame. In particular, the frame 14 without the upper bracket 622 is moved towards the frame 14 with the upper bracket 622, so that the upper bracket 622 engages the frame rail groove 638 of the frame 14 without the upper bracket 622. FIG. 42D shows a lower portion of the frame 14 highlighting the alignment and placement of the frame of FIG. 42C adjacent and perpendicular to another frame.

Figure 42E:
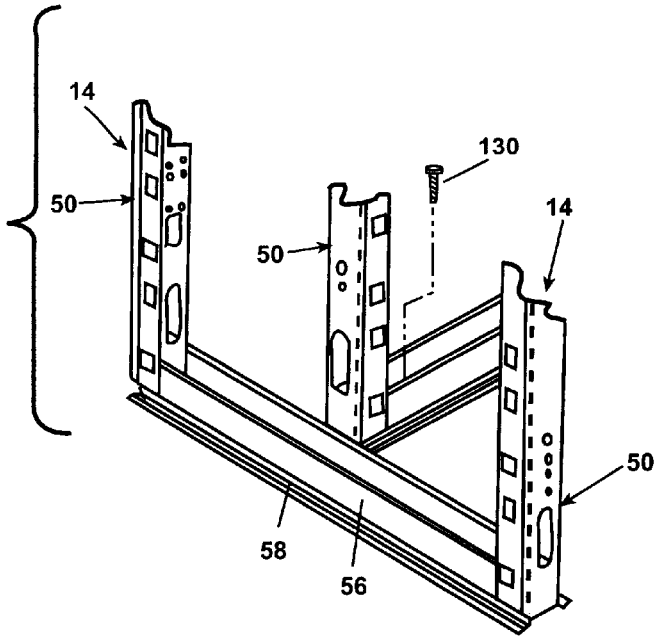
FIG. 42E is a fragmentary perspective view showing the mounting of a lower portion of one frame intermediate the ends of the adjacent frame.

FIG. 42E is a fragmentary perspective view showing the mounting of a lower portion of the frame 14 intermediate the ends of an adjacent frame 14. Once the bump rail 58 of the frame 14 with the bottom bracket 620 is operatively aligned and contacts the vertical rail 50 of the frame 14 without the bottom bracket 620, both frames 14 are secured by a fastener is 130 through a first aperture 632 (shown in FIG. 42H) of the bottom bracket 620.

Figure 42F:
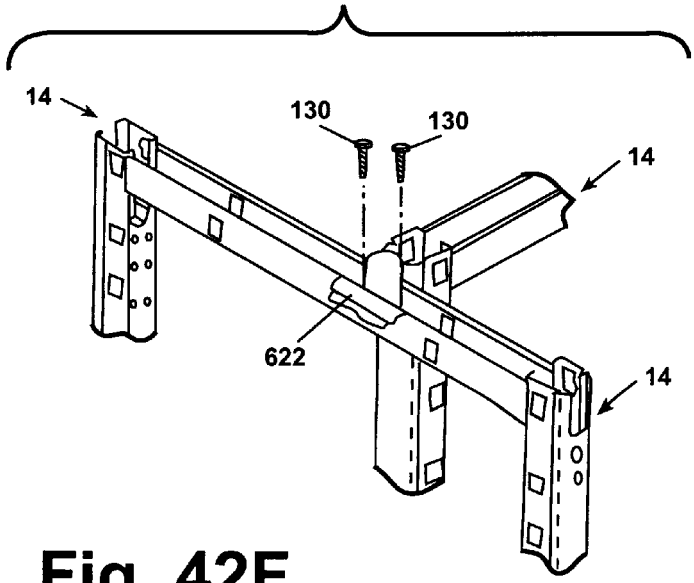
FIG. 42F is a fragmentary perspective view showing the completed mounting of an upper bracket of FIG. 42B over an upper rail of an adjacent frame.

FIG. 42F shows the completed mounting of an upper bracket of FIG. 42B over an upper portion of a vertical rail 50 of an adjacent frame 14. After both frames 14 are operatively aligned, as shown in FIG. 42B, the upper bracket 622 is secured to the frame 14 using a pair of fasteners 130 which extend through a pair of apertures 634 (not shown).

Figure 42G:
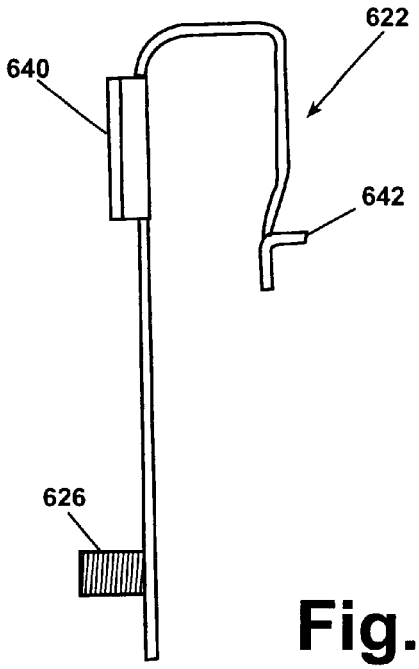
FIG. 42G is a side elevational view of the top bracket of FIG. 42B, 42C and 42F showing the engagement portions of a frame in greater detail.
Figure 42H:
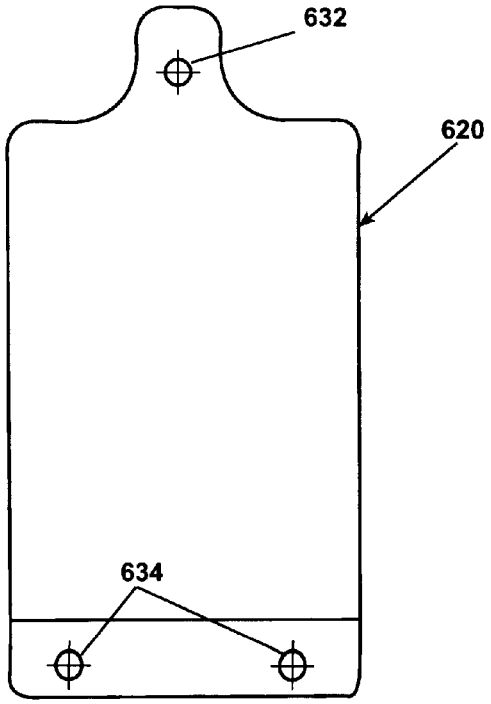
FIG. 42H is a top plan view of the bottom bracket of FIGS. 42A, 42D and 42E showing the interconnecting portions for the adjacent frames in greater detail.

FIG. 42G show the upper bracket 622 of FIGS. 42B, 42C and 42F highlighting the engagement portions for one frame and an adjacent frame in greater detail, including primary and secondary flanges 640 and 642, respectively. FIG. 42H shows the bottom bracket 620 of FIGS. 42A, 42D and 42E highlighting the interconnecting portions for the adjacent frames in greater detail, as well as first and second apertures 632 and 634, respectively.

Figure 43A:
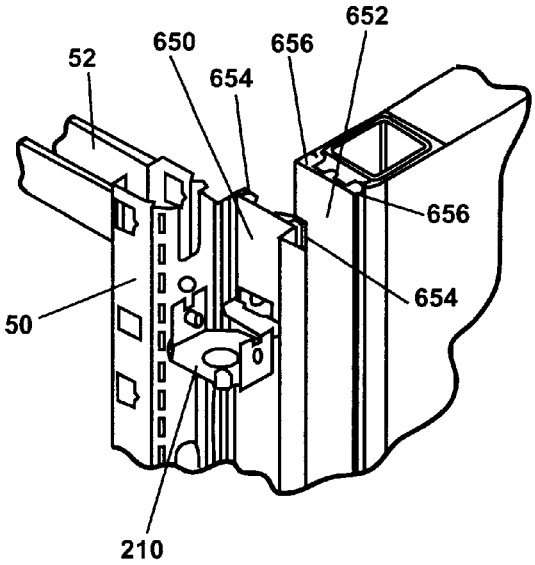
FIG. 43A is a fragmentary perspective view of an upper portion of a frame provided with a starter rail adapted to interface the frame of the workspace definition system according to the invention with a prior art workspace definition system.
Figure 43B:
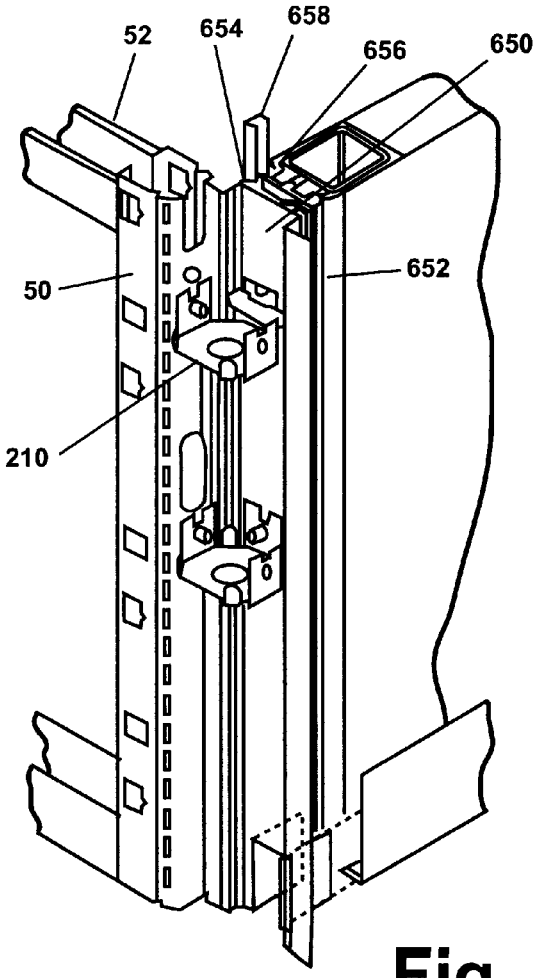
FIG. 43B is a fragmentary perspective view showing the interconnection of a living hinge between the starter rail of FIG. 43A and the existing workspace definition system.
Figure 43C:
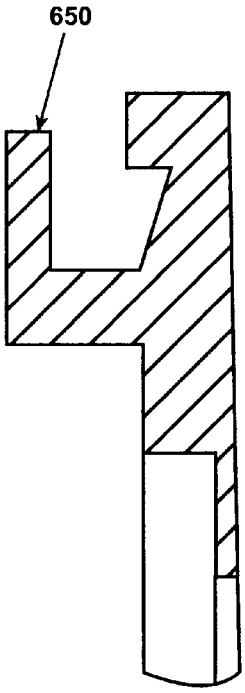
FIG. 43C is an enlarged cross-sectional view of a mounting flange for the starter rail of FIGS. 43A–43B for providing a secure mounting between the frame of the workspace definition system described herein and the prior art workspace definition system.

FIG. 43A shows an upper, terminal portion of a frame 14 provided with a starter rail 650 adapted to interface with the vertical rail 652 and, in turn, with the frame of another workspace definition system, such as those commercially available from Trendway Corporation, and which comprise a series of frames interconnected in a manner similar to that described herein. To secure a frame 14 of the present invention to a prior art frame, a connector 210 (as shown in FIG. 17) can be used to secure the vertical rail 50 to a starter rail 650 at a complementary angle. The starter rail 650 can be then aligned with the vertical rail 652 of the prior art system as shown in FIG. 431B. Once both the starter rail 650 and the prior art vertical rail 652 are aligned, a living hinge 658 is slidably mounted to channels 654 and 656, respectively. FIG. 43C is provided merely for illustrative purposes and shows an enlarged cross-sectional view of the starter rail 650 of FIGS. 43A–43B for providing a secure mounting between the frame of the workspace definition system described herein and the prior art workspace definition system.

Figure 44A:
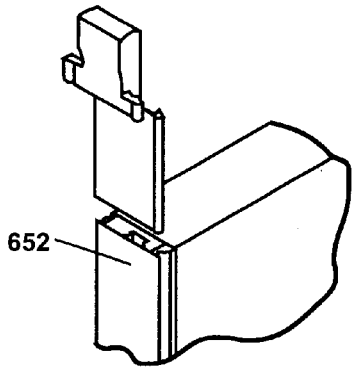
FIG. 44A is a fragmentary perspective view of a top bracket for interconnecting a frame of an existing prior art workspace definition system with a frame of the workspace definition system described herein showing the slidable mounting of the top bracket into the frame of the existing prior art workspace definition system.
Figure 44D:
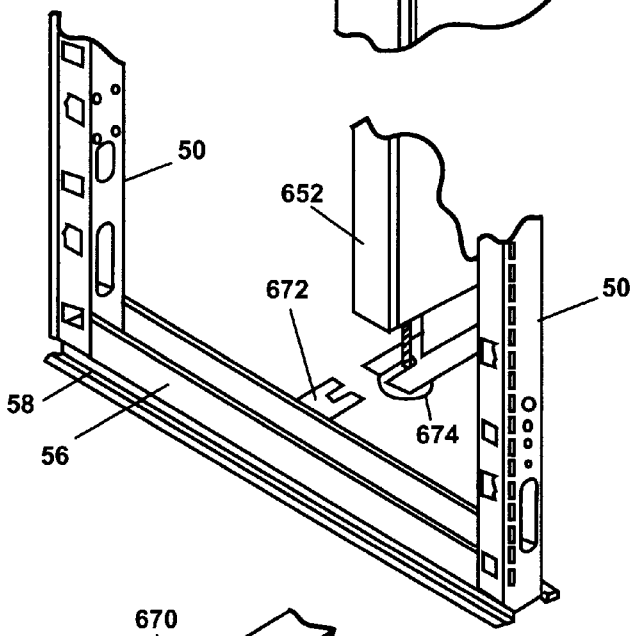
FIG. 44D is a fragmentary perspective view showing a bottom bracket mounted to a bump rail of the frame of the workspace definition system described herein showing the placement of the bottom bracket adjacent to a glide depending from an existing frame of a prior art workspace definition system.
Figure 44B:
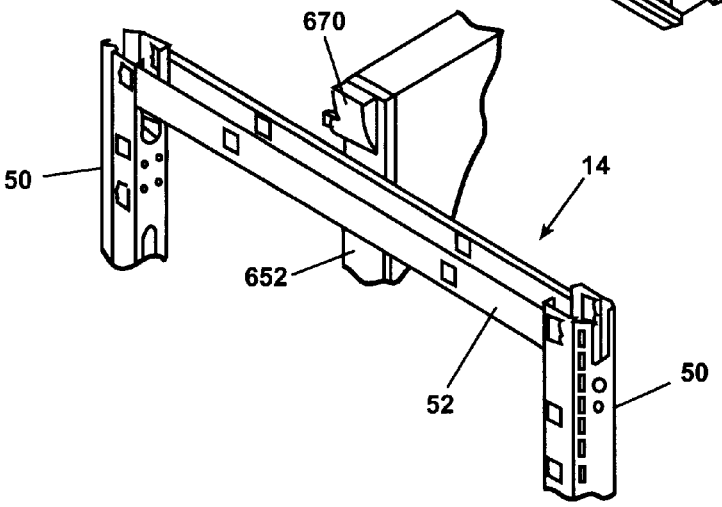
FIG. 44B is a fragmentary perspective view of the top bracket mounted to the existing prior art workspace definition system frame adjacent to a frame of the workspace definition system of the invention described herein.
Figure 44E:
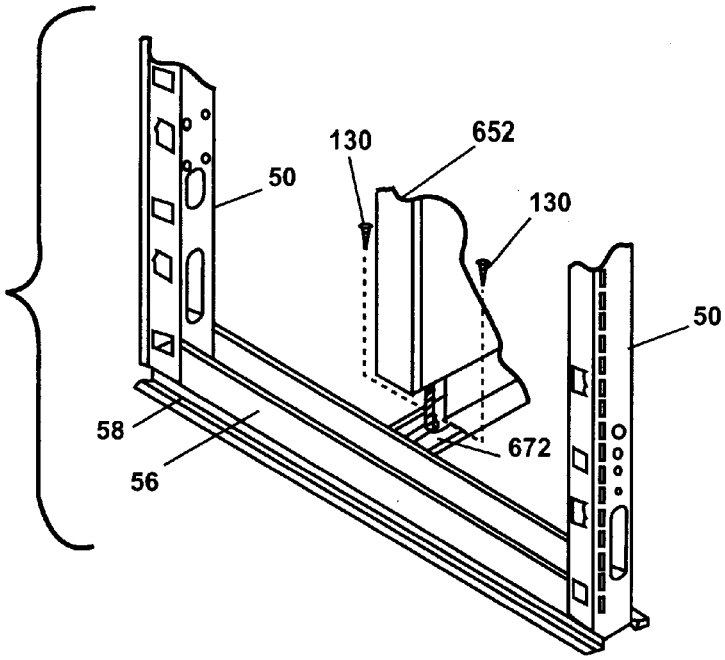
FIG. 44E is a fragmentary perspective view showing the bottom bracket of FIG. 44D received over the glide of the prior art workspace definition system and secured thereto by fasteners.
Figure 44C:
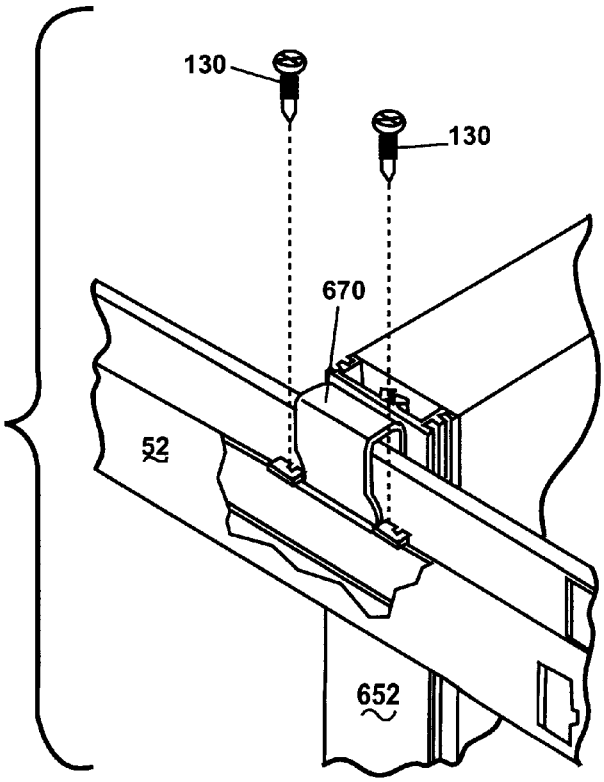
FIG. 44C is a enlarged fragmentary perspective view showing the mounting of a hook portion of the top bracket of FIGS. 44A–44B over a top rail of the frame of the workspace definition system described herein and secured thereto by a pair of fasteners.

FIGS. 44A–E show an intermediate (non-terminal) interconnection of a frame 14 in accordance with the present invention to the terminal end of a prior art frame. In particular, FIG. 44A shows a top bracket 670 which is sliding mounted onto the upper portion of a vertical rail 652 and, in turn, a frame of a prior art workspace definition system. FIG. 44B shows the top bracket 670 mounted to the vertical rail 652 of the prior art workspace definition system perpendicular and adjacent to the frame 14 of the workspace definition system of the invention described herein. As can be seen in FIG. 44C, once top bracket 670 is mounted on the top rail 52 of the present invention, the bracket 670 is secured thereto by a pair of fasteners 130. After the top bracket is secured, a bottom bracket 672, which is mounted to the bump rail 58, is placed adjacent to a glide 674 of the prior art frame . As shown in FIG. 44E, the bottom bracket 672 is then received over the glide 674 of the prior art workspace definition system and secured thereto by a pair of fasteners 130.

Figure 45A:
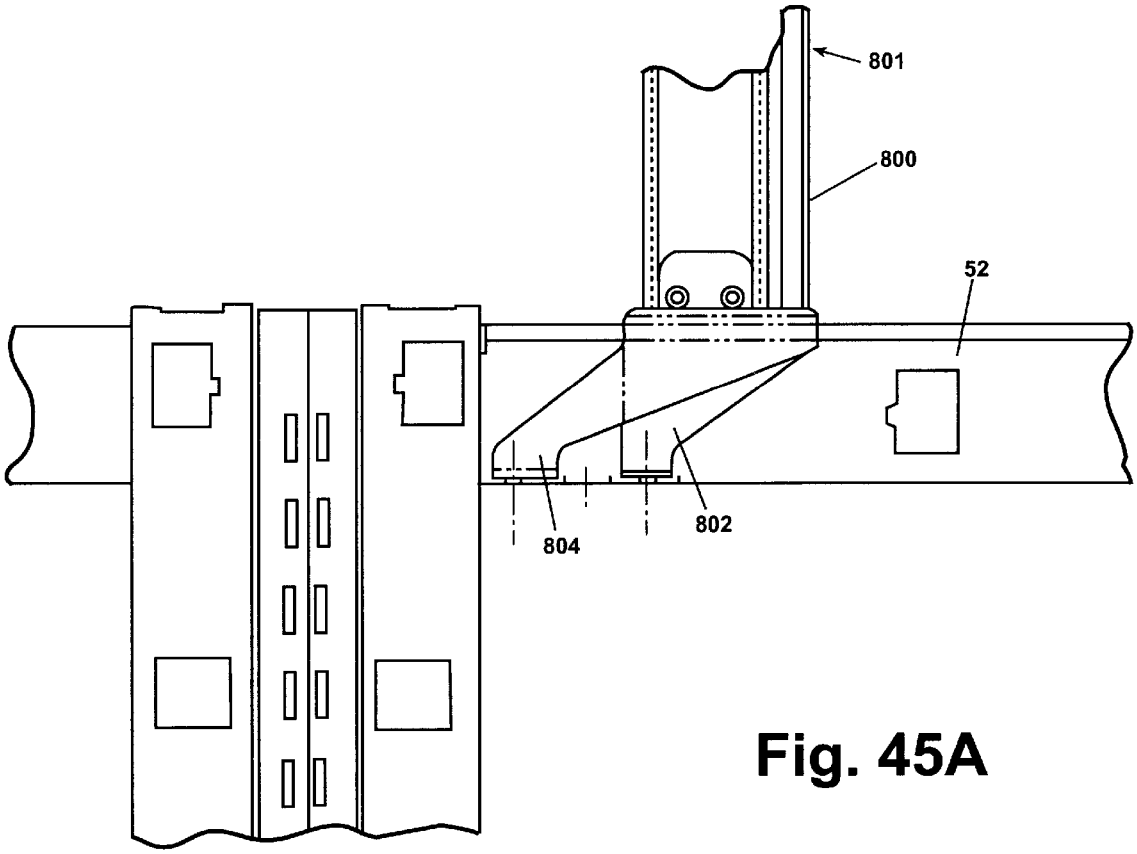
FIG. 45A is a fragmentary side elevational view showing a power pole extending between a ceiling surface and a top rail of the workspace definition system described herein and interconnected thereto by a short bracket and a long bracket.
Figure 45B:
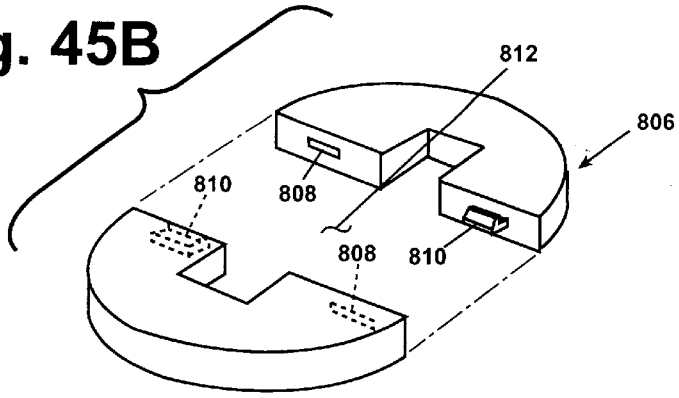
FIG. 45B shows a two-piece trim cover for concealing the interface between the power pole of 45A and the ceiling surface.

When electrical and/or data conduit 40 is received from an elevated resource, such as a ceiling, a power pole can be integrated into the workspace definition system for both safety and aesthetic purposes. As shown in FIG. 45A, a power pole 800 can extend between a ceiling surface 801 and a top rail 52 of the workspace definition system 10 described herein and interconnected thereto by a short bracket 802 and a long bracket 804. As shown in FIG. 45B a two-piece trim cover 806 can be used to conceal the interface between the power pole 800 of FIG. 45A and the ceiling surface 801. The two-piece cover 806 includes an aperture region 812 for accommodating electrical and/or data conduit 40. The two-piece cover 806 has a pair of tabs 810 that are lockably received in a pair of slots 808.

Figure 45C:
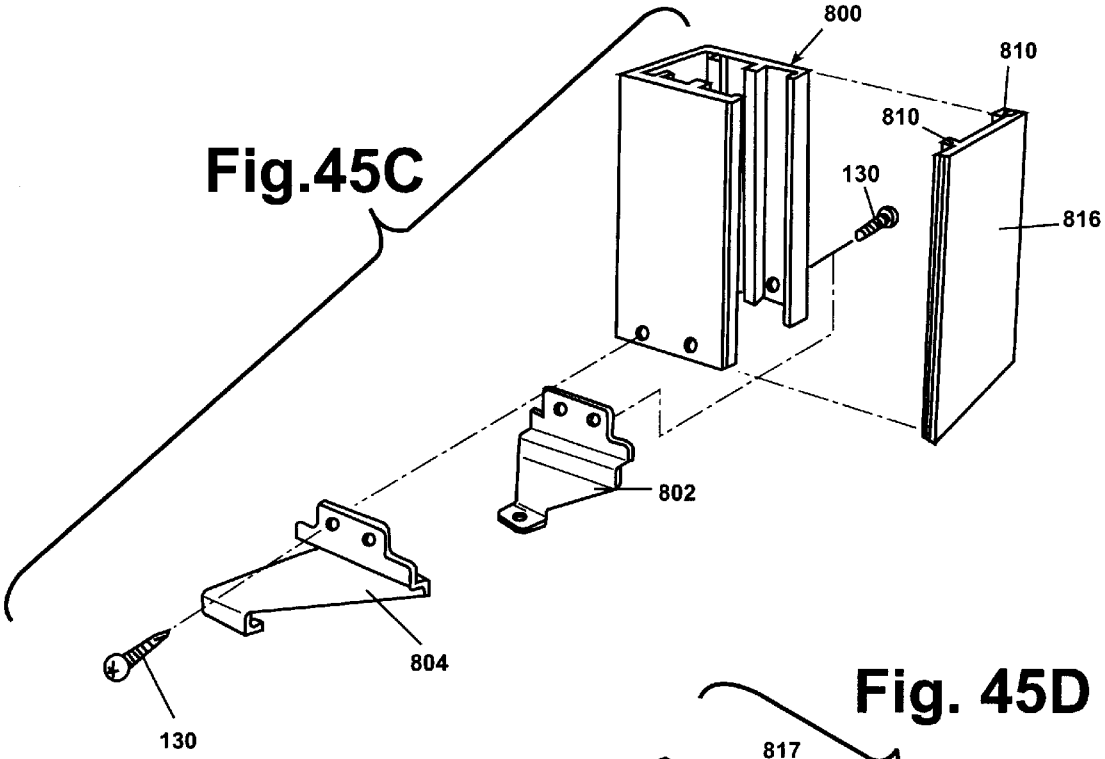
FIG. 45C is a exploded perspective view showing the power pole of FIG. 45A comprising a C-shaped channel and a snap-fit cover for mounting thereto and also showing an interconnection of the short and long brackets of FIG. 45A to a lower portion thereof.

FIG. 45C shows the power pole 800 of FIG. 45A comprising a C-shaped channel and a snap-fit cover 816 for mounting thereto and also showing an interconnection of the short and long brackets 802 and 804 respectively, which are secured by fasteners 130 to a lower portion thereof.

Figure 45D:
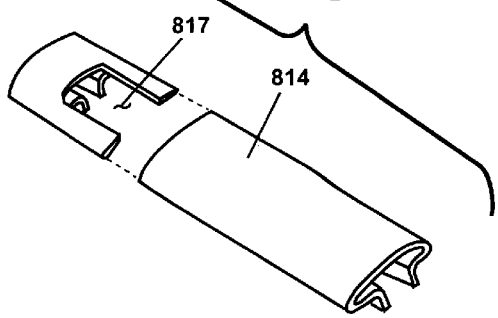
FIG. 45D is a fragmentary perspective view showing an alternative embodiment of the top cap shown in FIG. 13 provided with a recess adapted to accommodate a lower portion of the power pole of FIGS. 45A–45C to, in turn, conceal the interface between the power pole and the frame of the workspace definition system

FIG. 45D shows a top cap 814 (similar to that in FIG. 13) provided with a recessed region 817, which is adapted to accommodate a lower portion of the power pole 800 of FIGS. 45A–45C to conceal the interface between the power pole 800 and the frame 14 of the workspace definition system 10.

While particular embodiments of the invention have been shown, it will be understood, of course, that the invention is not limited thereto since modifications may be made by those skilled in the art, particularly in light of the foregoing teachings. Reasonable variation and modification are possible within the scope of the foregoing disclosure of the invention without departing from the spirit of the invention.

What is claimed is:

1. In an improved workspace management system for dividing a space into separate work areas comprising:

a rigid structural framework formed of rigid rectangular frames rigidly joined together at the edges thereof to form at least one work area;

each of the frames having outer faces on opposite sides thereof and openings on the opposite sides of the frames;

a plurality of interchangeable tiles, with each of the tiles having a connector cooperating with the openings on the frames for removably mounting said tiles to the frames for ease of placement on and removal from the frames;

the tiles being mounted to the outer faces of the frames to substantially cover both sides of the frames from a bottom portion thereof to a top thereof in juxtaposed parallel relationship;

the improvement comprising:

at least one of the frames comprises at least one load rail mounted horizontally between a pair of vertical rails and U shaped in cross section, the upper ends of the legs of the U shape having a reinforcing lip thereon;

a pair of the tiles mounted to the at least one of the frames forms a horizontal access slot therebetween; and the horizontal access slot between the pair of the tiles is positioned in register with the upper ends of the legs of the U shaped load rail whereby a component can be mounted to the frame and afforded the stability of the load rail with the reinforcing lip in a convenient fashion without affecting the overall aesthetic appearance of the system since the component is conveniently mounted to the load rail through the access slot between the pair of tiles.

2. The system of claim 1 wherein the U shape in the load bar forms a horizontal recess, the vertical rails have an opening in register with the horizontal recess for routing conduit throughout the framework.

3. The system of claim 1 wherein each of the frames further comprises a pair of opposed vertical rails having edge faces and outer faces thereon, the edge faces being interconnected with the outer faces of the vertical rails by ramped portions which are at an acute angle with respect to the edge faces and the outer faces; a series of aligned vertical slots in the ramped portions; the tiles extend horizontally at least as far as the vertical slots to block light from passing directly from one side of the frame to the other side of the frame through the aligned vertical slots.

4. The system of claim 1 wherein the rigid rectangular frames comprises a first frame having a first edge face in abutment with a second edge face of a second frame positioned adjacent to the first frame so that the first and second edge faces are in abutment, the first edge face further comprises a threaded aperture and the second edge face has an aperture in registry with the threaded aperture of the first edge face and a threaded bolt extending through the apertures of the second edge face and threadably received in the threaded apertures in the first edge face to rigidly join the first and second frames together.

5. The system of claim 1 wherein each frame has an upper rail having an upper portion thereon, the upper rail upper portion has a reinforcing lip thereon adapted to support at least one modular component.

6. The system of claim 1 wherein at least two adjacent frames in the rigid structural framework being of different heights, wherein a taller of the two adjacent frames has a cover mounted to an upper portion of an edge face thereof between the upper surfaces of the two adjacent frames to conceal the portion of the edge face of the taller frame above the shorter frame; at least one bracket mounted to the portion of the edge face of the taller frame above the shorter frame; the cover forms an open-sided channel with end portions mounted to the bracket, thereby leaving the channel open for routing electrical/data cables therethrough.

7. The system of claim 1 wherein at least two adjacent frames having edge faces positioned adjacent to one another, the adjacent frames being connected together by at least one spacer and a cover is mounted to the spacer between the adjacent frames to conceal the spacer; the spacer comprises at least one bracket having a generally vertical portion mounted to the edge faces of the adjacent frames and a generally horizontal portion having at least one of a slot and a projection; the cover has the other of the slot and the projection in register with the one of the slot and the projection on the spacer; whereby the cover is removably mounted to the spacer by insertion of the projection into the slot to conceal the area between the adjacent frames.

8. The system of claim 1 wherein at least one of the frames has a bump rail extending outwardly from a lower portion thereof to a greater extent than the plurality of interchangeable tiles to protect lower edges of the tiles from damage by occupants of the system or the operation of floor cleaning devices.

9. The system of claim 1 wherein at least one of the frames further comprises a pair of opposed vertical rails having an opening at each upper end thereof; and further comprising at least one inverted U-shaped extension frame having a pair of depending legs, each leg having a cross-sectional shape congruent with the cross-sectional shape of the opening on the vertical rail upper ends; whereby the at least one extension frame increases the overall height of the at least one of the frames when the legs are mounted within the openings.

10. The system of claim 1 wherein the rigid structural framework includes an end frame terminating a given distance from an existing wall bounding the space; a filler panel assembly comprising a filler bracket mounted to the existing wall, a filler frame adapted to be mounted to the end frame and the filler bracket, and at least one filler tile mounted to the filler frame to define a wall extension with the plurality of interchangeable tiles mounted to the frames between the end frame and the existing wall; the filler frame having a horizontal dimension less than the given distance; and an adjustable rod mounted to the filler frame and to the filler bracket to secure the filler frame to the filler bracket.

11. The system of claim 1 wherein the reinforcing lip comprises an inwardly rolled portion forming a hook.

12. The system of claim 11 and further comprising a component, wherein the component has a bracket mounted to the load rail so that the component is supported by the at least one frame via the bracket.

13. The system of claim 12 wherein the bracket is slidably mounted to the load rail.

14. The system of claim 12 wherein electrical power blocks are mounted within the load rail inwardly of the component bracket whereby the bracket can slide along the rail.

15. The system of claim 12 wherein the bracket comprises a first portion adapted to mount to the load rail and having one of a flange and a slot and a second portion mounted to the component and having the other of a flange and a slot, wherein the flange is adapted to be removably mounted within the slot to removably mount the component to the first portion of the bracket.

16. The system of claim 1 wherein the load rail has at least one internal rib on bottom surface.

17. The system of claim 16 and further comprising a component having a bracket, wherein the bracket on the component seats behind the internal rib.

18. The system of claim 17 wherein the component is a work surface.

19. The system of claim 17 wherein the component is a cabinet.

20. The system of claim 17 wherein the component has a first width, the frame has a second width and the first width is different than the second width.

21. In an improved workspace management system for dividing a space into separate work areas comprising:

a rigid structural framework formed of rigid rectangular frames rigidly joined together at the edges thereof to form at least one work area;

each of the frames having openings on the opposite sides of the frames;

a plurality of interchangeable tiles, with each of the tiles having a connector cooperating with the openings on the frames for removably mounting said tiles to the frames for ease of placement on and removal from the frames;

the tiles being mounted to the outer faces of the frames to substantially cover both sides of the frames from a bottom portion thereof to a top thereof in juxtaposed parallel relationship;

the improvement comprising:

each of the frames further comprises a pair of opposed vertical rails having edge faces thereon and outer faces on opposing sides thereof, the edge faces being interconnected with the outer faces of the vertical rails by ramped portions which are at an acute angle with respect to the edge faces and the outer faces;

a series of aligned vertical slots in the ramped portions;

the tiles extend horizontally at least as far as the vertical slots to block light from passing directly from one side of the frame to the other side of the frame through the aligned vertical slots.

22. The system of claim 21 wherein the rigid rectangular frames comprises a first frame having a first edge face in abutment with a second edge face of a second frame positioned adjacent to the first frame so that the first and second edge faces are in abutment, the first edge face further comprises a threaded aperture and the second edge face has an aperture in registry with the threaded aperture of the first edge face and a threaded bolt extending through the apertures of the second edge face and threadably received in the threaded apertures in the first edge face to rigidly join the first and second frames together.

23. The system of claim 21 wherein each frame has an upper rail having an upper portion thereon, the upper rail upper portion has a reinforcing lip thereon adapted to support at least one modular component.

24. The system of claim 21 wherein at least two adjacent frames in the rigid structural framework being of different heights, wherein a taller of the two adjacent frames has a cover mounted to an upper portion of an edge face thereof between the upper surfaces of the two adjacent frames to conceal the portion of the edge face of the taller frame above the shorter frame; at least one bracket mounted to the portion of the edge face of the taller frame above the shorter frame; the cover forms an open-sided channel with end portions mounted to the bracket, thereby leaving the channel open for routing electrical/data cables therethrough.

25. The system of claim 21 wherein at least two adjacent frames being connected together by at least one spacer and a cover is mounted to the spacer between the adjacent frames to conceal the spacer; the spacer comprises at least one bracket having a generally vertical portion mounted to the edge faces of the adjacent frames and a generally horizontal portion having at least one of a slot and a projection; the cover has the other of the slot and the projection in register with the one of the slot and the projection on the spacer; whereby the cover is removably mounted to the spacer by insertion of the projection into the slot to conceal the area between the adjacent frames.

26. The system of claim 21 wherein at least one of the frames has a bump rail extending outwardly from a lower portion thereof to a greater extent than the plurality of interchangeable tiles to protect lower edges of the tiles from damage by occupants of the system or the operation of floor cleaning devices.

27. The system of claim 21 wherein at least one of the frames further comprises a pair of opposed vertical rails having an opening at each upper end thereof; and further comprising at least one inverted U-shaped extension frame having a pair of depending legs, each leg having a cross-sectional shape congruent with the cross-sectional shape of the opening on the vertical rail upper ends; whereby the at least one extension frame increases the overall height of the at least one of the frames when the legs are mounted within the openings.

28. The system of claim 21 wherein the rigid structural framework includes an end frame terminating a given distance from an existing wall bounding the space; a filler panel assembly comprising a filler bracket mounted to the existing wall, a filler frame adapted to be mounted to the end frame and the filler bracket, and at least one filler tile mounted to the filler frame to define a wall extension with the plurality of interchangeable tiles mounted to the frames between the end frame and the existing wall; the filler frame having a horizontal dimension less than the given distance; and an adjustable rod mounted to the filler frame and to the filler bracket to secure the filler frame to the filler bracket.

29. The system of claim 21 wherein the edge faces on each vertical rail have a projection and a recess both extending along the vertical length of the rail in laterally spaced juxtaposed relationship to one another whereby the projection on one end face is received within the recess on an adjacent end face when a pair frames are placed into edge abutment with one another to prevent light from passing between the abutting end faces.

30. The system of claim 29 wherein at least one of the frames has a threaded opening in a lower portion thereof and the at least one of the frames further comprises at least one floor-engaging glide having a threaded shaft which is threadably received in the threaded opening in the frame, and the threaded shaft has a hexagonal head on an upper portion thereof whereby the at least one glide can be adjusted relative to the frame lower portion by a conventional socket tool when the frames are assembled.

31. The system of claim 30 wherein the frames further comprise apertures in the edge faces thereof, at least one of the apertures in a pair of abutting frames is threaded, and further comprising at least one bolt which extends through the apertures in the abutting edge faces.

32. In an improved workspace management system for dividing a space into separate work areas comprising:

a rigid structural framework formed of rigid rectangular frames rigidly joined together at edge faces thereof to form at least one work area;

each of the frames having outer faces on opposite sides thereof and openings on the opposite sides of the frames;

a plurality of interchangeable tiles, with each of the tiles having a connector cooperating with the openings on the frames for removably mounting said tiles to the frames for ease of placement on and removal from the frames;

the tiles being mounted to the outer faces of the frames to substantially cover both sides of the frames from a bottom portion thereof to a top thereof in juxtaposed parallel relationship;

the improvement comprising:

the frames comprises at least a first frame having a first edge face in abutment with a second edge face of a second frame positioned adjacent to the first frame so that the first and second edge faces are in abutment, the first edge face further comprises a threaded aperture and the second edge face has an aperture in registry with the threaded aperture of the first edge face and a threaded bolt extending through the apertures of the second edge face and threadably received in the threaded apertures in the first edge face to rigidly join the first and second frames together.

33. The system of claim 32 wherein each frame has an upper rail having an upper portion thereon, the upper rail upper portion has a reinforcing lip thereon adapted to support at least one modular component.

34. The system of claim 32 wherein at least two adjacent frames in the rigid structural framework being of different heights, wherein a taller of the two adjacent frames has a cover mounted to an upper portion of an edge face thereof between the upper surfaces of the two adjacent frames to conceal the portion of the edge face of the taller frame above the shorter frame; at least one bracket mounted to the portion of the edge face of the taller frame above the shorter frame; the cover forms an open-sided channel with end portions mounted to the bracket, thereby leaving the channel open for routing electrical/data cables therethrough.

35. The system of claim 32 wherein at least two adjacent frames being connected together by at least one spacer and a cover is mounted to the spacer between the adjacent frames to conceal the spacer; the spacer comprises at least one bracket having a generally vertical portion mounted to the edge faces of the adjacent frames and a generally horizontal portion having at least one of a slot and a projection; the cover has the other of the slot and the projection in register with the one of the slot and the projection on the spacer; whereby the cover is removably mounted to the spacer to conceal the area between the adjacent frames.

36. The system of claim 32 wherein at least one of the frames has a bump rail extending outwardly from a lower portion thereof to a greater extent than the plurality of interchangeable tiles to protect lower edges of the tiles from damage by occupants of the system or the operation of floor cleaning devices.

37. The system of claim 32 wherein at least one of the frames further comprises a pair of opposed vertical rails having an opening at each upper end thereof; and further comprising at least one inverted U-shaped extension frame having a pair of depending legs, each leg having a cross-sectional shape congruent with the cross-sectional shape of the opening on the vertical rail upper ends; whereby the at least one extension frame increases the overall height of the at least one of the frames when the legs are mounted within the openings.

38. The system of claim 32 wherein the rigid structural framework includes an end frame terminating a given distance from an existing wall bounding the space; a filler panel assembly comprising a filler bracket mounted to the existing wall, a filler frame adapted to be mounted to the end frame and the filler bracket, and at least one filler tile mounted to the filler frame to define a wall extension with the plurality of interchangeable tiles mounted to the frames between the end frame and the existing wall; the filler frame having a horizontal dimension less than the given distance; and an adjustable rod mounted to the filler frame and to the filler bracket to secure the filler frame to the filler bracket.

39. The system of claim 32 wherein the threaded aperture comprises an integral threaded sleeve having a thickness greater than the thickness of the one edge face.

40. The system of claim 39 wherein the integral threaded sleeve comprises a flow drilled length of material formed inwardly from the one edge face.

41. In an improved workspace management system for dividing a space into separate work areas comprising:

a rigid structural framework formed of rigid rectangular frames rigidly joined together at the edge faces thereof to form at least one work area;

each of the frames having outer faces on opposite sides thereof and openings on the opposite sides of the frames;

each of the frames has an upper rail open at an upper portion thereof and defining an internal channel adapted to receive electrical/data cables;

a plurality of interchangeable tiles, with each of the tiles having a connector cooperating with the openings on the frames for removably mounting said tiles to the frames for ease of placement on and removal from the frames;

the tiles are mounted to the outer faces of the frames to substantially cover both sides of the frames from a bottom portion thereof to a top thereof in juxtaposed parallel relationship;

the improvement comprising:

the upper rail upper portion has a reinforcing lip thereon adapted to support at least one modular component, wherein the reinforcing lip comprises an inwardly rolled portion forming a hook.

42. The system of claim 41 wherein the at least one modular component is a cabinet.

43. The system of claim 41 wherein the vertical rails have an opening in register with the channel in the upper rail for routing the electrical/data cables throughout the framework.

44. The system of claim 41 wherein at least two adjacent frames in the rigid structural framework being of different heights, wherein a taller of the two adjacent frames has a cover mounted to an upper portion of an edge face thereof between the upper surfaces of the two adjacent frames to conceal the portion of the edge face of the taller frame above the shorter frame; at least one bracket mounted to the portion of the edge face of the taller frame above the shorter frame; the cover forms an open-sided channel with end portions mounted to the bracket, thereby leaving the channel open for routing electrical/data cables therethrough.

45. The system of claim 41 wherein at least two adjacent frames being connected together by at least one spacer and a cover is mounted to the spacer between the adjacent frames to conceal the spacer; the spacer comprises at least one bracket having a generally vertical portion mounted to the edge faces of the adjacent frames and a generally horizontal portion having at least one of a slot and a projection; the cover has the other of the slot and the projection in register with the one of the slot and the projection on the spacer; whereby the cover is removably mounted to the spacer by insertion of the projection into the slot to conceal the area between the adjacent frames.

46. The system of claim 41 wherein at least one of the frames has a bump rail extending outwardly from a lower portion thereof to a greater extent than the plurality of interchangeable tiles to protect lower edges of the tiles from damage by occupants of the system or the operation of floor cleaning devices.

47. The system of claim 41 wherein at least one of the frames further comprises a pair of opposed vertical rails having an opening at each upper end thereof; and further comprising at least one inverted U-shaped extension frame having a pair of depending legs, each leg having a cross-sectional shape congruent with the cross-sectional shape of the opening on the vertical rail upper ends; whereby the at least one extension frame increases the overall height of the at least one of the frames when the legs are mounted within the openings.

48. The system of claim 41 wherein the rigid structural framework includes an end frame terminating a given distance from an existing wall bounding the space; a filler panel assembly comprising a filler bracket mounted to the existing wall, a filler frame adapted to be mounted to the end frame and the filler bracket, and at least one filler tile mounted to the filler frame to define a wall extension with the plurality of interchangeable tiles mounted to the frames between the end frame and the existing wall; the filler frame having a horizontal dimension less than the given distance; and an adjustable rod mounted to the filler frame and to the filler bracket to secure the filler frame to the filler bracket.

49. The system of claim 41 and further comprising at least one modular component having a bracket mounted to the reinforcing lip of the upper rail.

50. The system of claim 49 wherein upper rail has at least one internal rib on bottom surface.

51. The system of claim 50 wherein the bracket on component seats behind the internal rib.

52. The system of claim 41 wherein the at least one modular component comprises a frame mounted generally perpendicular to the upper rail intermediate the ends thereof.

53. The system of claim 52 and further comprising a bracket rigidly mounted to the perpendicular frame and having a flange mounted over the reinforcing lip of the upper rail.

54. The system of claim 52 wherein the component has first width, the frame has second width and the first width is different than second width.

55. The system of claim 41 wherein the rigid framework comprises a first rigid frame positioned with respect to a second rigid frame in a generally perpendicular relationship intermediate the edge faces thereof and a first bracket rigidly mounted to the first frame and having a flange mounted to an upper portion of the second frame.

56. The system of claim 55 and further comprising a second bracket rigidly mounted to a lower portion of the first frame and having a flange mounted to a lower portion of the second frame.

57. In an improved workspace management system for dividing a space into separate work areas comprising:

a rigid structural framework formed of rigid rectangular frames rigidly joined together at edge faces thereof to form at least one work area;

at least two adjacent frames in the rigid structural framework being of different heights, wherein a taller of the two adjacent frames has a cover mounted to an upper portion of an edge face thereof between the upper surfaces of the two adjacent frames to conceal the portion of the edge face of the taller frame above the shorter frame;

each of the frames having outer faces on opposite sides thereof and openings on the opposite sides of the frames;

a plurality of interchangeable tiles, with each of the tiles having a connector cooperating with the openings on the frames for removably mounting said tiles to the frames for ease of placement on and removal from the frames;

the tiles being mounted to the outer faces of the frames to substantially cover both sides of the frames from a bottom portion thereof to a top thereof in juxtaposed parallel relationship;

the improvement comprising:

at least one bracket mounted to the portion of the edge face of the taller frame above the shorter frame;

the cover forms an open-sided channel with end portions mounted to the bracket, thereby leaving the channel open for routing electrical/data cables therethrough.

58. The system of claim 57 wherein at least two adjacent frames being connected together by at least one spacer and a cover is mounted to the spacer between the adjacent frames to conceal the spacer; the spacer comprises at least one bracket having a generally vertical portion mounted to the edge faces of the adjacent frames and a generally horizontal portion having at least one of a slot and a projection; the cover has the other of the slot and the projection in register with the one of the slot and the projection on the spacer; whereby the cover is removably mounted to the spacer by insertion of the projection into the slot to conceal the area between the adjacent frames.

59. The system of claim 57 wherein at least one of the frames has a bump rail extending outwardly from a lower portion thereof to a greater extent than the plurality of interchangeable tiles to protect lower edges of the tiles from damage by occupants of the system or the operation of floor cleaning devices.

60. The system of claim 57 wherein at least one of the frames further comprises a pair of opposed vertical rails having an opening at each upper end thereof; and further comprising at least one inverted U-shaped extension frame having a pair of depending legs, each leg having a cross-sectional shape congruent with the cross-sectional shape of the opening on the vertical rail upper ends; whereby the at least one extension frame increases the overall height of the at least one of the frames when the legs are mounted within the openings.

61. The system of claim 57 wherein the rigid structural framework includes an end frame terminating a given distance from an existing wall bounding the space; a filler panel assembly comprising a filler bracket mounted to the existing wall, a filler frame adapted to be mounted to the end frame and the filler bracket, and at least one filler tile mounted to the filler frame to define a wall extension with the plurality of interchangeable tiles mounted to the frames between the end frame and the existing wall; the filler frame having a horizontal dimension less than the given distance; and an adjustable rod mounted to the filler frame and to the filler bracket to secure the filler frame to the filler bracket.

62. The system of claim 57 wherein the end portions include a projection mounted to the bracket.

63. The system of claim 62 wherein the bracket has outwardly extending support flanges and the cover has inwardly directed ends which are snap-fit behind the support flanges.

64. In an improved workspace management system for dividing a space into separate work areas comprising:

a rigid structural framework formed of rigid rectangular frames rigidly joined together at edge faces thereof to form at least one work area;

at least two adjacent frames being connected together by at least one spacer and a cover is mounted to the spacer between the adjacent frames to conceal the spacer;

each of the frames having outer faces on opposite sides thereof and openings on the opposite sides of the frames;

a plurality of interchangeable tiles, with each of the tiles having a connector cooperating with the openings on the frames for removably mounting said tiles to the frames for ease of placement on and removal from the frames;

the tiles being mounted to the outer faces of the frames to substantially cover both sides of the frames from a bottom portion thereof to a top thereof in juxtaposed parallel relationship;

the improvement comprising:

the spacer comprises at least one bracket having a generally vertical portion mounted to the edge faces of the adjacent frames and a generally horizontal portion having at least one of a slot and a projection;

the cover has the other of the slot and the projection in register with the one of the slot and the projection on the spacer;

whereby the cover is removably mounted to the spacer by insertion of the projection into the slot to conceal the area between the adjacent frames.

65. The system of claim 64 wherein each of the frames has alignment openings and mounting apertures on the edge faces, the spacer has alignment tabs which extend into the alignment openings in the frames.

66. The system of claim 64 wherein the at least two adjacent frames are joined at a 90 degree angle with respect to one another.

67. The system of claim 64 wherein the at least two adjacent frames are joined at a 135 degree angle with respect to one another.

68. The system of claim 64 wherein the at least two adjacent frames are joined at a 180 degree angle with respect to one another.

69. The system of claim 64 the at least two adjacent frames comprises three adjacent frames joined at least at a 90 degree angle therebetween.

70. The system of claim 64 wherein the spacer has a threaded nut mounted thereto and the spacer is secured to the edge faces of the adjacent frames by a threaded fastener which extends through the edge face of the adjacent frames and is threaded onto the nut.

71. The system of claim 64 wherein at least one of the frames has a bump rail extending outwardly from a lower portion thereof to a greater extent than the plurality of interchangeable tiles to protect lower edges of the tiles from damage by occupants of the system or the operation of floor cleaning devices.

72. The system of claim 64 wherein at least one of the frames further comprises a pair of opposed vertical rails having an opening at each upper end thereof; and further comprising at least one inverted U-shaped extension frame having a pair of depending legs, each leg having a cross-sectional shape congruent with the cross-sectional shape of the opening on the vertical rail upper ends; whereby the at least one extension frame increases the overall height of the at least one of the frames when the legs are mounted within the openings.

73. The system of claim 64 wherein the rigid structural framework includes an end frame terminating a given distance from an existing wall bounding the space; a filler panel assembly comprising a filler bracket mounted to the existing wall, a filler frame adapted to be mounted to the end frame and the filler bracket, and at least one filler tile mounted to the filler frame to define a wall extension with the plurality of interchangeable tiles mounted to the frames between the end frame and the existing wall; the filler frame having a horizontal dimension less than the given distance; and an adjustable rod mounted to the filler frame and to the filler bracket to secure the filler frame to the filler bracket.

74. The system of claim 64 wherein the generally horizontal portion of the spacer has a central opening adapted to receive electrical/data cables therethrough.

75. The system of claim 74 wherein the cover has a central opening in register with the spacer central opening for routing of electrical/data cables therethrouugh.

76. The system of claim 75 wherein the cover has inwardly-directed flanges thereon which are received behind edges of the generally horizontal portion of the spacer.

77. In an improved workspace management system for dividing a space into separate work areas comprising:

a rigid structural framework formed of rigid structure rectangular frames rigidly joined together at the edges thereof to form at least one work area;

each of the frames having outer faces on opposite sides thereof and openings on the opposite sides of the frames;

a plurality of interchangeable tiles, with each of the tiles having a connector cooperating with the openings on the frames for removably mounting said tiles to the frames for ease of placement on and removal from the frames;

the tiles being mounted to the outer faces of the frames to substantially cover both sides of the frames from a bottom portion thereof to a top thereof in juxtaposed parallel relationship;

the improvement comprising:

at least one of the frames has a bump rail mounted to the at least one of the frames and extending outwardly from a lower portion thereof to a greater extent than the plurality of interchangeable tiles to protect lower edges of the tiles from damage by occupants of the system or the operation of floor cleaning devices.

78. The system of claim 77 wherein the bump rail has at least one opening adapted to receive electrical/data cables routed into the system from a floor surface.

79. The system of claim 77 wherein the bump rail has at least one elongated recess in which a lower edge of one of the plurality of interchangeable tiles is received.

80. The system of claim 77 wherein at least one of the frames further comprises a pair of opposed vertical rails having an opening at each upper end thereof; and further comprising at least one inverted U-shaped extension frame having a pair of depending legs, each leg having a cross-sectional shape congruent with the cross-sectional shape of the opening on the vertical rail upper ends; whereby the at least one extension frame increases the overall height of the at least one of the frames when the legs are mounted within the openings.

81. The system of claim 77 wherein the rigid structural framework includes an end frame terminating a given distance from an existing wall bounding the space; a filler panel assembly comprising a filler bracket mounted to the existing wall, a filler frame adapted to be mounted to the end frame and the filler bracket, and at least one filler tile mounted to the filler frame to define a wall extension with the plurality of interchangeable tiles mounted to the frames between the end frame and the existing wall; the filler frame having a horizontal dimension less than the given distance; and an adjustable rod mounted to the filler frame and to the filler bracket to secure the filler frame to the filler bracket.

82. In an improved workspace management system for dividing a space into separate work areas comprising:

a rigid structural framework formed of rigid rectangular main frames rigidly joined together at the edges thereof to form at least one work area;

each of the main frames having outer faces on opposite sides thereof and openings on the opposite sides of the main frames;

a plurality of interchangeable tiles, with each of the tiles having a connector cooperating with the openings on the main frames for removably mounting said tiles to the main frames for ease of placement on and removal from the main frames;

the tiles being mounted to the outer faces of the main frames to substantially cover both sides of the frames from a bottom portion thereof to a top thereof in juxtaposed parallel relationship;

the improvement comprising:

at least one of the main frames further comprises a pair of opposed vertical rails having an opening at each upper end thereof; and at least one inverted U-shaped extension frame having a pair of depending legs, each leg having a cross-sectional shape congruent with the cross-sectional shape of the opening on the vertical rail upper ends;

wherein the depending legs of the at least one extension frame are bolted to the vertical rails;

whereby the at least one extension frame increases the overall height of the at least one of the main frames when the legs are mounted within the openings.

83. The system of claim 82 wherein the depending legs of the at least one extension frame are of a sufficient length to prevent the extension frame from rocking with respect to the main frame.

84. The system of claim 82 wherein the depending legs of the at least one extension frame are U-shaped in cross section.

85. The system of claim 82 wherein the rigid structural framework includes an end frame terminating a given distance from an existing wall bounding the space; a filler panel assembly comprising a filler bracket mounted to the existing wall, a filler frame adapted to be mounted to the end frame and the filler bracket, and at least one filler tile mounted to the filler frame to define a wall extension with the plurality of interchangeable tiles mounted to the frames between the end frame and the existing wall; the filler frame having a horizontal dimension less than the given distance; and an adjustable rod mounted to the filler frame and to the filler bracket to secure the filler frame to the filler bracket.

86. In an improved workspace management system for dividing a space into separate work areas comprising:

a rigid structural framework formed of rigid rectangular frames rigidly joined together at the edges thereof to form at least one work area;

each of the frames having outer faces on opposite sides thereof and openings on the opposite sides of the frames;

a plurality of interchangeable tiles, with each of the tiles having a connector cooperating with the openings on the frames for removably mounting said tiles to the frames for ease of placement on and removal from the frames;

the tiles being mounted to the outer faces of the frames to substantially cover both sides of the frames from a bottom portion thereof to a top portion thereof in juxtaposed parallel relationship;

the rigid structural framework including an end frame terminating a given distance from an existing wall bounding the space;

a filler panel assembly comprising a filler bracket mounted to the existing wall, a filler frame adapted to be mounted to the end frame and the filler bracket, and at least one filler tile mounted to the filler frame to define a wall extension with the plurality of interchangeable tiles mounted to the frames between the end frame and the existing wall;

the improvement comprising:

the filler frame having a horizontal dimension less than the given distance; and an adjustable rod mounted to the filler frame and to the filler bracket to secure the filler frame to the filler bracket.

87. The system of claim 86 wherein the adjustable rod is rigidly secured at one end to the filler bracket and rigidly secured in an adjusted position to the filler frame.

88. In an improved workspace management system for dividing a space into separate work areas comprising:

a rigid structural framework formed of rigid rectangular frames rigidly joined together at the edge faces thereof to form at least one work area;

each of the frames having outer faces on opposite sides thereof and openings on the opposite sides of the frames;

a plurality of interchangeable tiles, with each of the tiles having a connector cooperating with the openings on the frames for removably mounting said tiles to the frames for ease of placement on and removal from the frames;

the tiles are mounted to the outer faces of the frames to substantially cover both sides of the frames from a bottom portion thereof to a top portion thereof in juxtaposed parallel relationship;

the improvement comprising:

each of the edge faces of the rigid rectangular frames has a projection and a recess, both extending along a vertical length of the rigid rectangular frames in juxtaposed relationship to one another defining a longitudinal connection area therebetween; and a connector mounting the edge faces together in the connection area between the projection and the recess whereby the projection on one end face is received within the recess on an adjacent end face when a pair of the rigid rectangular frames are placed into abutment with one another to prevent light from passing between the abutting end faces.

89. In an improved workspace management system for dividing a space into separate work areas comprising:

a rigid structural framework formed of rigid rectangular main frames rigidly joined together at the edges thereof to form at least one work area;

each of the main frames having outer faces on opposite sides thereof and openings on the opposite sides of the main frames;

a plurality of interchangeable tiles, with each of the tiles having a connector cooperating with the openings on the main frames for removably mounting said tiles to the main frames for ease of placement on and removal from the main frames;

the tiles being mounted to the outer faces of the main frames to substantially cover both sides of the frames from a bottom portion thereof to a top thereof in juxtaposed parallel relationship;

the improvement comprising:

at least one of the main frames further comprises a pair of opposed vertical rails having an opening at each upper end thereof; and at least one inverted U-shaped extension frame having a pair of depending legs, each leg having a cross-sectional shape congruent with the cross-sectional shape of the opening on the vertical rail upper ends, wherein the depending legs of the at least one extension frame are U-shaped in cross section;

whereby the at least one extension frame increases the overall height of the at least one of the main frames when the legs are mounted within the openings.

90. The system of claim 89 wherein the depending legs of the at least one extension frame are of a sufficient length to prevent the extension frame from rocking with respect to the main frame.

91. The system of claim 89 wherein the rigid structural framework includes an end frame terminating a given distance from an existing wall bounding the space; a filler panel assembly comprising a filler bracket mounted to the existing wall, a filler frame adapted to be mounted to the end frame and the filler bracket, and at least one filler tile mounted to the filler frame to define a wall extension with the plurality of interchangeable tiles mounted to the frames between the end frame and the existing wall; the filler frame having a horizontal dimension less than the given distance; and an adjustable rod mounted to the filler frame and to the filler bracket to secure the filler frame to the filler bracket.

* * * * *

UNITED STATES PATENT AND TRADEMARK OFFICE

CERTIFICATE OF CORRECTION

PATENT NO. : 6,282,854 B1
DATED : September 4, 2001
INVENTOR(S) : Richard L. Vos et al.

It is certified that error appears in the above-identified patent and that said Letters Patent is hereby corrected as shown below:

Column 32, claim 29,
Line 3, after "pair" insert -- of --.

Column 37, claim 69,
Line 4, after "claim 64" insert -- wherein --.

Signed and Sealed this

Nineteenth Day of March, 2002

*Attest:*

*Attesting Officer*

JAMES E. ROGAN
*Director of the United States Patent and Trademark Office*